US005733055A

United States Patent [19]

Hiramatsu et al.

[11] Patent Number: 5,733,055

[45] Date of Patent: Mar. 31, 1998

[54] RECORDING APPARATUS

[75] Inventors: Soichi Hiramatsu, Yokohama; Shinnosuke Taniishi, Kawasaki; Tetsuo Suzuki, Yokohama; Junichi Asano, Kawasaki; Haruyuki Yanagi, Yokohama; Takashi Nojima, Tokyo; Satoshi Saikawa, Inagi, all of Japan

[73] Assignee: Canon Kabushiki Kaisha, Tokyo, Japan

[21] Appl. No.: 304,431

[22] Filed: Sep. 12, 1994

Related U.S. Application Data

[63] Continuation of Ser. No. 922,766, Jul. 31, 1992, abandoned.

[30] Foreign Application Priority Data

Jul. 31, 1991 [JP] Japan ..... 3-213163
Jul. 31, 1991 [JP] Japan ..... 3-213164

[51] Int. Cl.[6] ..... B41J 2/165

[52] U.S. Cl. ..... 400/355; 400/702; 347/29; 347/30

[58] Field of Search ..... 346/140 PD; 400/320, 400/355, 701, 702; 347/29, 30, 32, 33

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,410,900 | 10/1983 | Terasawa . | |
| 4,459,600 | 7/1984 | Sato et al. . | |
| 4,463,359 | 7/1984 | Ayata et al. . | |
| 4,558,333 | 12/1985 | Sugitani et al. . | |
| 4,723,129 | 2/1988 | Endo et al. . | |
| 4,740,796 | 4/1988 | Endo et al. . | |
| 4,745,414 | 5/1988 | Okamura et al. | 346/140 R |
| 4,825,231 | 4/1989 | Nozaki | 347/22 |
| 4,876,558 | 10/1989 | Mamiya | 346/140 R |
| 5,008,684 | 4/1991 | Kurafuji . | |
| 5,051,761 | 9/1991 | Fisher et al. . | |
| 5,096,315 | 3/1992 | Yamagmoto et al. | 400/222 |
| 5,106,216 | 4/1992 | Kim . | |
| 5,138,343 | 8/1992 | Aichi et al. | 346/140 |
| 5,153,613 | 10/1992 | Yamaguchi et al. | 346/140 |
| 5,162,818 | 11/1992 | Karita et al. | 346/140 |
| 5,168,291 | 12/1992 | Hiramatsu et al. | 347/29 |
| 5,175,566 | 12/1992 | Ejiri et al. | 346/140 |
| 5,182,582 | 1/1993 | Okamura | 346/140 |

FOREIGN PATENT DOCUMENTS

| | | |
|---|---|---|
| 0326168 | 8/1989 | European Pat. Off. . |
| 0423475 | 4/1991 | European Pat. Off. . |
| 0482356 | 4/1992 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |

OTHER PUBLICATIONS

*IBM Technical Disclosure Bulletin*, "Nozzle Guard and Maintenance Station for Drop-On-Demand Printheads", vol. 27, No. 12, pp. 6965–6967, May 1985.

*Primary Examiner*—John S. Hilten
*Attorney, Agent, or Firm*—Fitzpatrick, Cella, Harper & Scinto

[57] ABSTRACT

A recording apparatus is usable with a recording head having an ejection outlet. The recording head is carried on a carriage. The apparatus includes a cap for capping the ejection outlet of the recording head and a suction device for suctioning ink through the ejection outlet of the recording head and through the cap. The cap is unified with a cylinder of the suction device and the ejection outlet is capped in accordance with movement of the cylinder together with movement of the carriage.

12 Claims, 44 Drawing Sheets

RECORDING APPARATUS

This application is a continuation of application Ser. No. 07/922,766 filed Jul. 31, 1992, now abandoned.

FIELD OF THE INVENTION AND RELATED ART

The present invention relates to a recording apparatus having a mechanism for drive transmission.

A recording apparatus having a function of printer, copying machine, facsimile machine or the like, or a recording apparatus for a print-out device for a work station or compound system including a computer, a word processor or the like, records an image on a recording material such as a sheet of paper or a sheet of plastic resin (OHP sheet) in accordance with image information. The recording apparatus may include ink jet type, wire dot type, a heat sensitive type, a thermal transfer type, a laser beam printer type or the like.

In a serial type recording apparatus in which recording operation is effected in a main scan direction which as substantially perpendicular to a sub-scan direction which is the sheet feeding direction, a recording means or recording head carried on a carriage movable along the surface of the recording material records the image in the main scan direction, after the recording material is set in a predetermined recording position. After the recording is completed for one line, the sheet is fed through a predetermined distance (sub-scan). Then, the next line is recorded (main scan). This is repeated to cover the entire recording material surface for the image recording. On the other hand, in a line type recording apparatus in which the scanning operation is only in the sub-scan direction (sheet feeding direction), the recording material is set in the predetermined recording position. The record for one line is carried out at once, and then, the recording material is fed at a predetermined pitch. Then, the record for the next line is carried out again at once. This is repeated to cover the entire surface of the recording material for the image recording.

Among the above-mentioned types of the recording apparatuses, the ink jet type recording apparatus is such that ink is ejected from recording means or recording head onto the recording material for the purpose of recording an image thereon. This type is advantageous in that the size of the recording means can be easily reduced, that a high resolution image can be recorded at a high speed, that the plain paper is usable without specific treatment thereto, that the running cost is low, that the noise is small because it is non-impact type and also in that it is easy to effect the color image recording with use of plural color ink materials.

A typical recording means of an ink jet type using thermal energy to eject the ink, is easy to manufacture with a high density liquid passage arrangement (ejection outlet arrangement), because the liquid passages can be produced by forming a heat generating resistor and an electrode on a substrate through a semiconductor manufacturing process including etching, evaporating sputtering or the like and attaching a liquid passage wall or a top plate on the base plate. In addition, the size of the recording head can be further reduced.

Generally, in a serial type recording apparatus, a carriage driving motor for driving the carriage for the main scan of the recording head is in a stepping type motor. As for a driving motor for feeding the recording material in the direction perpendicular to the carriage movement direction, usually a stepping motor is used. From the standpoint of cost reduction and space saving or the like, it is desired that the number of driving sources, i.e., motors, be minimized and therefore, a system is under development in which one driving source carries out plural operations.

Referring first to FIG. 48, there is shown a recording apparatus provided with a conventional drive switching mechanism in an exemplary recording apparatus, in a perspective view. As shown in FIG. 48, the recording apparatus comprises a recording means or recording head provided with plural ejection outlets for ejecting droplets of ink in accordance with recording information by the use of energy generating means such as a piezoelectric element or a heat generating resistor, a carriage 2 which is reciprocable in the main scan direction while carrying a recording head 1, a carriage shaft for slidably mounting the carriage, a feeding roller 5 for feeding the recording material at proper timing. Designated by a reference numeral 4 is a recording material on which the recording is effected.

A pulse motor 6 functions as a driving source to drive the feeding roller 5 and to effect automatic sheet feed. A pump carriage 7 carrying a capping unit for capping hermetically an ejection outlet side surface of the recording head 1 is movable in parallel with the carriage shaft 3. A guide shaft 8 is effective to guide the parallel movement of the pump carriage. A returning spring 9 urges in the rightward direction the pump carriage 7, in FIG. 48. A pump carriage 7 is provided with an arm **7*a*, and the end portion thereof is provided with a hole 7*b* in which a projection 2*a* of the carriage 2 at its right side is engageable. When the carriage 2 moves to the left in FIG. 48, the projection 2*a* is engaged into the hole 7*b*, by which the rotation of the carriage 2 around the carriage shaft 3 is prevented and a cap 29 is press-contacted to the ejection side surface of the recording head 1**.

FIG. 49 is a partial perspective view illustrating a drive transmission mechanism and a driving source of the recording apparatus. FIG. 50 is a partial perspective view illustrating gear arrangement for the drive transmission and switching in the apparatus of FIG. 49. To the backside of the pump carriage 7, an end of a leaf spring 10 for the switching action transmission and having an elasticity in the carriage movement direction, is fixed. In addition, the other end of the leaf spring 10 is retained so as to be gripped by a slide gear supporting table 12 for supporting a slide gear 11. The slide gear supporting table 12 is mounted for movement along the slide shaft 13 in the carriage movement direction. Therefore, in accordance with the motion (position) of the pump carriage 7, the motion (position) of the slide gear 11 can be limited by way of the leaf spring 10. More particularly, when the carriage 2 is moved to the left until the projection **2*a* abuts to (engages with) to the arm portion 7*a* of the pump carriage 7, they are moved together, by which the slide gear 11 moves in interrelated relation with the carriage 2**, in the same direction.

As shown in FIG. 50, the slide gear 11, depending on its position, is engageable with any of plural gears independently rotatably supported along a carriage movement direction. In FIG. 50, among plural gears, a feed gear 14 functions to transmit the driving farce to a sheet feeding gear fixed to the feeding roller 5, ASF (automatic sheet feeder) gear 15 functions to transmit the driving force to an automatic sheet feeder, and a pump gear 16 functions to transmit the driving force to a sucking recovery device. The pump gear comprises two gears **16*a* and 16*b* unified together. The left side gear 16*b* in the Figure is meshed with an idler gear of the sucking recovery apparatus. Therefore, the slide gear 11 meshes with one of gears 14, 15 and 16** through a leaf spring 10 and a pump carriage 7, depending on the stop position of the carriage 2. Therefore, the driving force is selectively transmitted from the pulse motor 6. In other words, the drive transmissions from a single driving source 6 are switched, depending on motion of the carriage.

However, in such a switching mechanism, the feed gear 14, the automatic sheet feeding (ASF) gear 15 and the pump gear 16 are required to be disposed with spaces between adjacent ones in the carriage scanning direction, with the result of large width of the recording apparatus. When the slide gear 11 is meshed into the gears 14, 15 and 16, it is required that the pulse motor 6 is rotated in the forward or backward direction to prevent side-by-side abutment between the gears. When the slide gear 11 is disengaged from the gears 14, 15 and 16, the pulse motor 6 is required to be rotated in the forward or backward direction to remove the retaining force due to the friction. For This reason, the sequential operations for the switching becomes complicated, with the result of lower reliability of the recording apparatus and a longer switching time.

In the ink jet recording apparatus, it is possible that the ejection outlets are clogged with the result of improper ejection or election failure, when paper dust or foreign matter is deposited on the ink ejection outlet of the recording means or when the ink adjacent the election outlets are dried and increased in the viscosity. In order to prevent the clog, the ink ejection side is hermetically sealed with a cap during non-recording, and the ink is sucked out through the ejection outlets by sucking means such as pump to maintain the proper ejection through the ejection outlets. In the serial type ink jet recording apparatus, when the recording operation is not carried out, the carriage having the recording head is stopped at a position where the recording head is faced to the gap disposed outside the recording range, and the ink ejection side surface of the recording head is closed or capped.

Referring to FIG. 48, when the carriage 2 moves to the left, an arm 7*a* is urged by a carriage 2 so that the pump carriage 7 is moved toward left along the Guiding shaft 8. A rear side of the cap 29 mounted on the pump carriage 7 is engaged with a rail 11. The rail 11 has such a configuration to extend out in the front direction toward the left side. Therefore, in accordance with the leftward movement of the cap 29, it is urged to the ejection side surface of the recording head 1. In other words, when the cap 29 mounted on the pump carriage comes to the left end position by the movement of the carriage 2, the recording head 1 is capped by the cap 29, following the configuration of the rail 11.

When the pulse motor 6 is driven with the capped state, the pump cam 13 is driven through a pumping gear 12, and by the cam 13, a piston of the pump 14 is driven for the pumping action. The pump 14 is connected with a tube 15 through a joint 16, and the tube 15 is connected with inside space of the cap 29. Therefore, by driving the pump 14 when the recording head 1 is at the left end position, the ink is sucked through the ejection outlets of the recording head through the cap 29 and the tube 15. This is an ejection recovery operation.

However, in the conventional recovery device, the distance from the cap 29 to the pump 14 is so long that the initial air quantity to be sucked by the pump 14 is large, and therefore, the initial sucking force is not sufficient. In order to assure sufficient sucking force, against this, a large pump is required to be employed as the pump 14. In addition, the sucking operation is effected through a joint 16 or tube 15 between the pump 14 and the cap 29, so that the liability of negative leakage or the like is increased with the result of difficulty in assuring the reliability in addition, the number of parts increases with the result of high cost.

SUMMARY OF THE INVENTION

Accordingly, it is a principal object of the present invention to provide a recording apparatus having a recording means carried on a carriage movable along a recording material and a switching mechanism for switching drive transmission, wherein the switching between the reversible state and neutral state not transmitting the driving force is related with the motion of the carriage, by which the dimension of the recording apparatus in the width direction can be reduced, and in addition, the switching time period for the driving source switching can be reduced with improved reliability.

It is another object of the present invention to provide a recording apparatus in the case of an ink jet recording apparatus or a case in which only one of the forward and backward rotation is transmittable in a certain state, and various switching is carried out in interrelation with the carriage motion, wherein the switching operation from a neutral state to a reversibly rotatable state is interrelated with a capping action for capping an ejection side surface of a recording means.

It is a further object of the present invention to provide an ink jet recording apparatus in which an initial sucking force is maintained high during a recovery operation, so that the reliability of the recovery device is increased with low cost.

According to an embodiment of the present invention, the cap is directly connected to a cylinder constituting the pump.

According to another embodiment of the present invention, the cylinder is moved in interrelation with the carriage to cap the ink ejection outlet side of the recording head, or a press-contacting force is produced behind the carriage.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
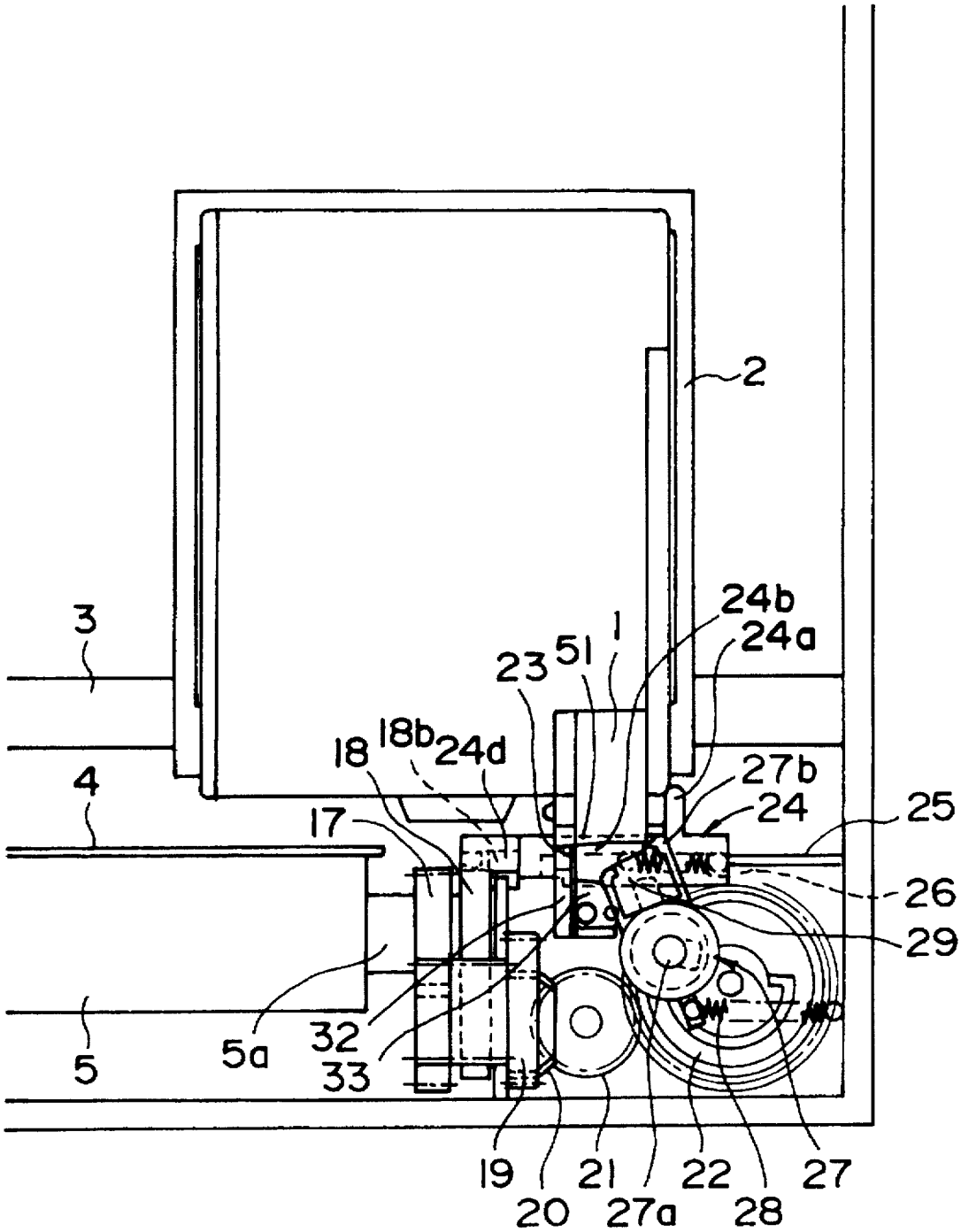
FIG. 1 is a front view of a recording apparatus according to a first embodiment of the present invention in a neutral state without drive transmission.
Figure 2:
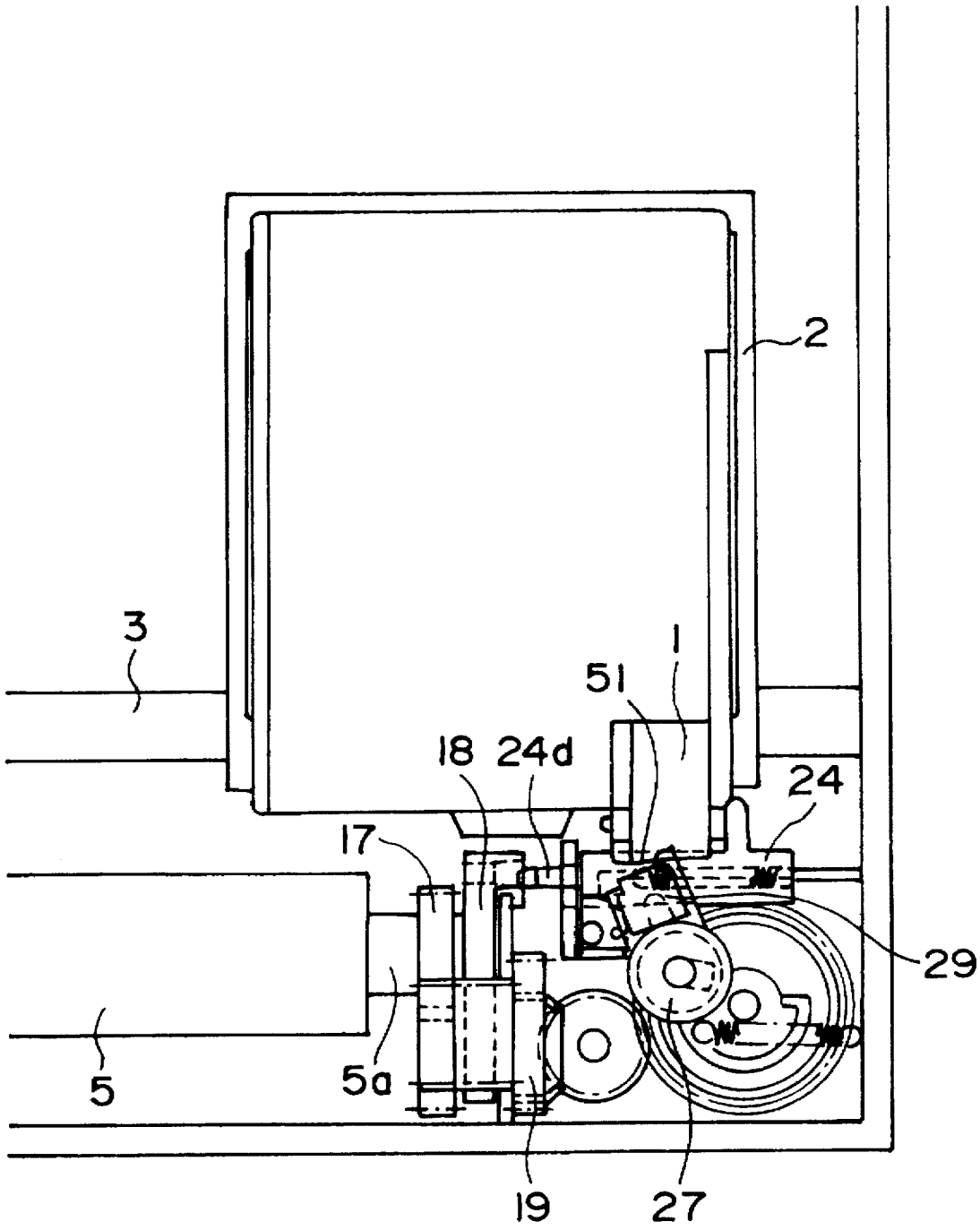
FIG. 2 is a front view of a major part of the recording apparatus of FIG. 1 in an uncapped state in which the drive transmission is switchable.
Figure 3:
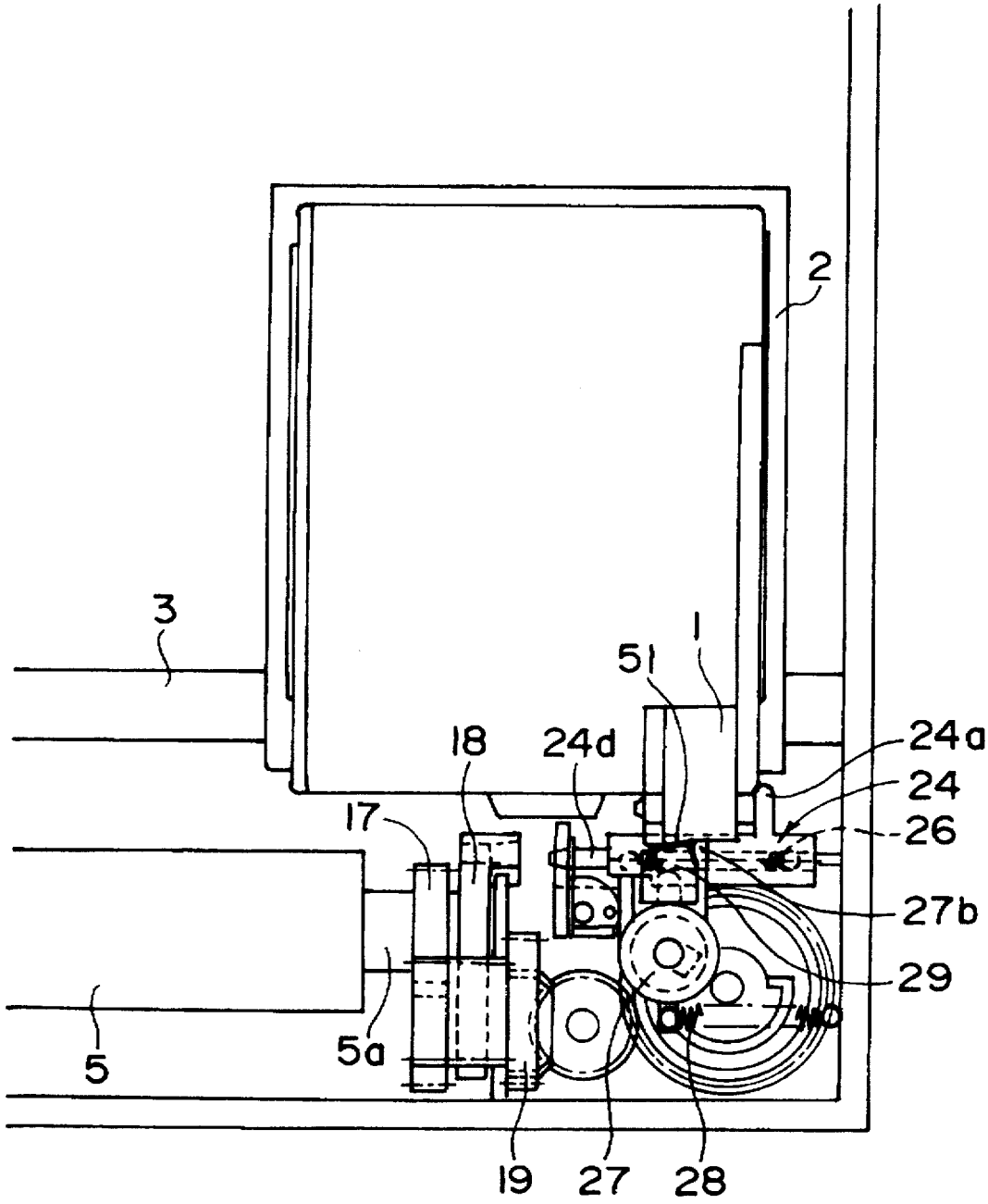
FIG. 3 is a front view of a major part of the recording apparatus of FIG. 1 in a capped state in which the drive transmission is switchable.
Figure 48:
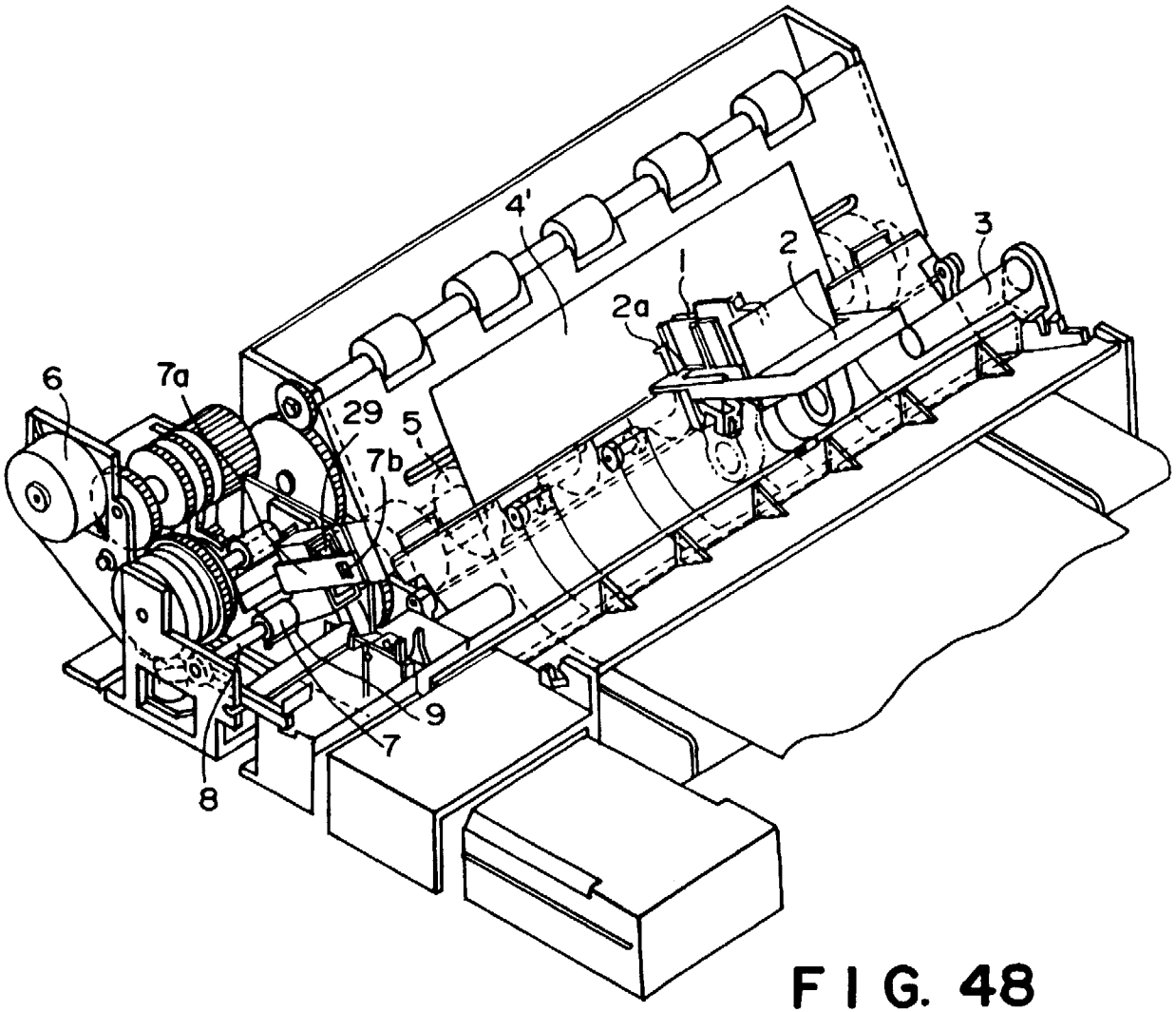
FIG. 48 PRIOR ART
FIG. 48 is a perspective view of a major part of a conventional recording apparatus.
Figure 49:
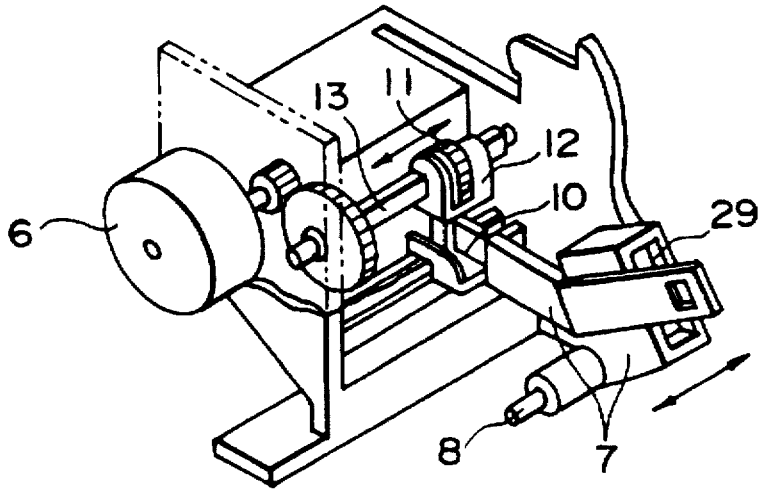
FIG. 49 PRIOR ART
FIG. 49 is a partial perspective view of a drive transmission switching mechanism of the recording apparatus of FIG. 48.
Figure 50:
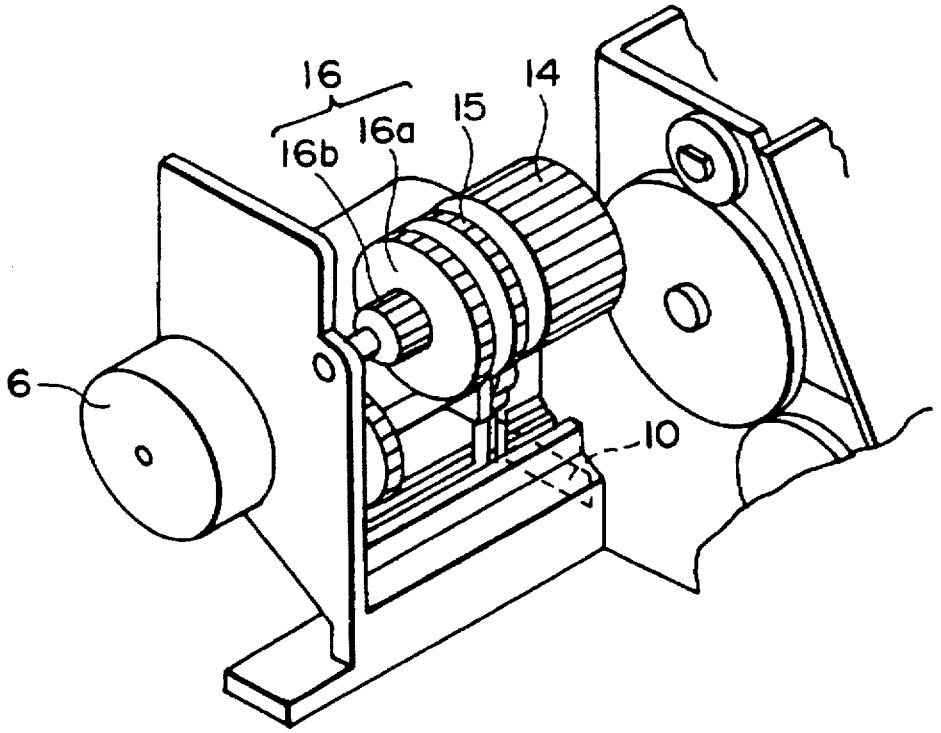
FIG. 50 PRIOR ART
FIG. 50 is a partial perspective view illustrating arrangement of the drive transmission gears in the apparatus of FIG. 49.

Referring to the accompanying drawings, embodiments of the present invention will be described in detail. In the embodiments which will be described hereafter, the apparatus is similar to the recording apparatus shown in FIG. 48 except that the present invention is incorporated. Therefore, in the parts not shown in the Figure, the structures are substantially the same as in FIG. 48. The drawings show the structure outside the recording range (the right end portion of the recording apparatus in the Figure). FIGS. 1–8 deal with a first embodiment of the recording apparatus, using the present invention. FIGS. 1–3 are front views of the major part of the recording apparatus in different positions of the carriage. FIGS. 4–7 are views as seen from the right in FIGS. 1–3. FIG. 8 is a partial perspective view of the ink ejecting part of the recording means (recording head). In FIG. 1, the recording head 1 is not capped, and a switching lever 18 is fixed at the neutral position. FIG. 2 shows a state in which the recording head is not capped, and the switching lever 18 is free, that is, it is operable for the switching. FIG. 3 shows a state in which the recording head 1 is capped, and the switching lever 18 is free, that is, it is operable for the switching.

In FIG. 1, the recording head 1 is carried on the carriage 2 in such a position as to eject the ink downwardly in the Figure. While the carriage 2 is moved along the guiding shaft 8 (main scan), the image is recorded on a recording material 4. When one line recording is completed, the recording operation (ink ejecting operation) is stopped, and the recording material 4 is fed in a direction perpendicular to the carriage movement (sub-scan direction) through a predetermined distance. Thereafter, the carriage 2 is moved again along the guiding shaft 8 (main scan), and the image is recorded for the next line. The recording material 4 is press-contacted to a feed roller 5, and the sheet feed for the recording material 4 is accomplished by rotating the feed roller 5 through a predetermined rotational angle.

The feed roller 5 is driven from a driving source in the form of a motor (pulse motor) 6. The rotational force thereof can be transmitted to a first pump gear 19 by way of a feed gear 17. However, the transmission is selectively permitted or prevented by a shifting or switching lever 18. The first pump gear 19 drives a pump cam 22 by way of a second pump gear 20 and a third pump gear 21.

Outside the recording range (outside the feeding roller 5 length range) of the recording apparatus, a wiper 23 is mounted in a direction perpendicular to the carriage 2 movement. When the carriage 2 moved, the wiper 23 wipes the ink ejection side surface 51 of the recording head 1. Outside the recording range, a slide lever 24 is mounted for horizontal movement along a slide rail 25. The slide lever 24 is urged to the left in FIG. 1 a slide spring 26. The slide lever 24 is provided with a head abutting portion 24*a*. When the recording head is positioned more leftward than the positions of FIG. 1, the recording head 1 is away from the head abutting portion 24*a*. When the recording head is moved to the right in FIG. 1 away from the recording range, the recording head 1 is abutted to the head abutting portion 24*a*, and the slide lever 24 is moved toward the right together with the recording head 1, and therefore, the carriage 2. Also, when the recording head 1 moves to the left from the right end position, the slide lever 24 is moved together with the carriage 2 until the recording head is away from the recording head abutting portion 24*a*.

A cylinder 27 Is rotatable about a rotational axis 27*a* extending in a direction perpendicular to the carriage 2 movement direction. To the cylinder 27, a cap 29 for capping an ejection outlet formed side of the recording head 1, is fixed. The cylinder 27 is urged in the counterclockwise direction in FIG. 1 by a cylinder spring 28 so that the cap is normally at a rest position (not capping the recording head 1) in which the cap 29 is inclined. The cylinder 27 is provided with an engaging portion 27*b* extending upwardly. When the slide lever 24 moves to the right, the engaging portion 27*b* is engaged with a cylinder driving portion 24*b* of the slide lever 24.

FIG. 3 shows a state in which the carriage is moved to the right end from the position thereof show in FIG. 1. In FIG. 3, the recording head 1 urges the head abutting portion 24*a* of the slide lever 24, so that the slide lever 24 is moved to the right against the urging force of the slide spring 26 along the slide rail 25. Together with the rightward movement of the slide lever 24, the cylinder driving portion 24 of the slide lever is brought into engagement with the engaging portion 27*b* of the cylinder 27 to rotate the cylinder 27 about The rotational axis 27*a* in the clockwise direction against the urging force of the cylinder spring 28. When the carriage 2 reaches the position shown in FIG. 3, the cap 29 fixed on the cylinder 27 is positioned right in front of the recording head 1, and the ejection side surface 51 of the recording head is hermetically capped with the cap 29.

Figure 4:
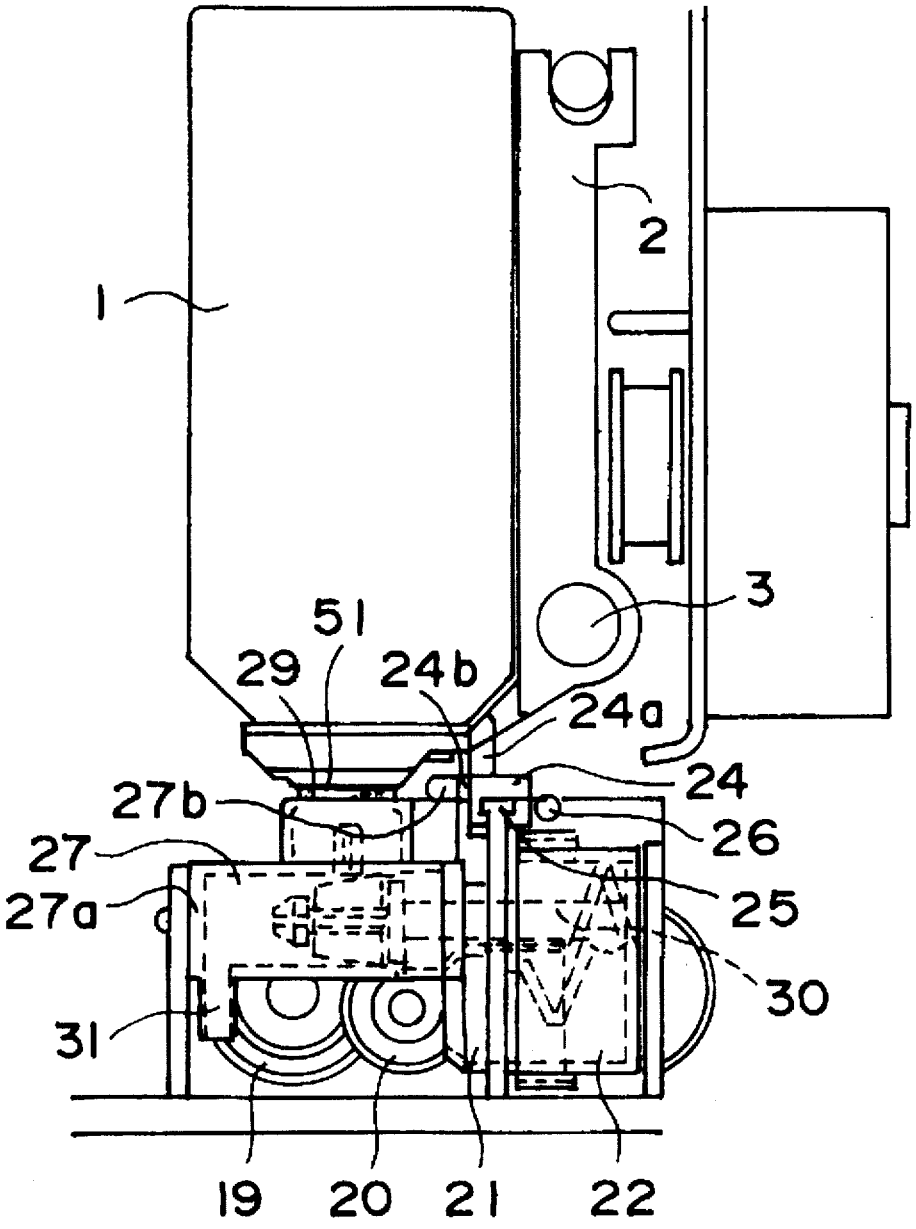
FIG. 4 is a side view of a major part of the recording apparatus of FIG. 1 in a capped state in which the drive transmission is switchable.
Figure 5:
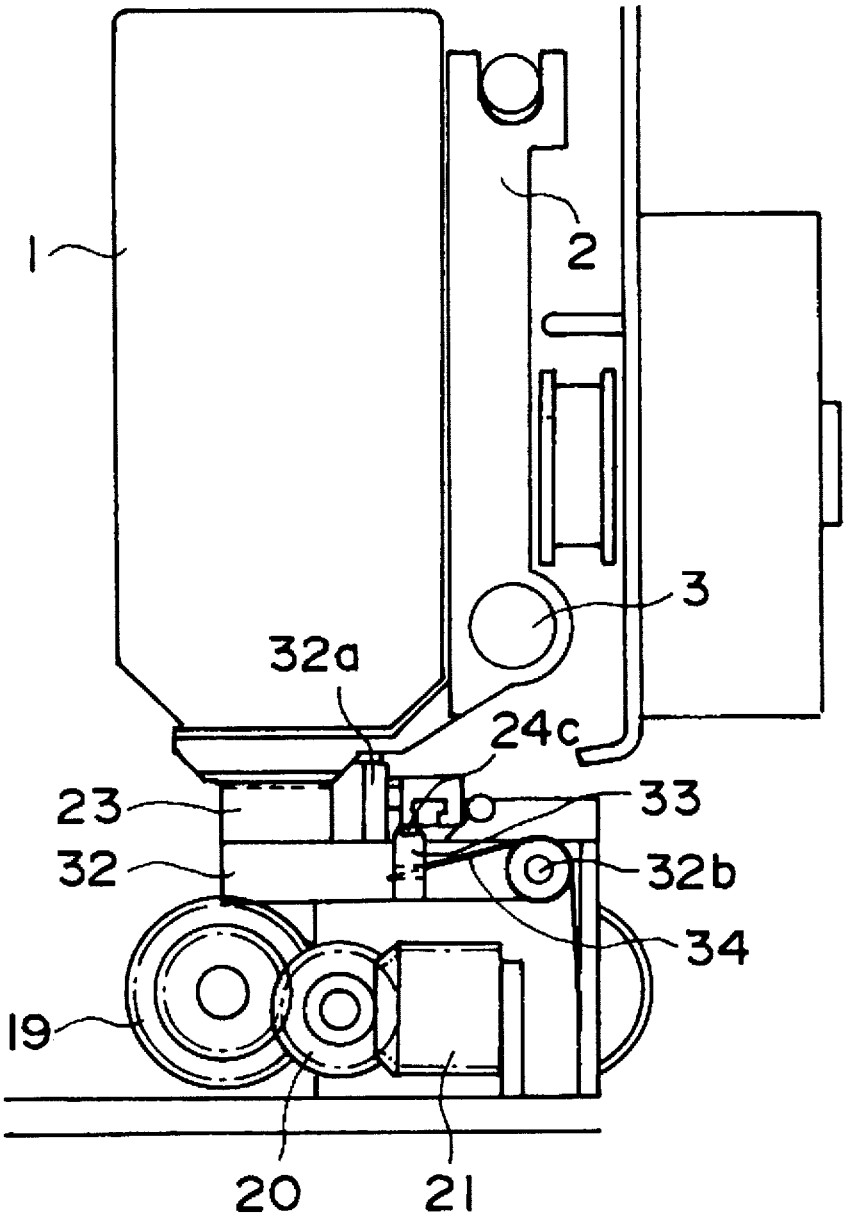
FIG. 5 is a side view of a recording apparatus of FIG. 1 illustrating a structure around a wiper for wiping the recording head.

FIG. 2 shows a state in which the carriage 2 is between a position shown in FIG. 1 and a position of FIG. 3, and the recording head 1 is not yet capped, but a switching lever 18 for switching transmission of the rotation force of the feed gear 17 is movable for switching operation. FIGS. 4 and 5 are side views of the structures around the cylinder 27 and the wiper 23. In FIG. 4, the recording head is capped, corresponding to FIG. 3. With this state, the engaging portion 27*b* of the cylinder 27 is urged by a cylinder driving portion 24*b* of the slide lever 24, and the cylinder 27 rotates about an axis 27*a*, so that the cap 29 is closely contacted to the ejection side surface 51 of the recording head 1 (capped state).

In FIG. 4, a piston 30 movable to the left and to the right in this Figure is mounted to the cylinder 27. When the pump cam 22 is driven and rotated through the pump gear 19, the piston 30 moves to the right or left by the can surface of the pump cam 22, so that the ink is sucked through the ejection outlets of the recording head by way of the cap 29 into the cylinder 27. The sucked ink (residual ink) is discharged through a residual ink pipe 31 in the cylinder 27. By doing so, the ejection performance of the recording head is recovered, that is, the mechanism constitutes a recovery device.

In FIG. 5, a wiper 23 is fixed on a wiper holder 32. A degree of overlapping between the wiper 23 and the ejection side surface 51 of the recording head 1 is controlled by a projection 32*a* of a wiper holder having a cam configuration patterned after the right side of the ejection side surface 51 of the recording head. The wiper holder 32 is rotatable about a rotational shaft 32*b* extending in the carriage movement direction. It is urged to the ejection side surface 51 of the recording head by a wiper spring 34 through a wiper cam 33 rotatably mounted on the wiper holder 32.

When the carriage 2 moves to the right in FIGS. 1–3, the wiper 23 kicks the wiper cam 33 against the wiper spring 34, and wipes the ejection side surface 51 of the recording head with the overlapping degree assured by the projection 32*a* of the wiper holder 32.

When the carriage 2 moves to the left, the wiper cam 33 is urged downwardly in FIG. 5 by the wiper cam portion 24*c* of the slide lever 24, and the wiper holder 32 provided with the wiper cam 33 is rotated in the counterclockwise direction in FIG. 5 about the rotational shaft 32*b* against the wiper spring 34. Therefore, the wiper 23 supported on the wiper holder comes away from the ejection side surface of the recording head 1.

Figure 6:
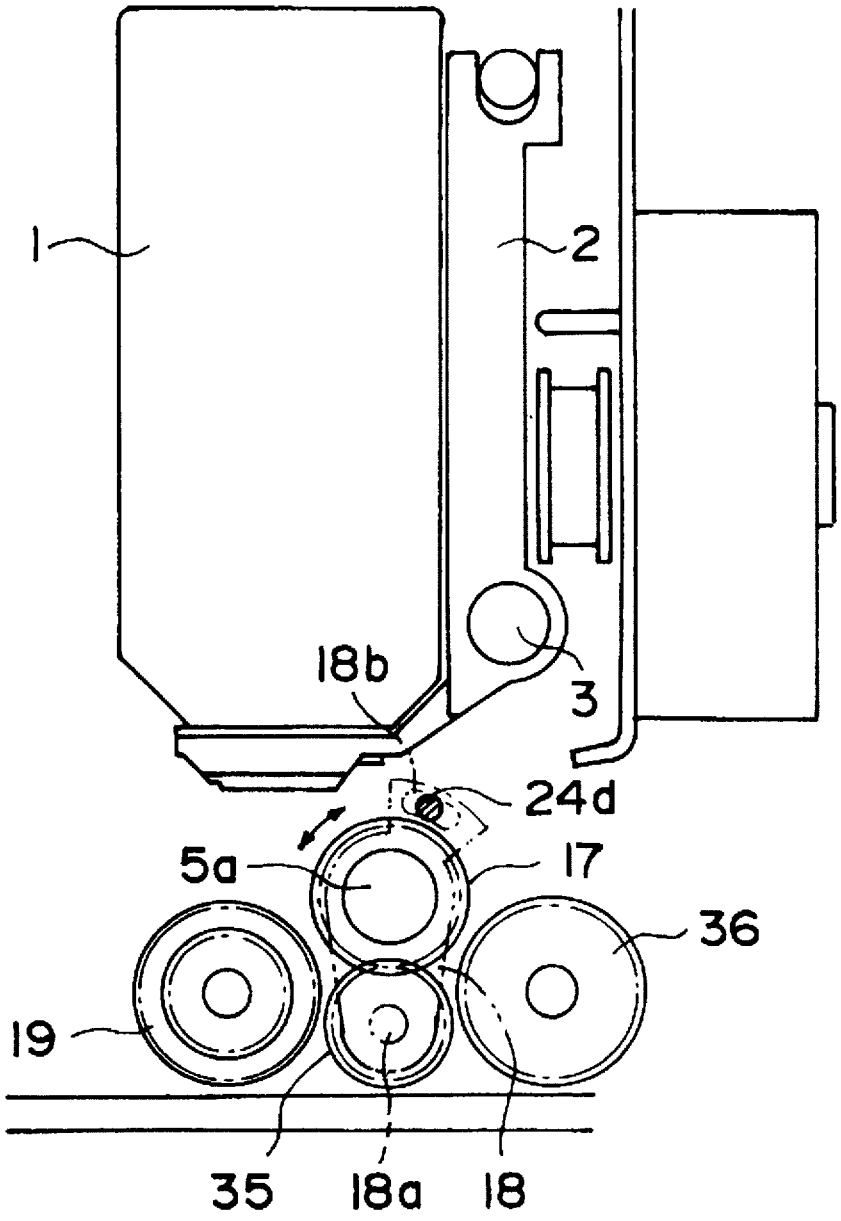
FIG. 6 is a side view of a recording apparatus of FIG. 1 in which a switching lever for the drive transmission mechanism is fixed at a neutral position.
Figure 7:
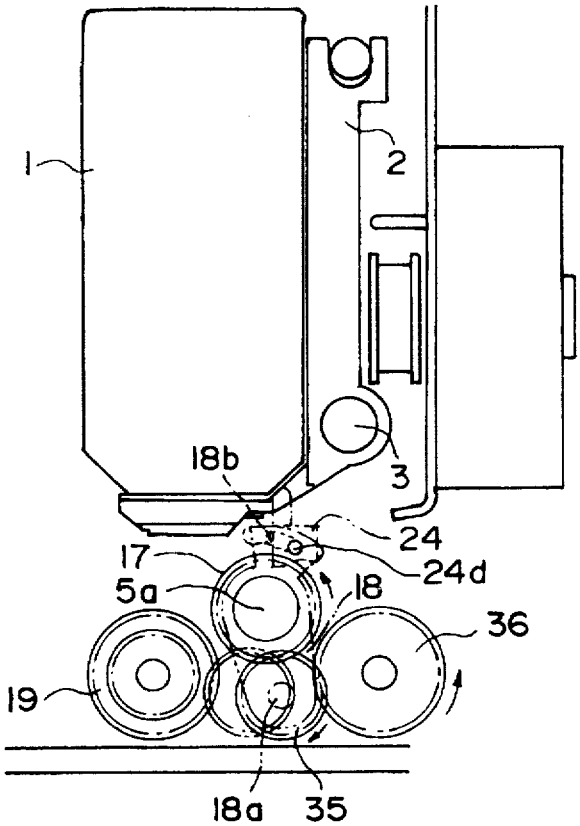
FIG. 7 is a side view of a recording apparatus of FIG. 1 in a state in which the switching lever of the drive transmission mechanism is rotatable.
Figure 8:
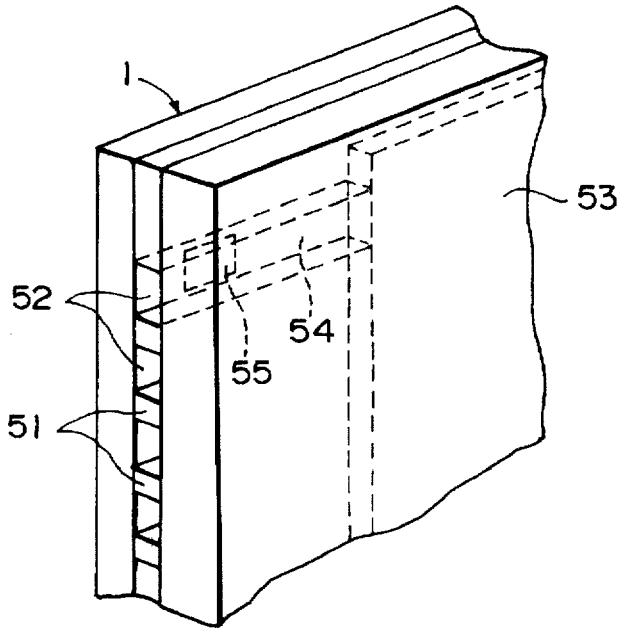
FIG. 8 is a partial perspective view of a recording apparatus of FIG. 1 illustrating a structure of an ink ejection part of the recording head.

Referring to FIGS. 6 and 7 and referring back to FIGS. 1–3, the description will be made as to a shifting or switching mechanism for the rotating or driving force for the feed roller shaft 5*a*.

Figure 36:
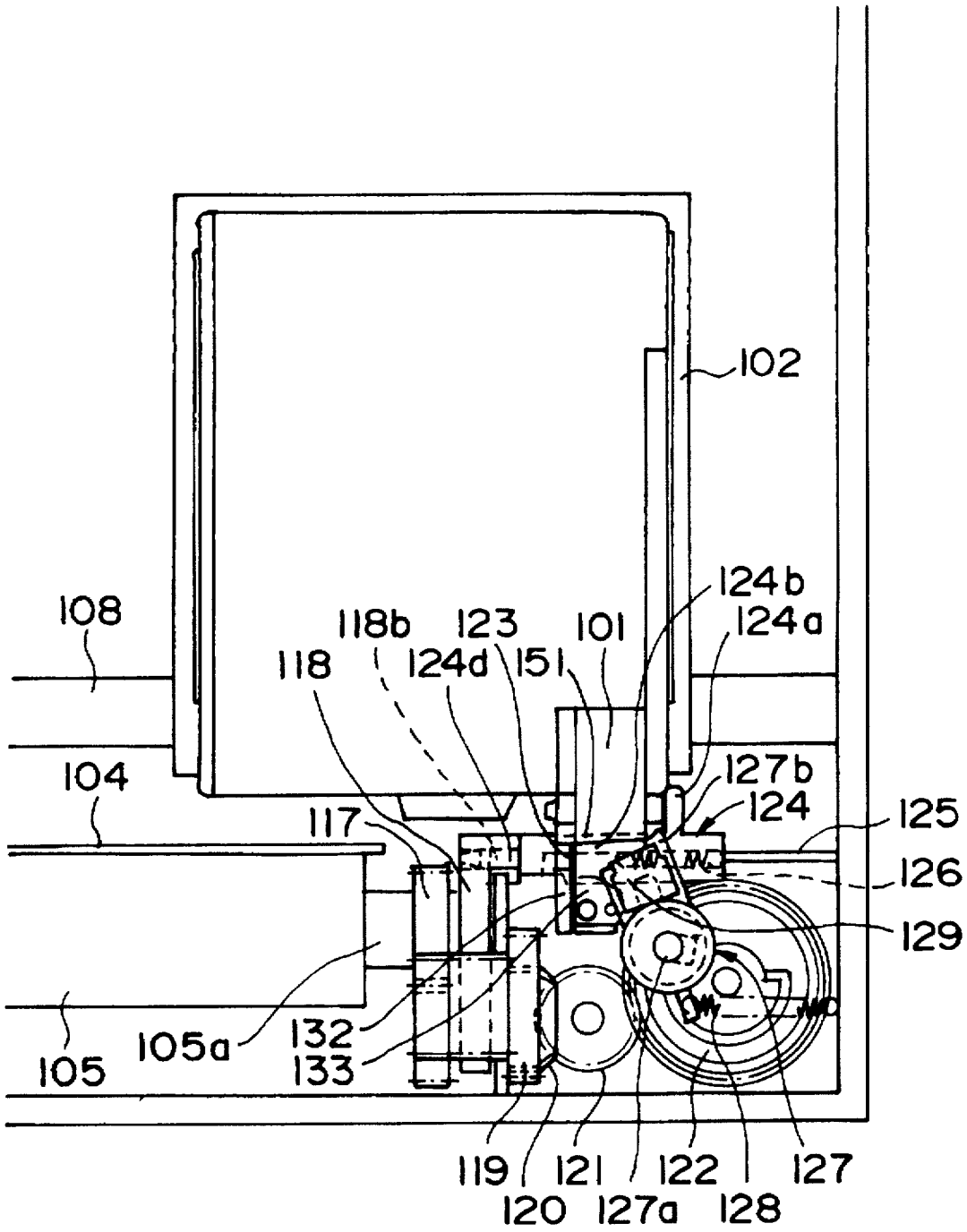
FIG. 36 is a partial front view of a major part of an ink jet recording apparatus according to an eighth embodiment of the present invention.

The driving force for the feed roller shaft 5*a* is transmitted from a driving source in the form of a pulse motor 6 or the like in FIG. 36, for example, to a shaft 5*a* of the feed roller 5. As will be understood from FIGS. 1–3, 6 and 7, the switching lever 18 is rotatable about the feed roller shaft 5*a* and a swingable gear 35 is rotatably mounted on a gear shaft 18*a* mounted on a bottom end portion of the switching lever 18. The swingable gear 35 is engaged with a feed gear 17 fixed on the feed roller 5.

When the feed roller 5 rotates, the feed gear 17 fixed to the feed roller shaft 5*a* rotates, so that the swingable gear 35 rotates by the rotation of the feed gear 17. At this time, the switching lever 18 rotatably supporting the swinging gear 35 receives torque in the predetermined direction in accordance with the rotational direction of the feed gear 17. If it is not fixed and, therefore, is rotatable, it rotates in the predetermined direction about the feed roller shaft 5*a*. When the feed gear 17 rotates in the clockwise direction in FIG. 7, the Switching lever 18 also rotates in the clockwise direction, so that the swinging gear 35 is brought into meshing engagement with the first pump gear 19, by which the rotational force of the feed roller 5 is transmitted to the first pump gear 19 for the driving the recovery means. On the contrary, when the feed gear 15 is rotated in the counterclockwise direction, the switching lever 18 rotates in the counterclockwise direction, so that the swingable gear 35 is brought into meshing engagement with the ASF gear 35, by which the rotation force of the feed roller is transmitted to the ASF gear 36 for driving the ASF.

However, in the state where the switching lever 18, as shown in FIGS. 1 and 6, is fixed at the neutral position, the drive transmission switching operation between the pump gear 19 and the ASF gear 36 described above is not carried out. In other words, in the state of FIGS. 1 and 6, the carriage 2 does not move sufficiently to the right of FIG. 1, and therefore, the slide lever 24 is not moved to the right in FIG. 1. Accordingly, a pin 24*d* at the left end of the slide lever 24 is engaged deeply in the receiving portion 18*b* of the switching lever 18. For this reason, the switching lever 18 is fixed at the neutral position of FIG. 6 irrespective of the rotation of the feed roller in either direction, and therefore, the switching of the drive transmission does not occur. The pin receiving portion 18*b* of the slide lever 24 has such a dimension that the upper portion thereof in a direction perpendicular to the sheet of the drawing of FIG. 6 (the inlet side of the pin 24*d*) is sufficiently larger than the cross-sectional configuration of the pin 24*d*, and the lower portion in the same direction (the rear side of the pin inserting direction) has substantially the same configuration as the cross-section of the pin 24*d*. To accomplish this, a tapered aperture is formed.

In the position of the slide lever 24 shown in FIGS. 1 and 6, the pin 24*d* is deeply engaged with the pin receiving portion 18*b* of the switching lever 18, and therefore, the switching lever 18 is retained, held or fixed at the neutral position in which the swinging gear 35 is not in the meshing engagement with the pump gear 19 or the ASF gear 36. Accordingly, even if the feed roller 5 rotates, the swinging gear 35 rotates idly, and therefore, the rotational force (driving force) is not transmitted to the pump gear 19 or the ASF gear 36. Normally, in the stage shown in FIG. 6, the recording material 4 is fed by rotation of the feed roller 5.

Referring to FIGS. 2, 3 and 7, the description will be made as to the switching of the drive transmission in response to rotational direction change of the feed roller 5. In these Figures, when the carriage 2 rotates to the right end, the slide lever 24 moves to the right as described hereinbefore, and the pin 24*d* at the left end of the slide lever 24*a* is brought out of engagement from the pin receiving portion 18*b* of the switching lever 18. Then, as shown in FIG. 7, the switching lever 18 becomes rotatable. As described hereinbefore, by controlling the rotation and the rotational direction of the feed roller 5, the rotating force thereof is selectively transmitted to the pump gear 19 or the ASF gear 36. More particularly, when the feed gear 17 (feed roller 5) is rotated in the counterclockwise direction, for example, the switching lever 18 rotates in the counterclockwise direction, so that the swingable gear 35 rotatably supported on the switching lever 18 can be engaged with the ASF gear 36. When the feed gear 17 is rotated in the clockwise direction, the switching lever 18 also rotates in the clockwise direction, and therefore, the swingable gear 18 can be meshed with the pump gear 19, so that the driving force of the feed roller 5 may be selectively transmitted to the ASF gear 36 or the pump gear 19 through the swingable gear 35. In this manner, when and only when the carriage is at the position shown in FIGS. 2 and 3, the pump (recovery pump) is driven by the clockwise rotation of the feed roller 5, and the ASF (automatic sheet feeding device) is driven by the counterclockwise rotation of the feed roller. Thus, the drive transmission is switchable by the rotational direction of the feed roller. The recording means (recording head) 1 is an ink jet recording means for ejecting ink using thermal energy, and therefore, is provided with electrothermal transducers. The recording means ejects the ink through the ejection outlet, using bubble creation and development through film boiling caused by the thermal energy generated by the electrothermal transducer, and using the subsequent contraction of the bubble.

FIG. 8 is a partial perspective view of the structure of the ink ejecting portion of the recording means 1. In FIG. 8, the ink ejection side surface 51 faced to the recording material 4 with a predetermined gap therebetween, approx. 0.5–2.0 mm, for example, provided with a plurality of ejection outlets 52 formed with predetermined intervals. On a wall of the liquid passage 54 for communication between the ejection outlets 52 and the common liquid chamber 53, the electrothermal transducers (heat generating resistor or the like) 55 are mounted. In this embodiment, the recording head 1 is carried on the carriage 2 in such a positional relation that the ejection outlets 52 are lined up in a direction substantially perpendicular to the scanning direction of the carriage. The electrothermal transducers 55 are actuated (supplied with electric power) corresponding to image signals or ejection signals, by which the ink in the liquid passage 54 is boiled (film-boiling), so that the ink is ejected through the ejection outlets 52.

Figure 9:
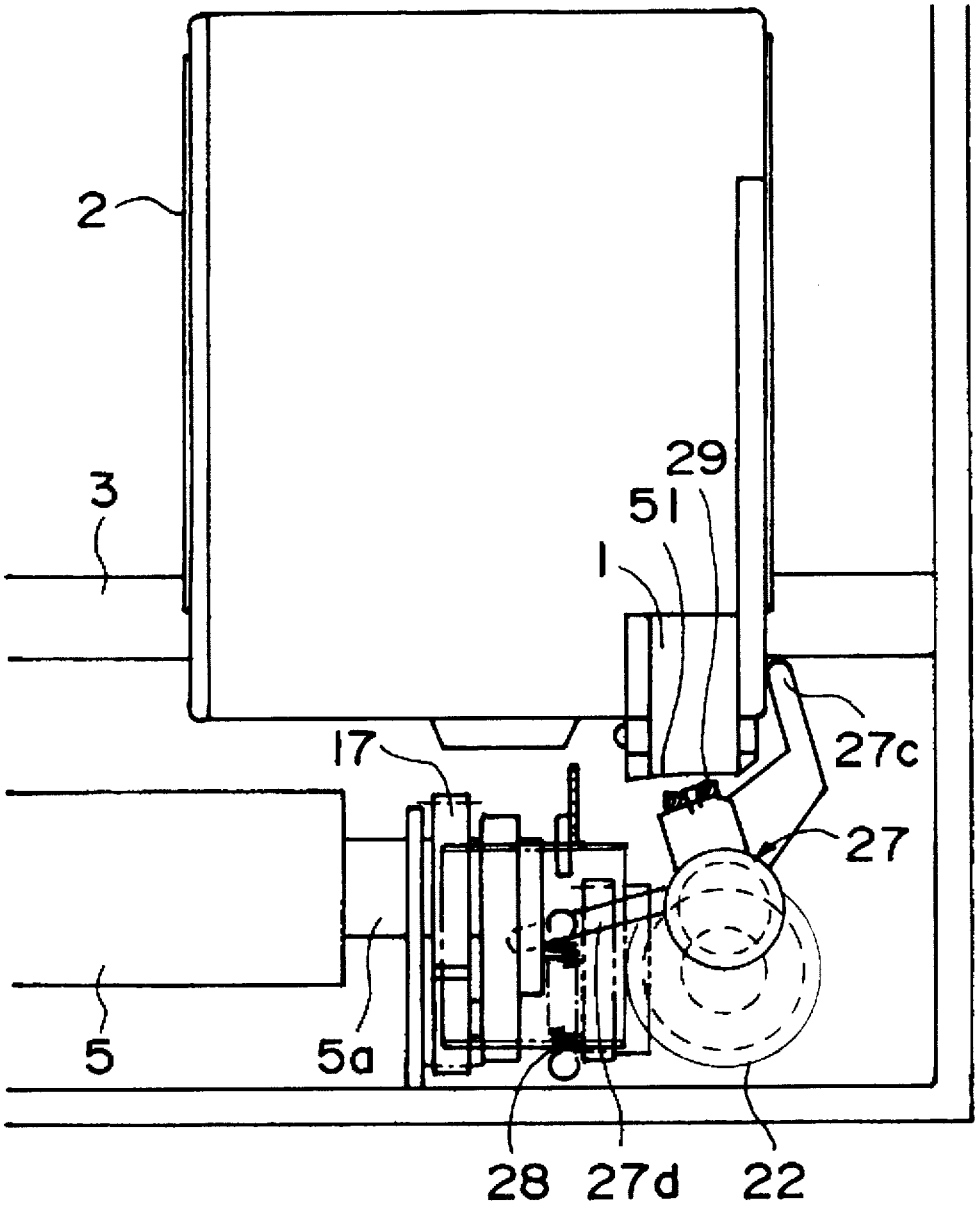
FIG. 9 is a front view of a recording apparatus according to a second embodiment of the present invention in a neutral state without drive transmission.
Figure 10:
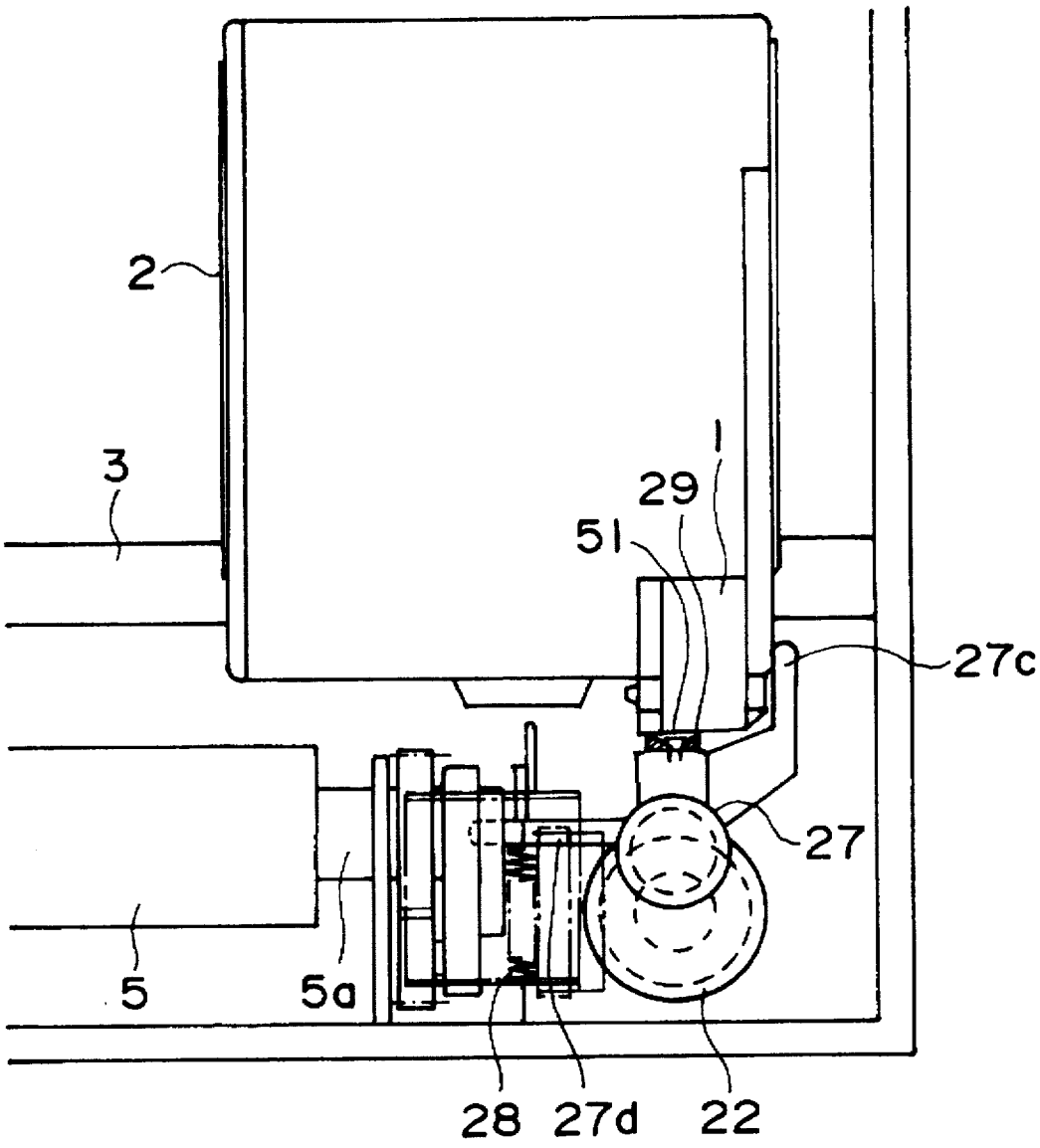
FIG. 10 is a front view of a recording apparatus of FIG. 9 in a capped state in which the drive transmission is switchable.
Figure 11:
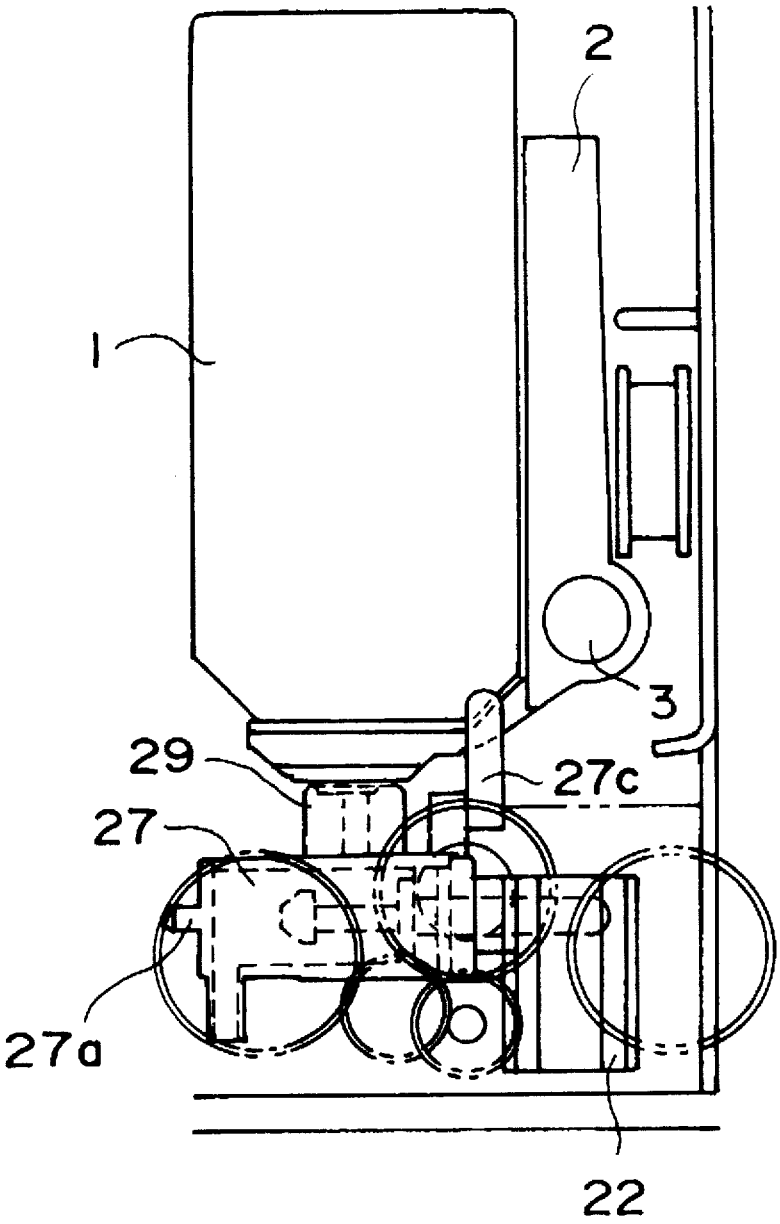
FIG. 11 is a side view of a structure around a cylinder shown in FIG. 10.

Referring to FIGS. 9, 10 and 11, the recording apparatus of the second embodiment of the present invention will be described. FIG. 9 is a front view of a recording apparatus when the carriage has not yet reached the capping position. FIG. 10 is a front view of the recording apparatus when the carriage 2 has reached the capping position. FIG. 11 is a side view of the apparatus of FIG. 10. In FIGS. 9, 10 and 11, a cylinder 27 having the cap 29 is normally retained or held at the inclined position (uncapping position) to space the cap 29 away from the recording head 1 (FIG. 9), by a cylinder spring 28 coupled to the arm portion 27*d*. When the recording head 1 carried on the carriage 2 moves to the right end, the cylinder 27 rotates against the spring force of the cylinder spring 28 by the recording head 1 urging a head lever 27*c* of the cylinder 27, as shown in FIG. 10, so that the cap 29 is brought into close contact with the ejection side surface of the recording head 1 (capped state).

Figure 12:
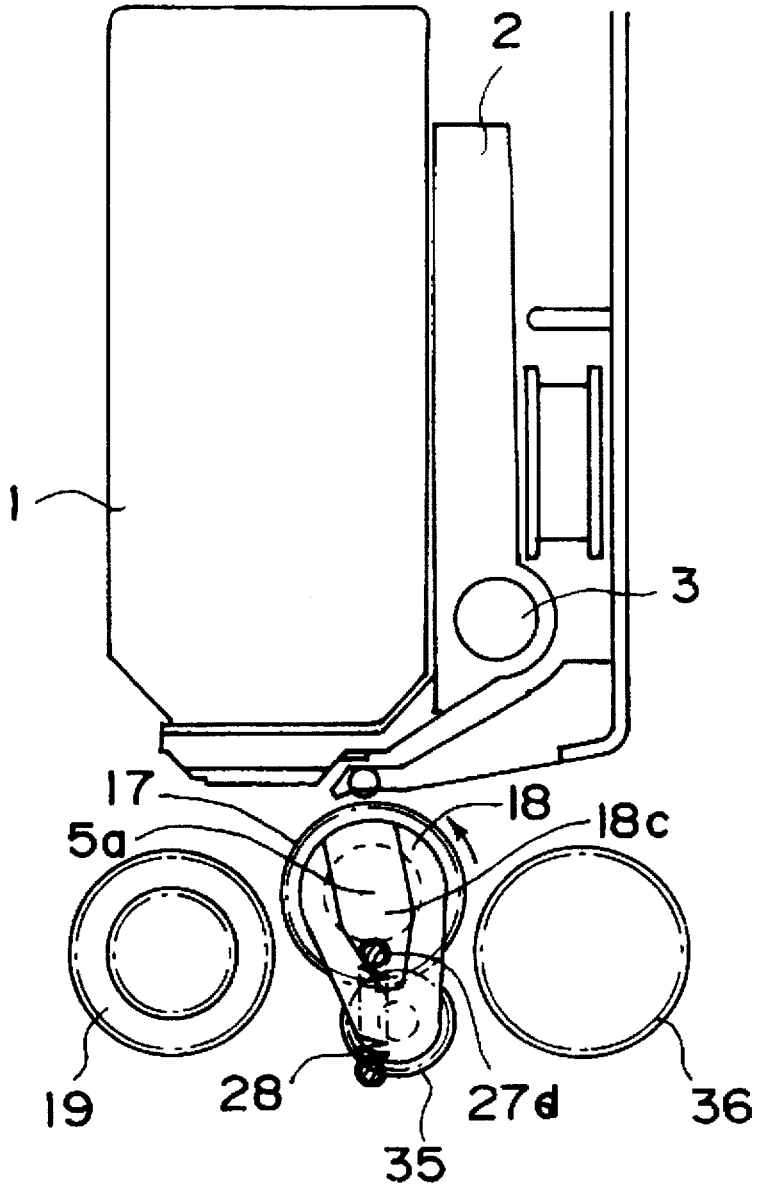
FIG. 12 is a side view of a structure around a switching lever shown in FIG. 9.

FIG. 12 is a side view of the switching lever 18 and the structure therearound in the state where the cap 29 does not cap the recording head (FIG. 9). In the state of FIG. 12, the arm 27*d* of the cylinder 27 suspends downwardly by the cylinder spring 28. By the engagement between the arm 27*d* and a cam 18*c* of the switching lever 18, the rotation of the switching lever 18 is limited or prevented. In other words, the switching lever 18 is held or fixed at the neutral position by the arm 27*d* of the cylinder. Therefore, the driving force or rotating force of the feed roller 5 is transmitted to a swingable gear 33, but it is transmitted to the pump gear 19 or the ASF gear 36. As shown in FIG. 12, for example, even if the feed gear 17 rotates in the counterclockwise direction, the swingable gear 35 is not brought into meshing engagement with the ASF gear 36, because the counterclockwise rotation of the switching lever 18 is prevented by the arm 27*d* of the cylinder 27.

Figure 13:
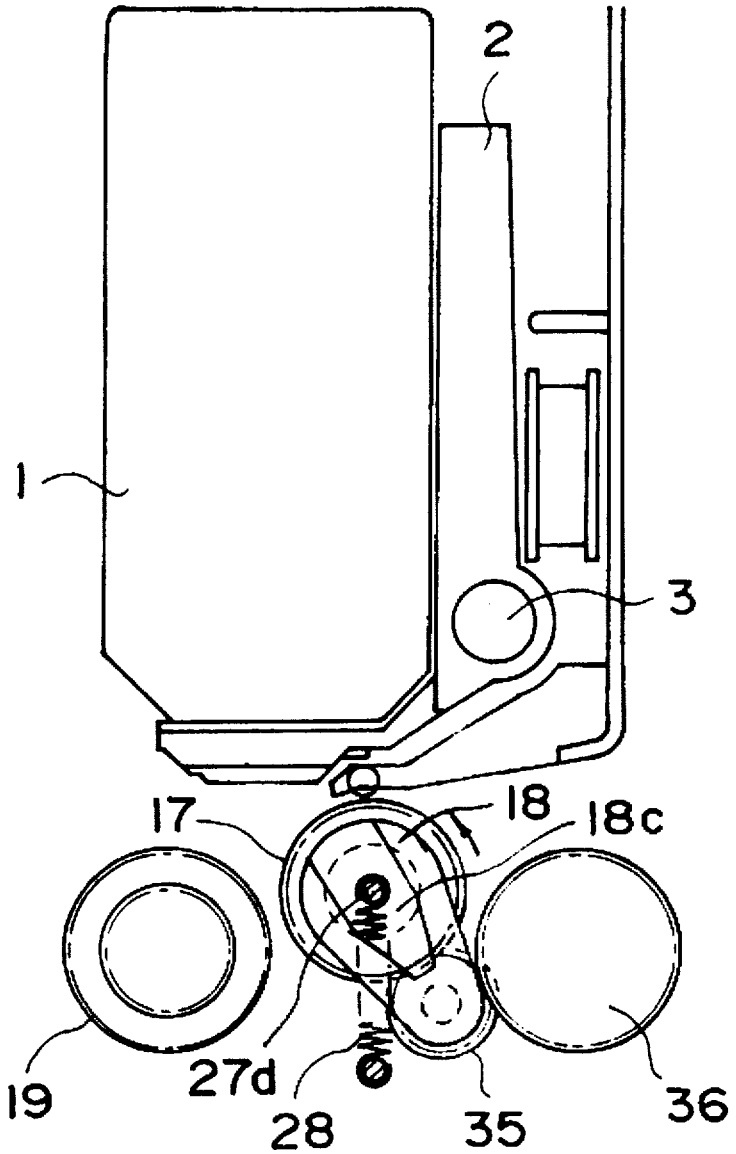
FIG. 13 is a side view of a structure around the switching lever shown in FIG. 10.

FIG. 13 is a side view of the switching lever 18 and the peripheral structure thereof in the state of FIG. 10, that is, the state in which the recording head is capped by the cap 29. In the state of FIG. 13, the arm 27*d* of the cylinder 27 is at a raised position against the spring force of the cylinder spring 28. With this state, the arm 27*d* of the cylinder 27 is disposed at or adjacent the rotational center of the switching lever 18, and therefore, the cam 18*c* of the switching lever is not limited by the arm 27*d*. Accordingly, the switching lever 18 is permitted to rotate freely about the feed roller shaft 5*a*.

Therefore, when the feed gear 17 (feed roller 5) is rotated in the counterclockwise direction in the state of FIG. 13, the switching lever 18 rotates in the counterclockwise direction through the same operation as in the case of FIG. 7. Then, the swingable gear 35 is brought into meshing engagement with the ASF (automatic sheet feeding device) gear 36. In this manner, the ASF can be driven by the rotational force or the driving force of the feed roller 5. When the feed roller 5 is rotated in the clockwise direction in the state of FIG. 13, the swingable gear 35 is brought into meshing engagement with the pump gear 19 through the same function as in the case of FIG. 7. Therefore, the ink ejection recovery pump can be driven by the rotation of the feed roller 5. In other words, in the state of FIG. 13, the drive transmission to the ASF and the pump, can be selectively switched in response to the rotational direction (forward or reverse rotation) of the feed roller 5. The other structure and operation of the recording apparatus of the second embodiment described in conjunction with FIGS. 9–13, are substantially the Same as in the first embodiment having been described in conjunction with FIGS. 1–8.

Figure 14:
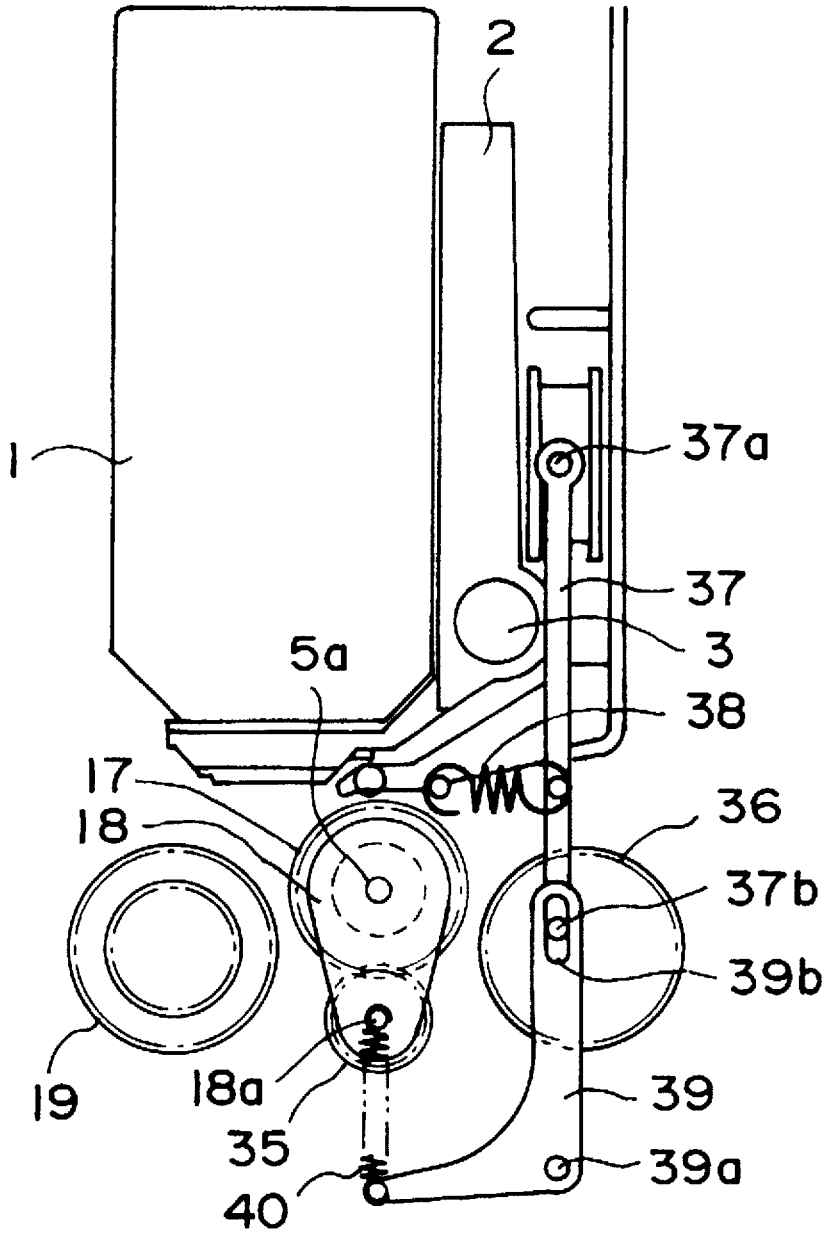
FIG. 14 is a side view of a major part of a recording apparatus according to a third embodiment of the present invention in a neutral state without drive transmission.
Figure 15:
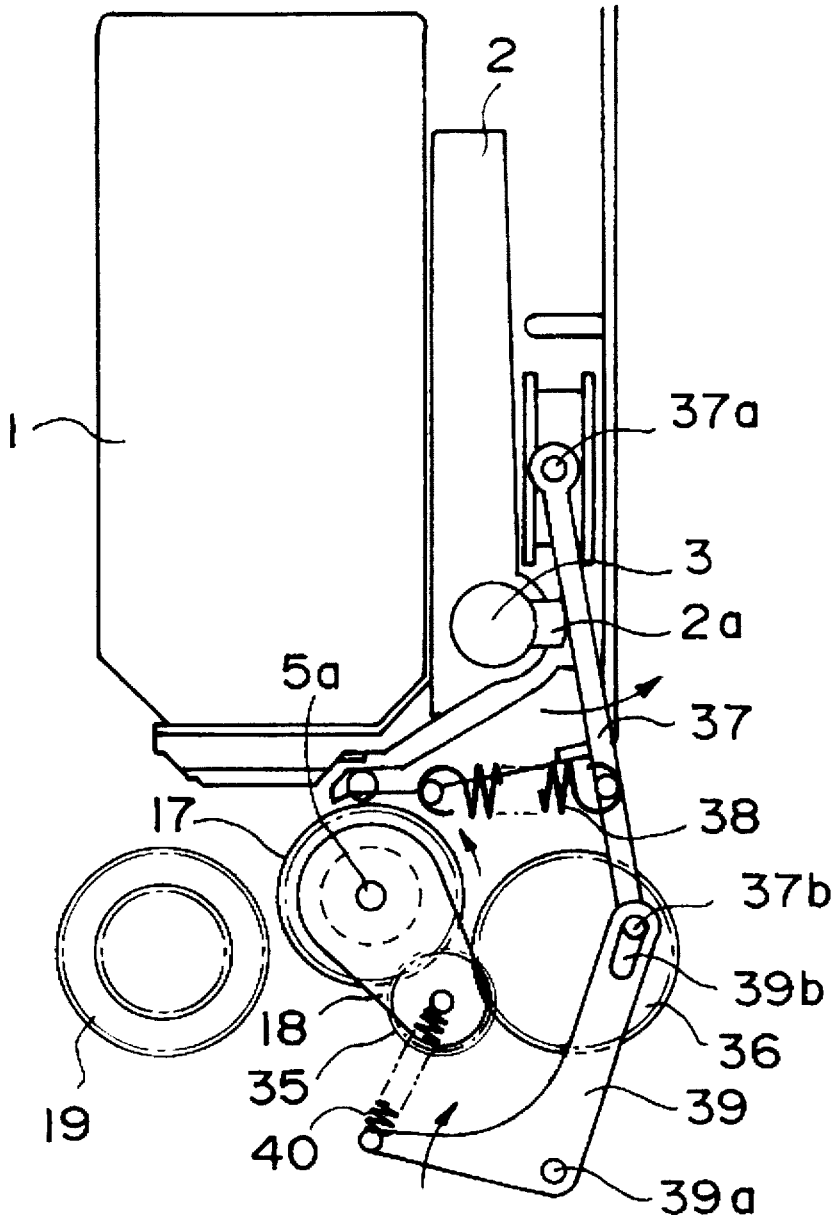
FIG. 15 is a side view similar to FIG. 14 but in a drive transmission switchable state.

FIGS. 14 and 15 are side views of a major part of the recording apparatus according to a third embodiment of the present invention. FIG. 14 shows a state in which the carriage 2 is close to or at the recording position. FIG. 14 shows the state in which the carriage 2 is at an end of the movable range (capping position, for example). In the state of FIG. 14 in which the carriage 2 is closer to the recording position, the driving force of the feed gear 17 (feed roller) is not transmitted to the pump gear 19 or to the ASF gear 36. On the other hand, in the state of FIG. 15 where the carriage 2 is at the end position, the driving force of the feed gear 17 can be selectively transmitted to the pump gear 19 or the ASF gear 36, depending on the direction of the rotation of the feed gear 17.

In FIGS. 14 and 15, a release lever 37 is mounted for rotation about a rotational shaft 37*a* extending parallel to the carriage 2 movement direction. The release lever 37 is normally urged in the clockwise direction in the Figure by a release spring 38, as shown in FIG. 14. A release cam 39 is mounted for rotation about a rotational shaft 39*a* extending in a direction parallel to the carriage 2 movement direction. Adjacent an end portion of the release cam 39, a receiving hole 39*b* is formed, and the receiving hole 39*b* is engaged by a driving shaft 37*b* at an end of the release lever 37. Between the other end of the release cam 39 and the bottom end of the switching lever 39, there is mounted a lever spring 40 for limiting the motion of the switching lever 18.

In the the state of FIG. 14, the release lever 39 is urged in the clockwise direction by the release spring 38, and therefore, the release cam 39 is held at a position rotated to the counterclockwise direction through a driving shaft 37*b* of the release lever 37. The switching lever 18 is pulled downwardly by the lever spring 40. Therefore, in the state of FIG. 14, the switching lever 18 is held at the downward neutral position shown in the Figure, so that even if the feed gear 17 (feed roller 5) is rotated in the clockwise or counterclockwise direction, the rotational force thereof is not transmitted to the pump gear 19 or to the ASF gear 36.

On the other hand, in the state of FIG. 15 where the carriage 2 is placed at the end, the release lever 37 is rotated in the counterclockwise direction by the cam 2*a* of the carriage 2 against the spring force of the release spring 38. Therefore, the release cam 39 is rotated in the clockwise direction by the driving shaft 37*b* of the release lever 37. When this state is reached, as Shown in FIG. 15, the spring force of the lever spring 40 mounted between the other end of the release cam 39 and the bottom end of the Switching lever 18, is disabled, so that the switching lever 18 becomes rotatable about the feed roller shaft 5*a*.

Then, when the feed gear 17 (feed roller 5) is rotated in the counterclockwise direction, as shown in FIG. 15, the switching lever 18 rotates in the counterclockwise direction, as in the case of FIG. 7, so that the swingable gear 35 can be meshed with the ASF gear 36. Thus, by the counterclockwise rotation of the feed roller, the ASF can be driven by the driving force thereof. On the other hand, when the feed gear 17 is rotated in the clockwise direction, the switching lever 18 rotates in the clockwise direction to cause the swingable gear 35 to be meshed with the pump gear 19, by which the pump for the recovery operation can be driven by the rotating or driving force of the feed roller 5.

As described, in the state of FIG. 15, the drive transmission can be switched or shifted in response to the rotational direction of the driving source. The other structures and operations of the recording apparatus of the third embodiment described in conjunction with FIGS. 14 and 15, are substantially the game as in the first embodiment (FIGS. 1–8) or the second embodiment (FIGS. 9–13).

As described in the foregoing, according to the embodiments of FIGS. 1–15, the drive transmission is shifted in response to the rotational direction, and the neutral position not transmitting the driving force is established by the motion of the carriage 2, and therefore, the number of driving sources in the form of motors or the like, can be reduced. This is effective to reduce the cost of the apparatus. In addition, the dimension of the recording apparatus measured in the carriage 2 movement direction, can be reduced. Thus, the size and the weight of the apparatus can be reduced. The drive transmission can be shifted simply by stopping the carriage 2 at a predetermined position and changing the rotational direction of the driving source at the position, and therefore, the switching time period can be reduced, and in addition, the sequential operational steps can be simplified. Accordingly, the reliability of the operation of the recording apparatus can be improved.

Figure 16:
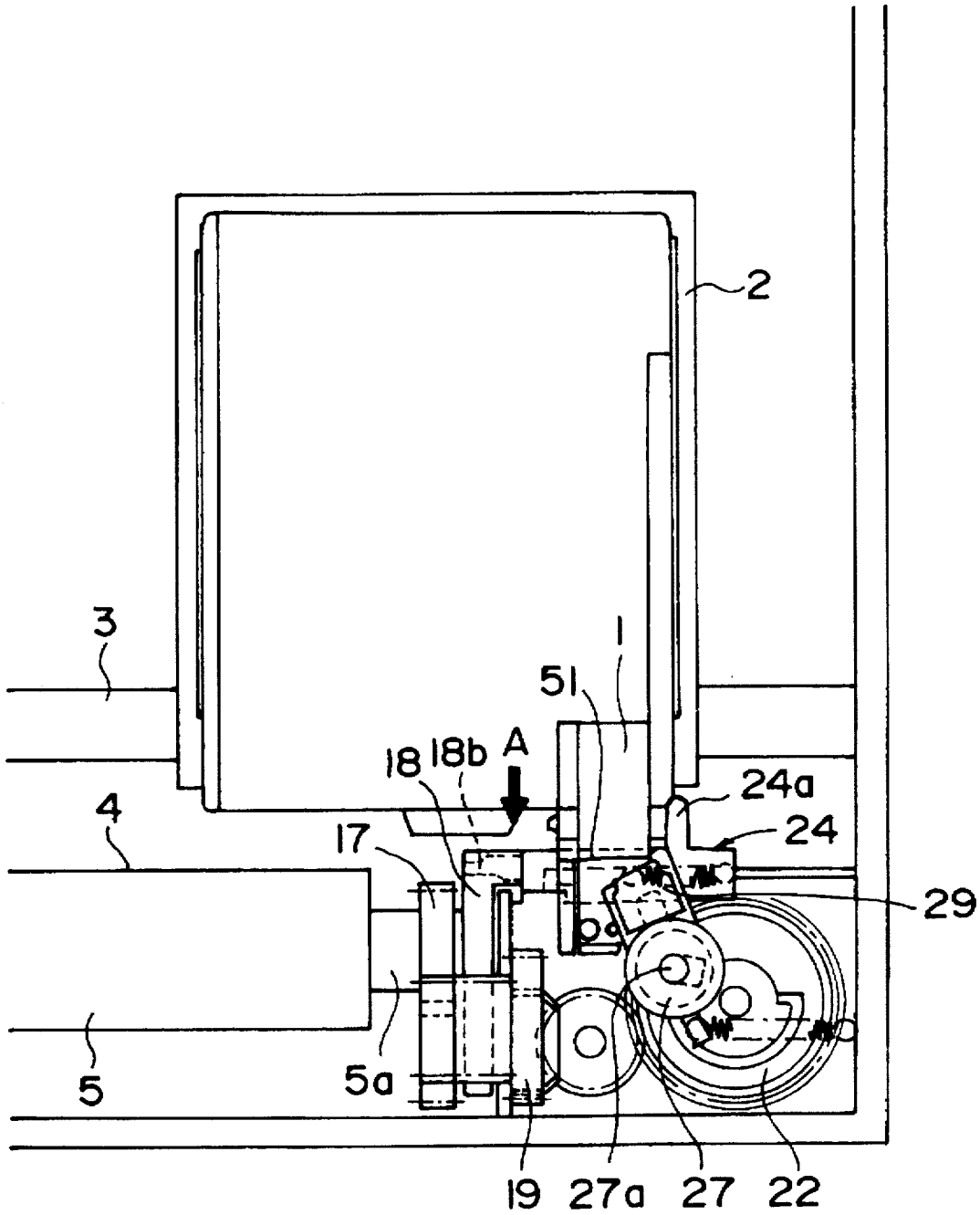
FIG. 16 is a front view of a major part of a recording apparatus according to a fourth embodiment of the present invention in a neutral state without drive transmission.
Figure 17:
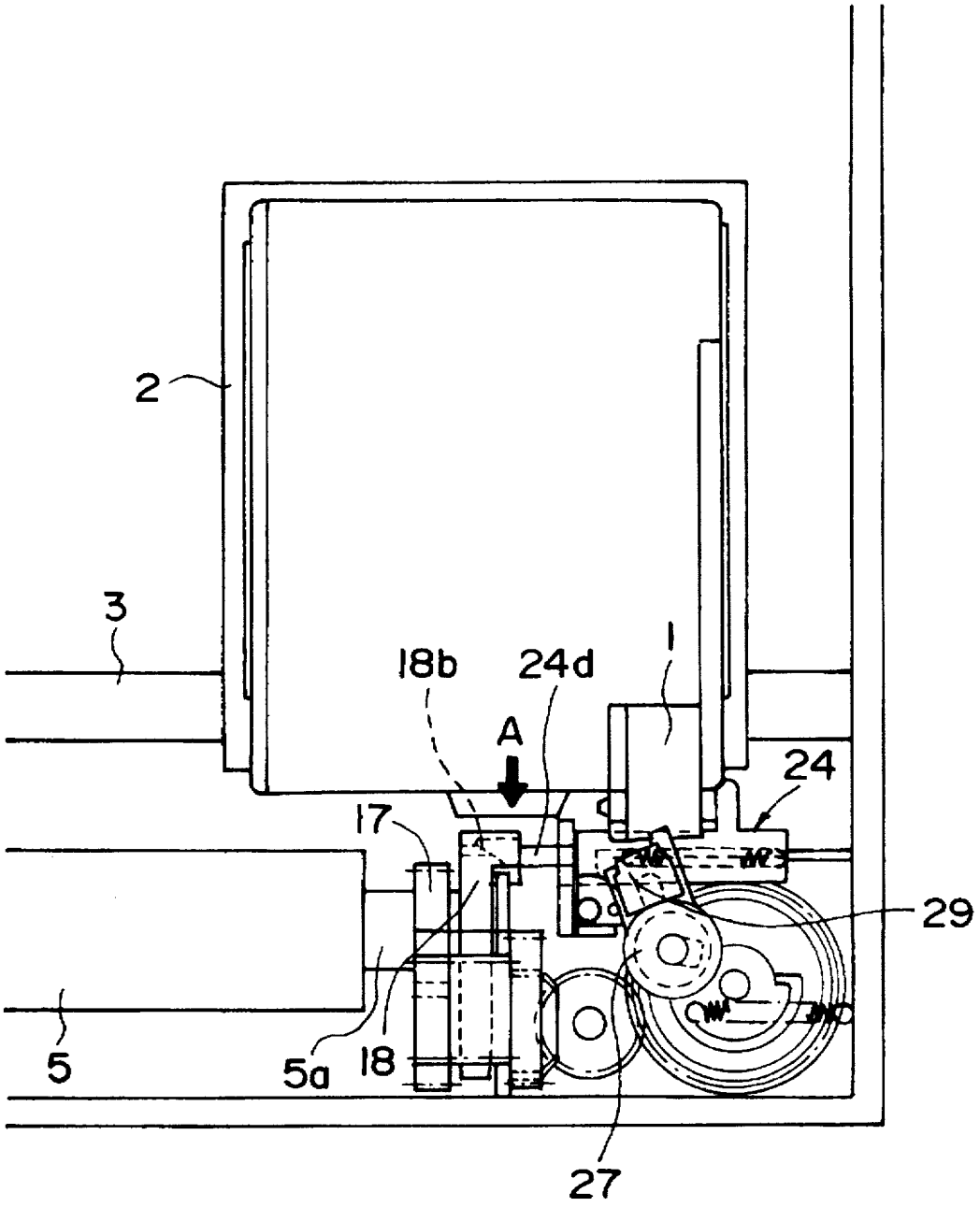
FIG. 17 is a front view of a recording apparatus of FIG. 16 in a state in which the drive transmission is possible in one direction.
Figure 18:
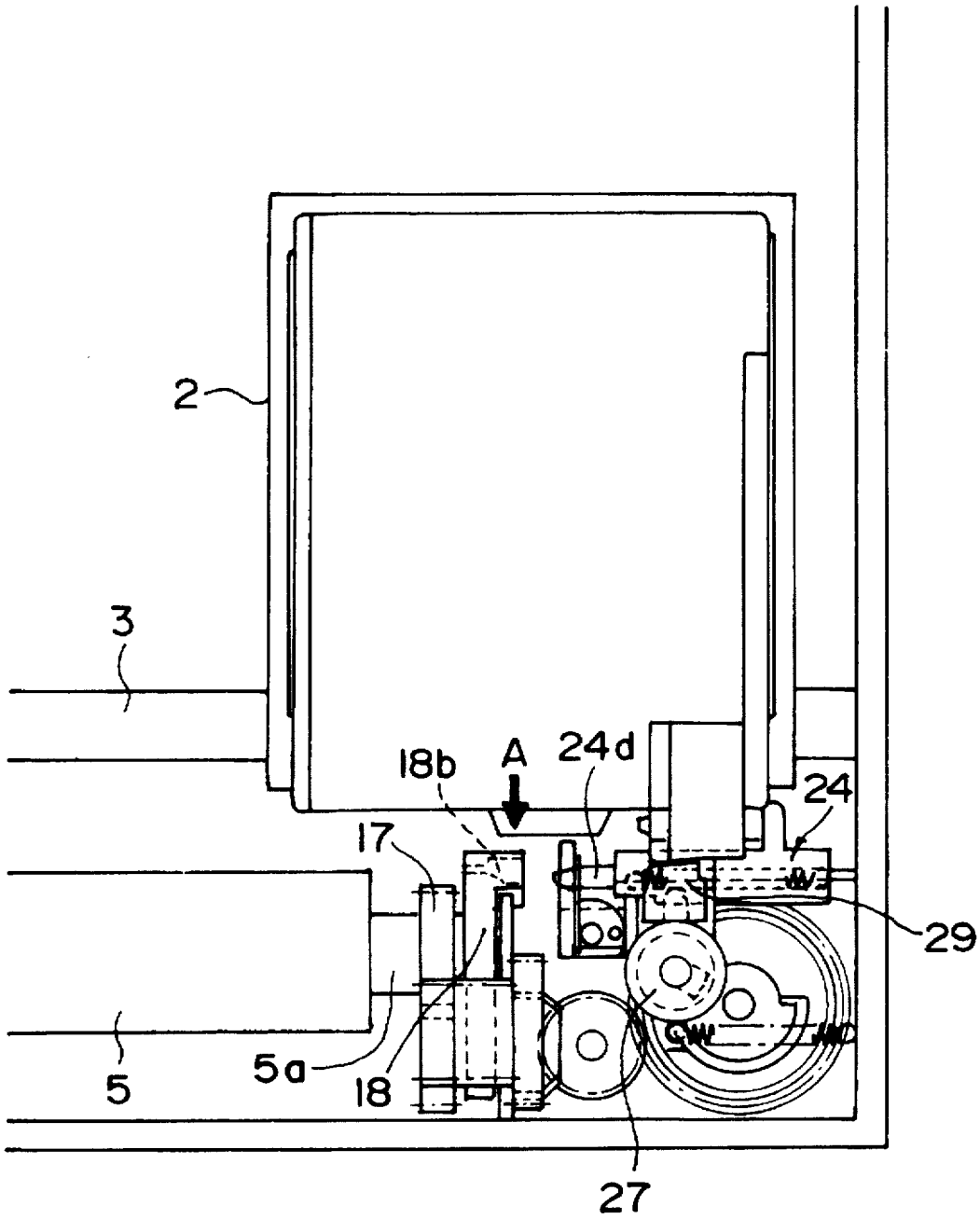
FIG. 18 is a front view of the recording apparatus of FIG. 16 in a capped state in which the drive transmission is switchable.
Figure 19:
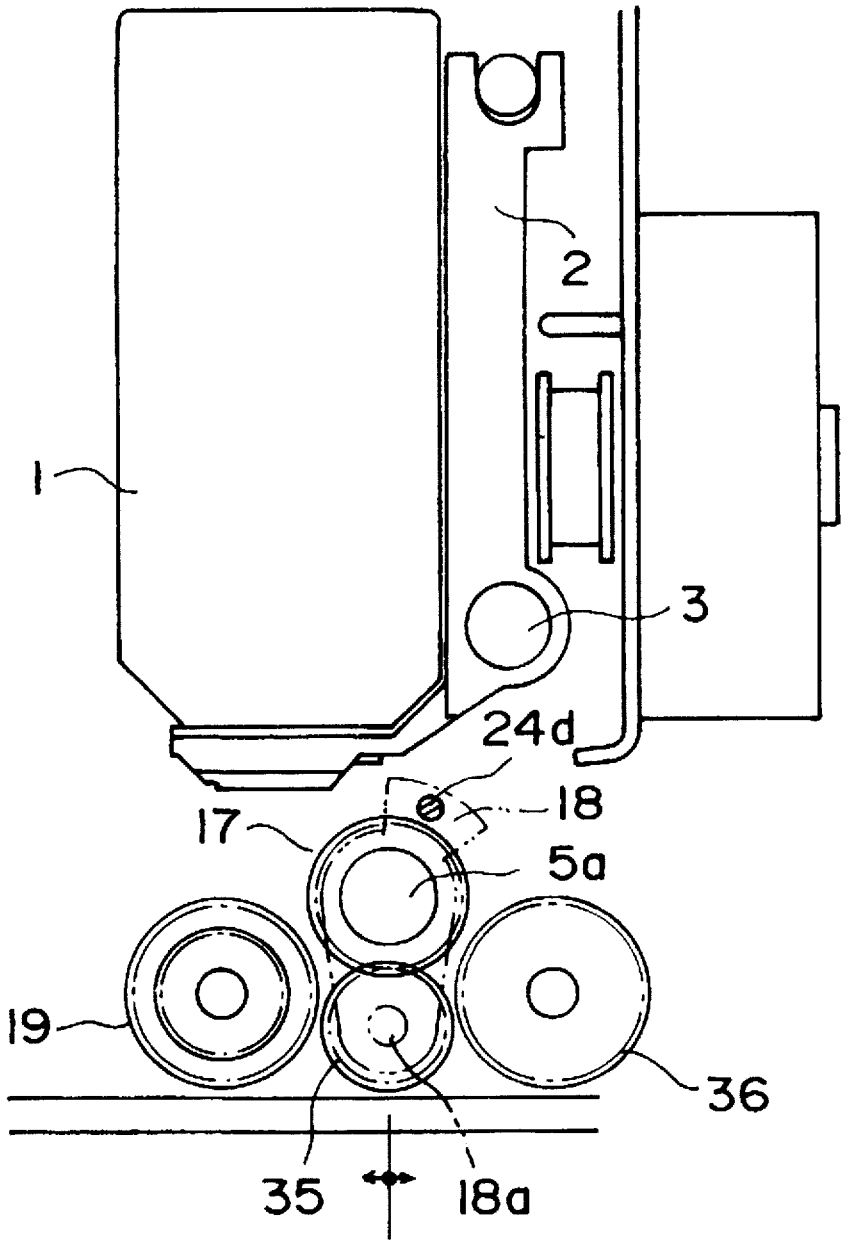
FIG. 19 is a side view of the apparatus of FIG. 16.
Figure 20:
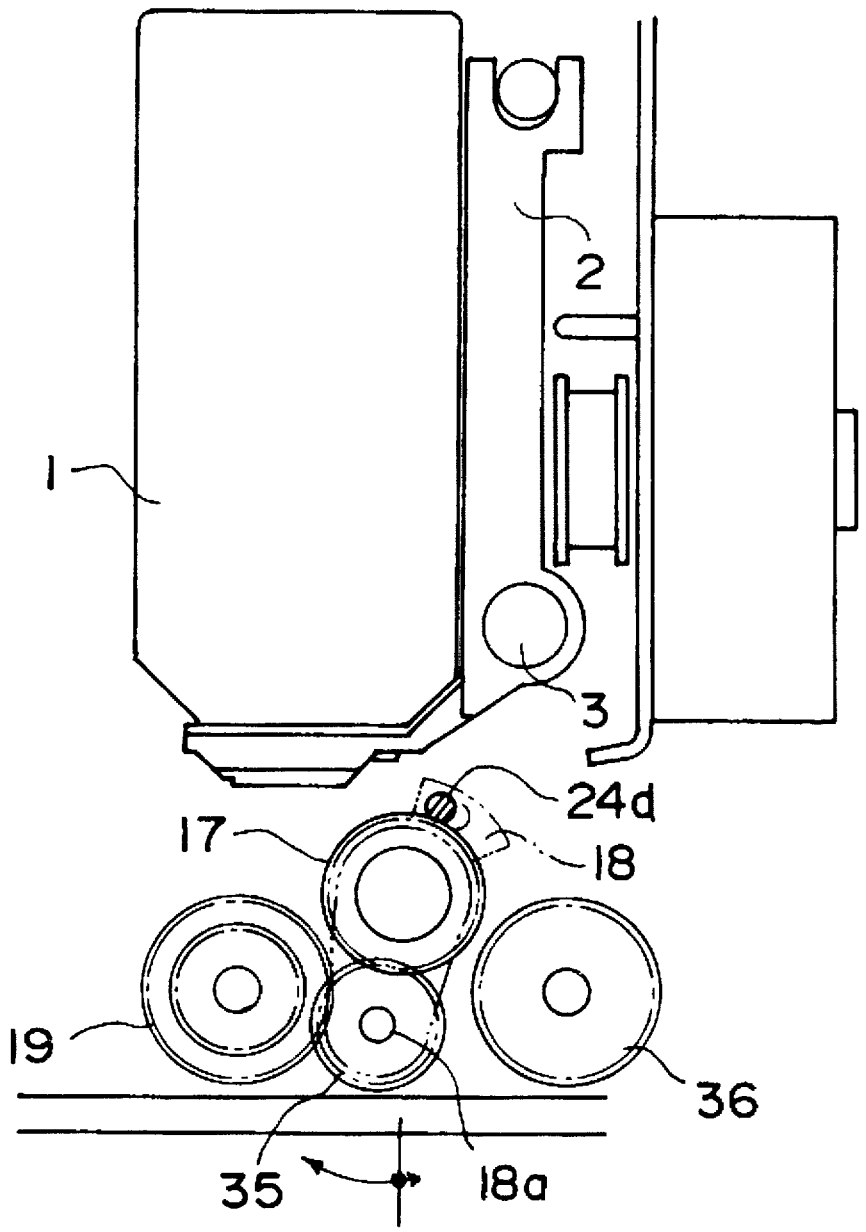
FIG. 20 is a side view of the apparatus of FIG. 17.
Figure 21:
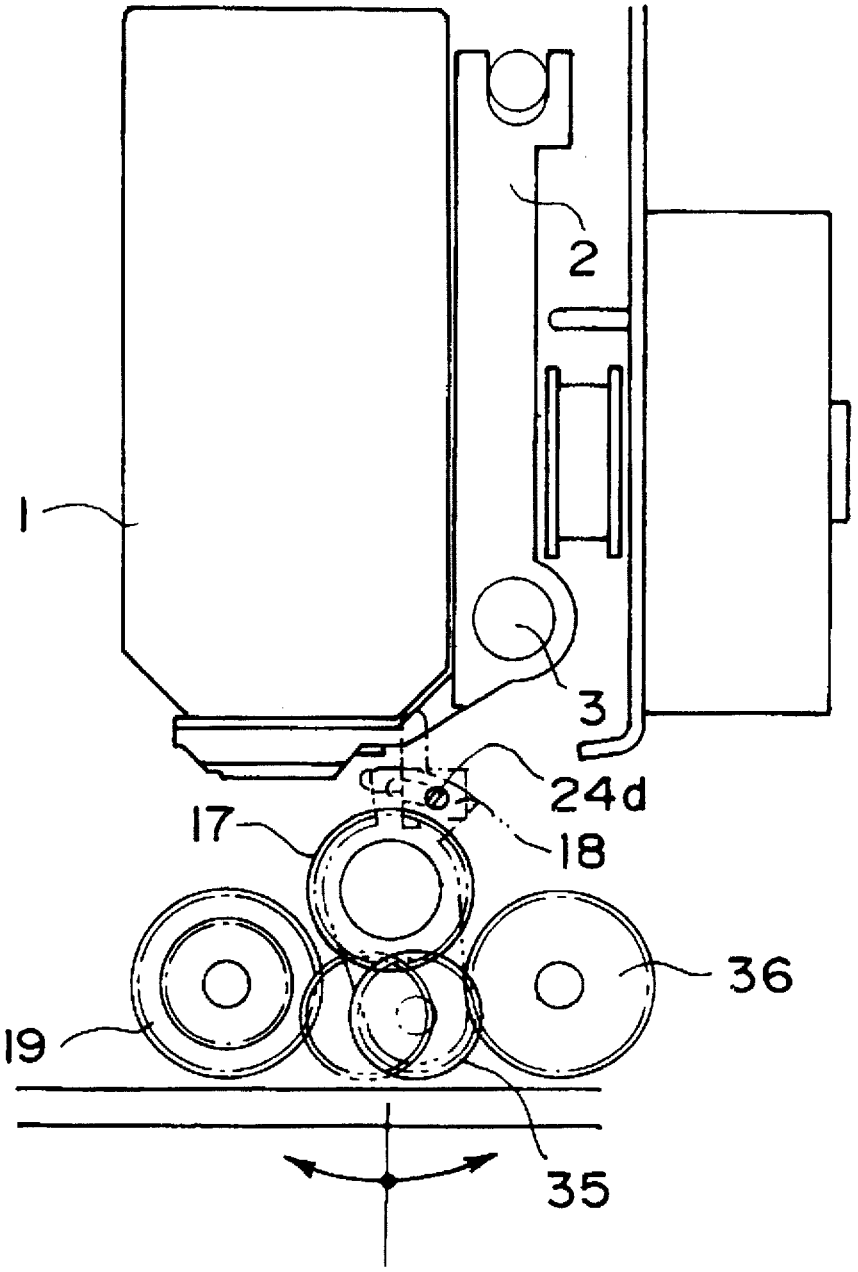
FIG. 21 is a side view of the apparatus of FIG. 18.
Figure 22:
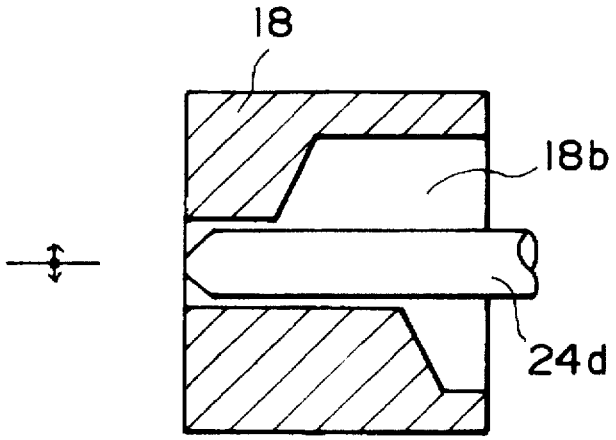
FIG. 22 is a partial sectional view illustrating a switching lever and a slide lever in the state shown in FIG. 16 of the apparatus.
Figure 23:
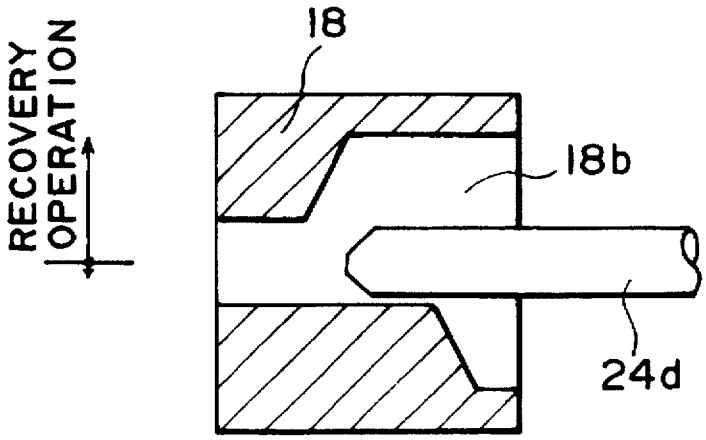
FIG. 23 is a partial sectional view of the switching lever and the slide lever at the position shown in FIG. 17.
Figure 24:
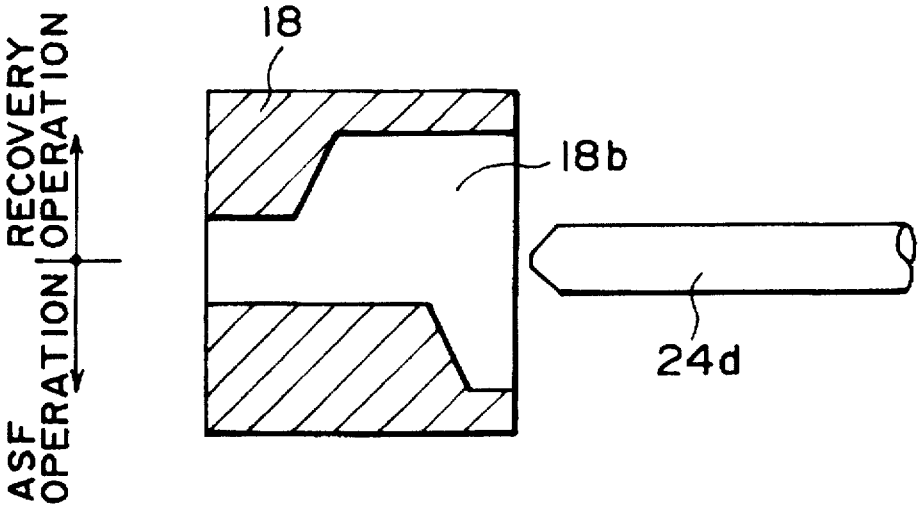
FIG. 24 is a partial sectional view of a switching lever and a slide lever in a state shown in FIG. 18.

Referring to FIGS. 16–24, the fourth embodiment of the present invention will be described. FIGS. 16–18 are front views of the recording apparatus with different carriage positions adjacent the right end portions. FIGS. 19–21 are right side views of FIGS. 16–18, respectively. FIGS. 22–24 show the switching lever 18 and the slide lever 24 as seen in the direction A in FIGS. 16–18.

The structure of the fourth embodiment of FIGS. 14–24 are substantially the same as of FIGS. 1–8 embodiment, except the engagement between the switching lever 18 and the slide lever 14. Therefore, in the general arrangement of the drive transmission switching mechanism of FIGS. 16–21, the same reference numerals as in FIGS. 1–7 of the first embodiment are assigned to the elements having the corresponding functions, and the detailed description thereof are omitted.

In the states of FIGS. 16, 19 and 22, the carriage 2 is still at the left position so that the recording head 1 is not capped, that the switching lever 18 is fixed at the neutral position and that the forward and backward rotation of the feed roller is used only for the sheet feeding. In FIGS. 17, 20 and 23, the carriage 2 is close to the right end so that the recording head 1 is faced to the cap 29. In this state, the recording head is not yet capped; the switching lever 18 is locked against the forward rotation of the feed roller 5: it is free for the backward rotation; the driving force is not transmitted to the ASF; but the driving force is transmitted to the pump of the recovery system. In FIGS. 18, 21 and 24, the carriage 2 has been moved sufficiently to the right end position (capping position); the recording head is capped by the cap; the switching lever 18 is free for the forward and backward rotation of the feed roller 5; and by the forward and backward rotation of the feed roller 5, the driving force transmission can be switched between for the ASF and for the recovery system.

Referring to FIGS. 16–24, the description will be made as to the drive transmission switching in the three positions of the carriage 2. In FIGS. 16, 19 and 22, the switching lever 18 is rotatable about a feed roller shaft 5a, and a swingable gear 35 is rotatably mounted on a swingable gear shaft **18*a* at the bottom end of the switching lever 18. When the switching lever 18 is in the free state, and when the rotation of the feed roller 5 rotates the feed gear 17 fixed on the feed roller shaft 5*a*, the switching lever 18 rotates about the feed roller shaft 5*a* through the swingable gear 35 meshed with the feed gear 17, in response to the rotating direction (forward or backward) of the feed gear 17. When, for example, the feed gear 17 rotates in the clockwise direction in FIG. 21, the switching lever 18 also rotates in the clockwise direction, so that the swingable gear 35 is brought into meshing engagement with the pump gear 19. When, on the other hand. The feed gear 17 rotates in the counterclockwise direction, the switching lever 18 also rotates in the counterclockwise rotation, so that the swingable gear 35 is brought into meshing engagement with the ASF gear. In this manner, the drive transmission can be switched between for the recovery system and for the ASF (automatic sheet feeder), in response to the rotational direction of the feed roller shaft 5*a*** (forward and backward).

However, in the states of FIGS. 16, 19 and 22, the carriage 2 is at the position to the left, and therefore, the slide lever 24 is not moved to the right in FIG. 16, and therefore, a pin **24*d* at the left end of the slide lever 24 is deeply engaged with a pin receptor 18*b* of the switching lever 18. For this reason, even if the feed roller shaft 5*a* rotates, the switching lever 18 remains fired at the neutral position, and therefore, the drive transmission is not effected to either side. More particularly, the pin receptor 18*b* of the slide lever 24 has a configuration shown in FIGS. 22–24. In the state of FIG. 22, the pin 24*d* of the slide lever 24 is deeply engaged with the pin receptor 18*b* of the switching lever 18, and therefore, the switching lever 18 is held or fixed at the neutral position shown in FIG. 19. Even if the feed roller 5 is rotated, the swingable gear 35 is not engaged with the pump gear 19 or the ASF gear 36, and therefore, the rotational force of the feed roller 5 rotates the swingable gear 35 idly without drive transmission. The normal sheet feeding (the feeding of the recording material 4) is carried out by rotating the feed roller 5 in the forward direction in the state of FIG. 19**.

Now, the description will be made referring to FIGS. 17, 20 and 23. When the carriage 2 moves to the neighborhood of the right end, as shown in FIG. 19, the slide lever 24 is moved through a predetermined amount to the right by the recording head. As shown in FIG. 23, the pin **24*d* at the left end of the slide lever 24 is engaged with (inserted into) the middle position of the pin receptor 18*b* of the switching lever 18. With this state, as shown in FIGS. 20 and 23, the switching lever 18 is rotatable to the pump gear 19 only. When the feed gear 17 is rotated in the clockwise direction, the switching lever 18 also rotates in the clockwise direction so as to engage the swingable gear 35 rotatably mounted on the switching lever 18 to the pump gear 19. On the other hand, when the feed gear 17 is rotated in the counterclockwise direction in the state shown in FIGS. 17 and 23, the switching lever 18 is locked at a half way position, and therefore, the swingable gear 35 is prevented from meshing engagement with the ASF gear 36**.

In the state of FIGS. 17, 20 and 23, the carriage 2 is at such a position that the carried recording head has not yet been capped by the cap 29. At this position of the carriage, the recording head 1 may be subjected to the preliminary ejection or the like. Therefore, when the feed roller 5 is rotated in the clockwise direction with the carriage placed at the position, the swingable gear 35 is meshed with the pump gear 19 to drive the pump. This permits the ink sucking operation (discharge) for sucking out the ink discharged into the cap by the preliminary ejecting operation. During the normal recovery operation, the carriage 2 is returned to the position of FIG. 17 after the ink sucking operation with the cap 29 press-contacted to the recording head 1. Then, the cap 29 is moved away from the ejection side surface 51, and then the ink in the cap 29 is sucked out, as described hereinbefore, so that the idle sucking can be effected to suck the ink in the cap 29.

When the sheet feeding is desired with the state of FIGS. 17, 20 and 23 or when the preliminary ejection is desired during the sheet feeding, it is required that the feed gear 17 is rotated in the counterclockwise direction with the carriage positions at this position. In such a case, the switching lever 18 is locked in a halfway position, as described hereinbefore, and therefore, the swingable gear 35 is not meshed with the ASF gear 36. For this reason, the inconvenience of the ASF being driven, does not arise.

The description will be made as to the states of FIGS. 18, 21 and 24. When the carriage 2 is moved further to the right from the position of FIG. 17, the slide lever 24 also moves further to the right, to the capping position in which the ejection side surface 51 of the recording head is closed by the cap 29, as shown in FIG. 18. At this capping position, as shown in FIG. 24, the pin **24*d* at the left end of the slide lever 24 is disengaged from the pin receptor 18*b* of the switching lever 18. Thus, as show in FIG. 21, the switching lever 18 is rotatable in either direction for the pump gear 19 and for the ASF gear 36**.

When the feed gear 17 is rotated in the clockwise direction, the switching lever 18 also rotates in the clockwise direction, so that the swingable gear 35 rotatably mounted on the switching lever 18 is meshed with the pump gear 19. When the feed gear 17 is rotated in the counterclockwise direction, the switching lever 18 also rotates in the counterclockwise direction, so that the swingable gear 35 is brought into meshing engagement with the ASF gear 36. Thus, the drive transmission can be switched to either direction, depending on the rotational direction of the feed roller 5.

In the position of the carriage 2 shown in FIGS. 18, 21 and 24, the recording head is capped hermetically by the cap 29. With this state, by rotating the feed gear in the clockwise direction, it is possible to perform the recovery operations for the ejection outlets 52 of the recording head 1. In addition, by rotating the feed gear 17 in the counterclockwise direction, the ASF (auto-sheet feeder) can be driven.

Figure 25:
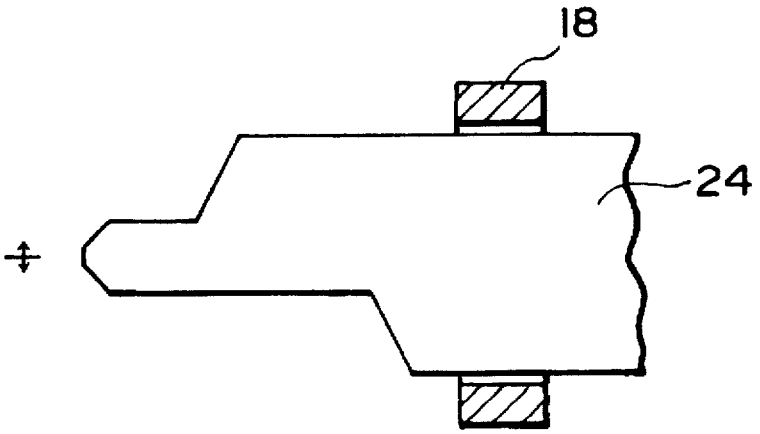
FIG. 25 is a partial sectional view of a recording apparatus according to a fifth embodiment of the present invention, illustrating a switching lever and a slide lever in a neutral position incapable of the drive transmission.
Figure 26:
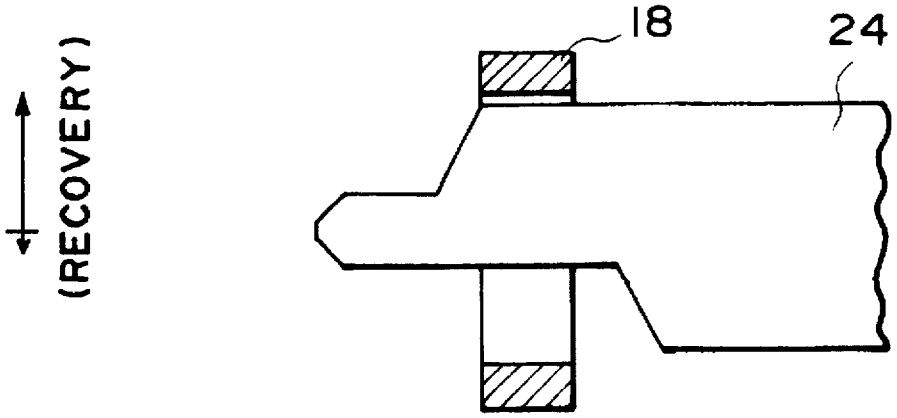
FIG. 26 is a partial sectional view of the apparatus in a state in which the drive transmission is possible only in one direction, in FIG. 25.
Figure 27:
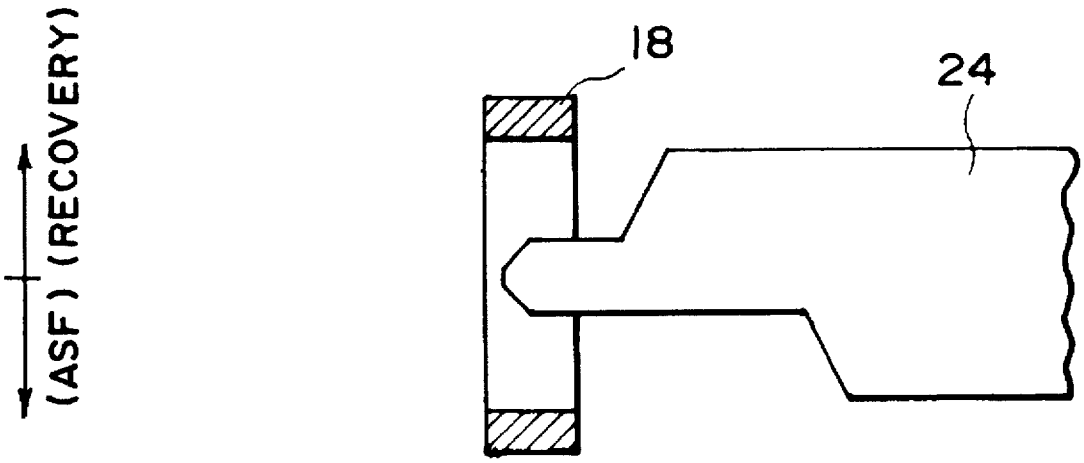
FIG. 27 is a partial sectional view in a state in which the drive transmission is switchable in both directions, in FIG. 25.

Referring to FIGS. 25, 26 and 27, the description will be made as go a fifth embodiment of the present invention. In this embodiment, the states shown in FIGS. 22–24 Of the fourth embodiment, are accomplished through other methods. In FIGS. 25– 27, the portion of the slide lever 24 engageable with the switching lever 18 has a vertical step in FIGS. 25–27, and takes the positions shown in FIGS. 25–27, corresponding to the positions of the carriage 2 (FIGS. 16–18) in the fourth embodiment. The switching lever 18 has a receptor hole engageable with a widest portion of the stepped configuration of the slide lever 24. The recording apparatus of the fifth embodiment (FIGS. 25–27) is different. In the above respects from the fourth embodiment, but it is substantially the same in the structure in the other respects.

FIG. 25 shows the state in which the carriage 2 is at a left position corresponding to the position shown in FIG. 16. In this state of FIG. 25, the slide lever 24 is at the leftmost position, wherein the widest portion of the step of the slide lever 24 is engaged with the switching lever 18. With this state, therefore, the rotation of the switching lever 18 is prevented by the slide lever 24 in both directions, and therefore, even if the feed roller 5 is rotated in the forward or backward direction, the drive is not transmitted, so that both of the recovery operation and the ASF operation are prevented.

In FIG. 26, the carriage 2 is at a position close to the left most position, wherein the slide lever 24 has been moved halfway toward the right. In the state of FIG. 26, the wide portion of the step of the slide lever only at one side (upper side) is engaged with the receptor of the switching lever 28. Therefore, the switching lever 18 is rotatable only upwardly in the Figure. The downward rotation thereof is prevented.

Therefore, with the state of FIG. 26, the recovery operation is possible by rotating the feed gear 17 in the clockwise direction. However, even if the feed gear 17 is rotated in the counterclockwise direction, the ASF operation is not possible.

FIG. 27 shows a state in which the carriage 2 has moved further to the right from the position of FIG. 26, and it is at the capping position for the recording head. In the state of FIG. 27, the narrowest portion of the step of the slide lever 24 is engaged with the receptor of the switching lever 18. Therefore, the switching lever 18 is free in the upward and lower movement in the Figure. Therefore, both of the recovery operation through the pump gear 19 and the ASF operation through the ASF gear 36 are permitted. The drive transmission is selectively switched for the recovery operation and for the ASF operation, by selecting the feed gear 17 rotation direction.

Figure 28:
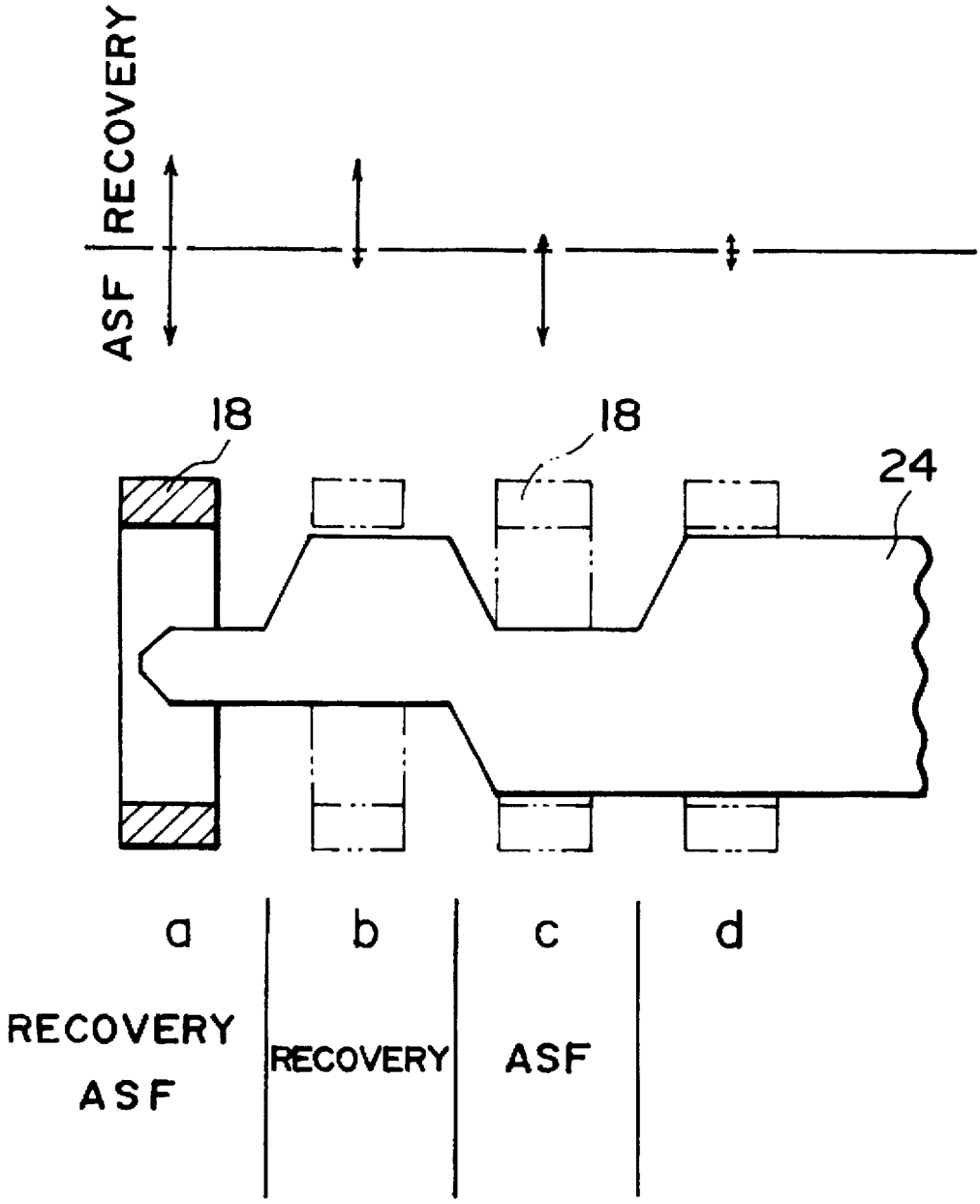
FIG. 28 is a partial sectional view of a recording apparatus according to a sixth embodiment of the present invention, illustrating a switching lever and a slide lever at opposed positions.

Referring to FIG. 28, there is shown a recording apparatus of a sixth embodiment of the present invention. In this embodiment, there is provided a position in which the ASF operation is enabled but the recovery operation is disabled, in addition to all the positions of the fifth embodiment shown in FIGS. 25–28. In FIG. 28, the slide lever 24 has a saw teeth configuration. It is moved to the left and right in FIG. 28 in accordance with movement of the carriage 2. In FIG. 28, reference characters a, b, c and d designate the relative position of the switching lever 18 when the slide lever 24 moves to the left and right. In other words, when the carriage 2 moves from the left to the right, the switching lever 18 sequentially takes the relative positions d-c-b-a.

When the carriage 2 is at the right end capping position, the switching lever 18 is at the position a. In this state, the switching lever 18 is not controlled by the slide lever 24, and therefore, can be rotated in either direction. Accordingly, the drive transmission is switchable selectively to the recovery operation and to the ASF operation, depending on the rotating direction of the feed roller 5.

When the switching lever 18 takes the relative position b by the leftward a movement of the slide lever 24 due to the leftward movement of the carriage 2, only the ASF operation is prevented, and therefore, the state is such that the drive transmission to the ASF is disabled, whereas the drive transmission to the recovery operation is enabled.

When the switching lever 18 takes the relative position c by the further leftward movement of the carriage 2 and the slide lever 24, only the recovery operation is prevented, and therefore, the drive transmission to the recovery operation is disabled, whereas the drive transmission for the ASF operation is enabled.

When the carriage 2 moves further to the left, the contact between the carriage and the slide lever 24 is released, and the switching lever 18 takes the relative position d. In this state, the motion of the switching lever 18 to the recovery operation mechanism and to the ASF operation mechanism, are both prevented, and therefore, the drive transmissions for the recovery operation and for the ASF operation, are both disabled.

Thus, by the use of the slide lever 24 having the saw teeth configuration shown in FIG. 28, it is possible to independently enable or disable the recovery operation and the ASF operation. Thus, all of combinations of such operations, can be established only by the carriage 2 movement.

Figure 29:
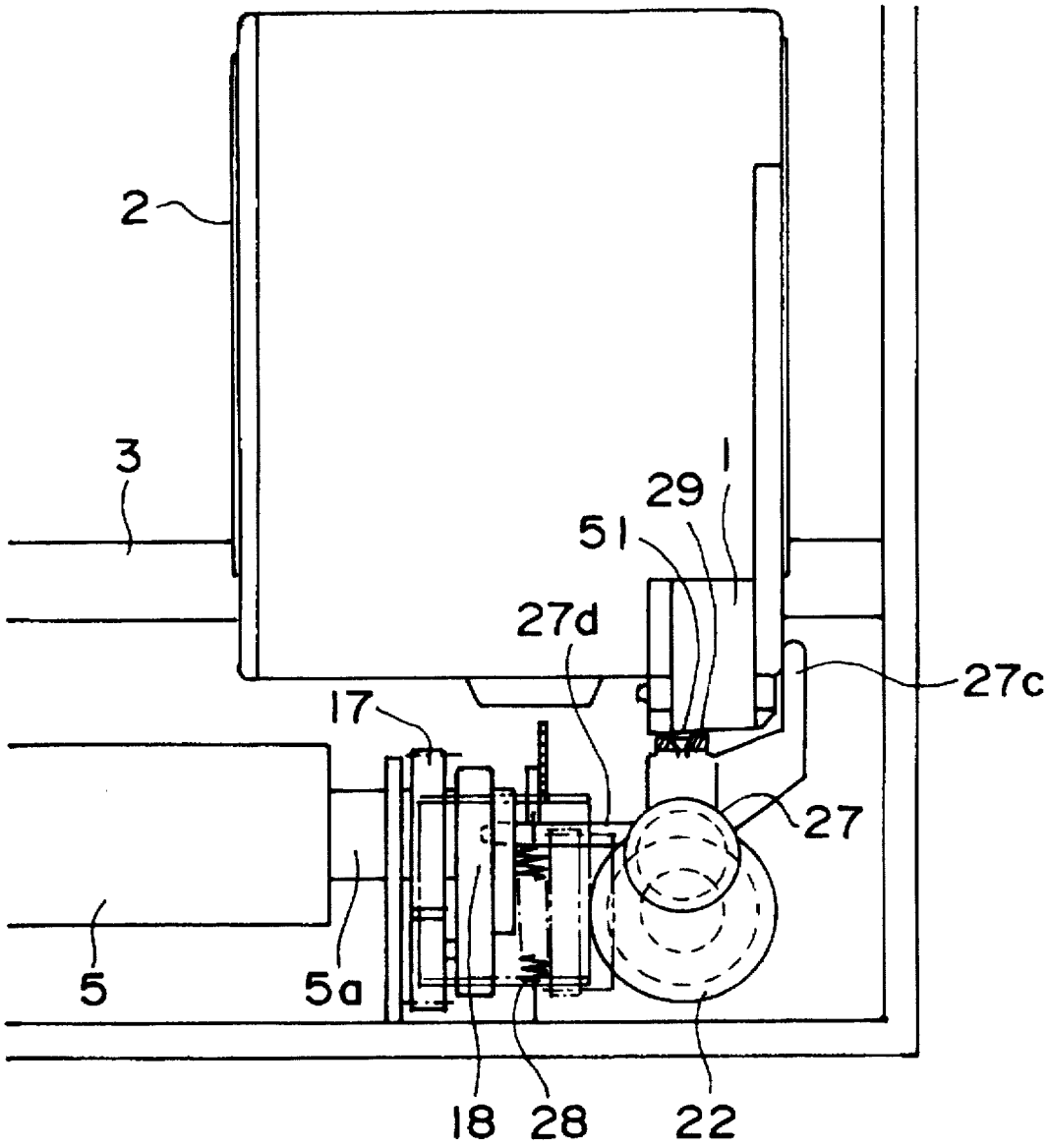
FIG. 29 is a front view of a recording apparatus according to a seventh embodiment of the present invention in a capped state in which the drive transmission is switchable in both directions.
Figure 30:
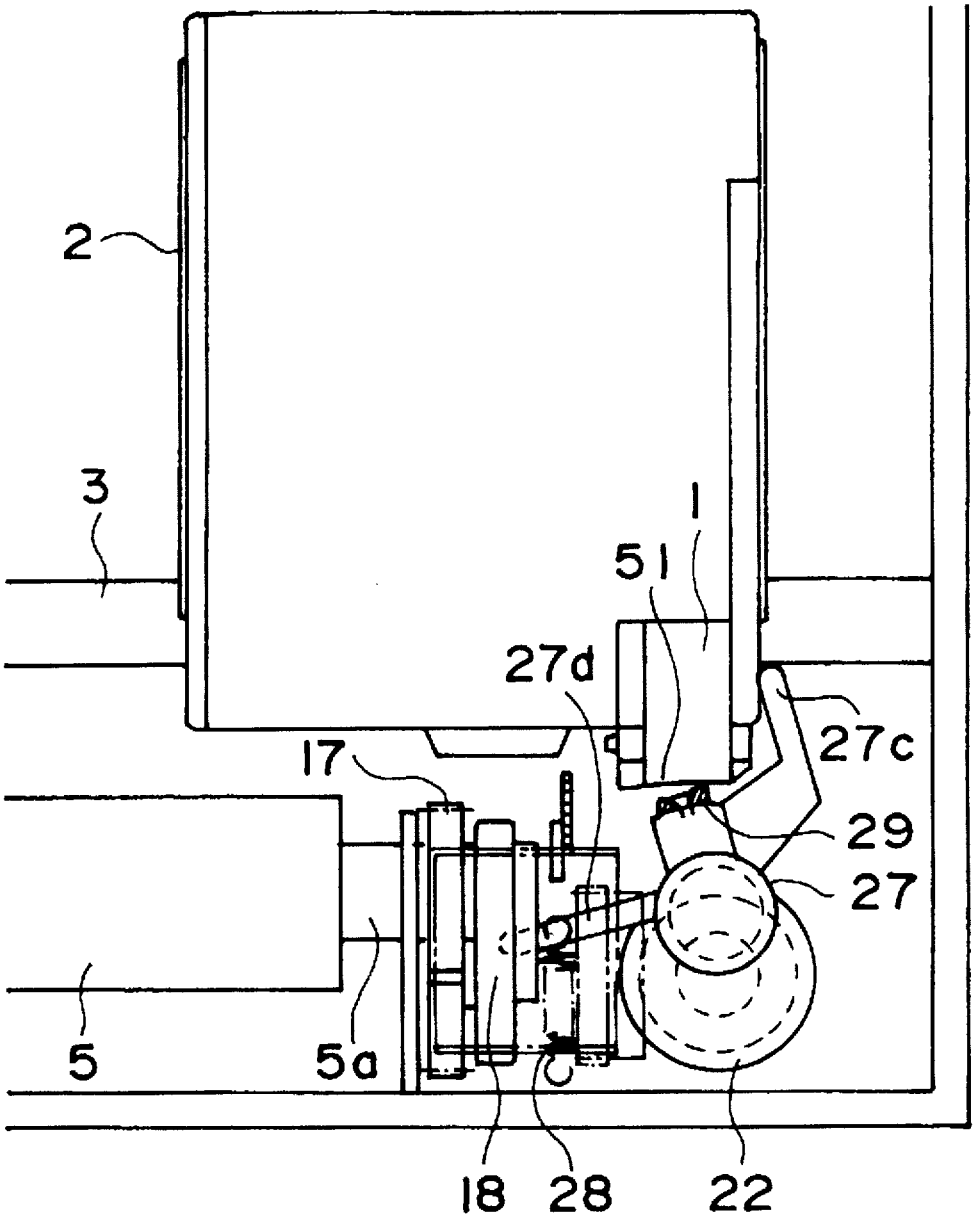
FIG. 30 is a front view of a recording apparatus of FIG. 29 in a state capable of drive transmission only in one direction.
Figure 31:
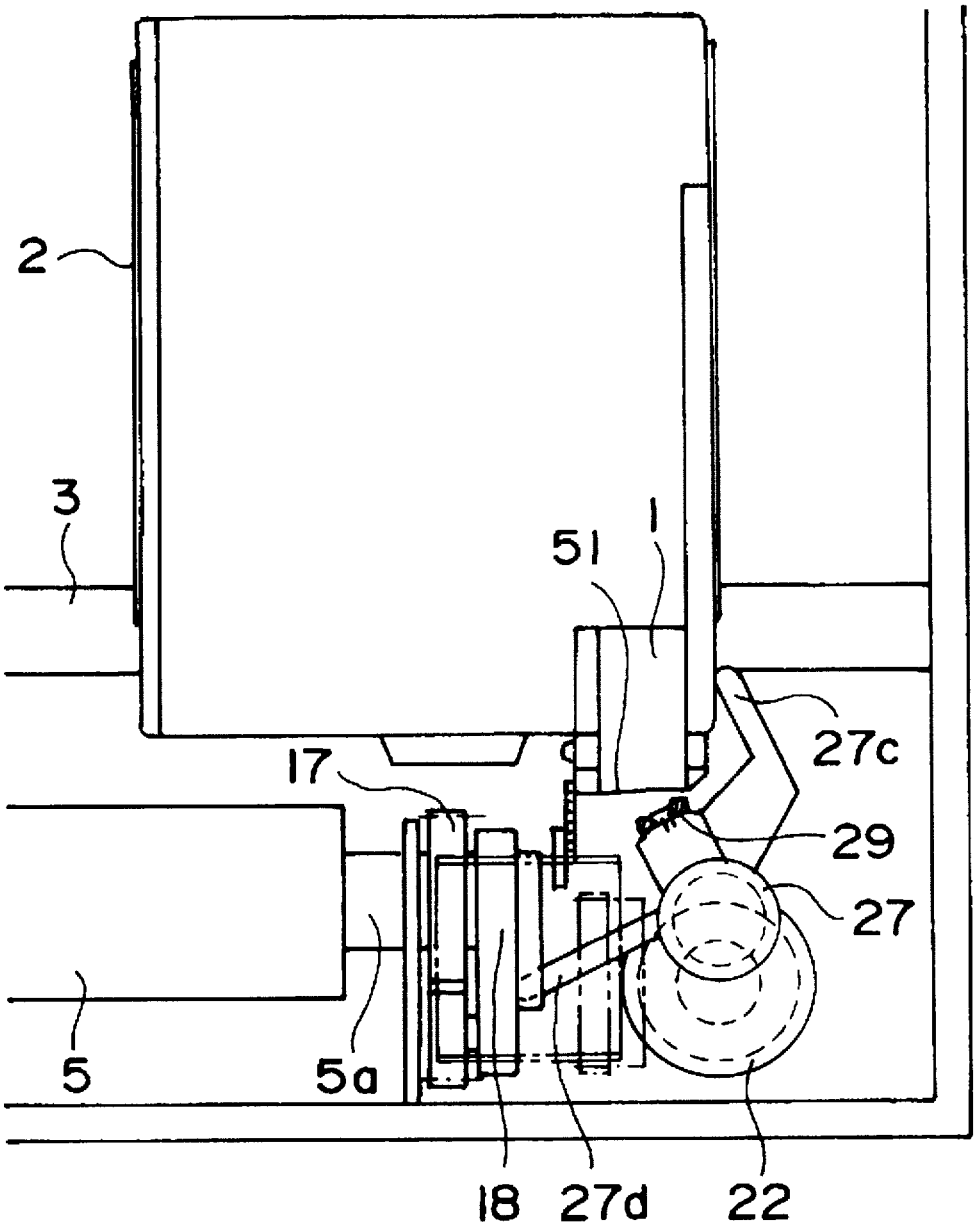
FIG. 31 is a front view of a recording apparatus of FIG. 29 in a state incapable of drive transmission in any direction.

Referring to FIGS. 29, 30, 31, 32, 33, 34 and 35, a recording apparatus according to a seventh embodiment of the present invention will be described. FIGS. 29–31 are front views in which the carriage 2 position adjacent the right end portion of the recording apparatus are different, and FIGS. 32–35 are side views from the right, of FIGS. 29–31

The structures of the seventh embodiment of FIGS. 29–35, are substantially the same as in the second embodiment shown in FIGS. 9–10, except for the engagement between the switching lever 18 and the slide lever 24. Therefore, the same reference numerals as in FIGS. 1–7 (First embodiment) are assigned to the elements having the corresponding functions in FIGS. 29–31 showing the general arrangement of the drive switching mechanism, and the detailed description thereof are omitted.

Figure 35:
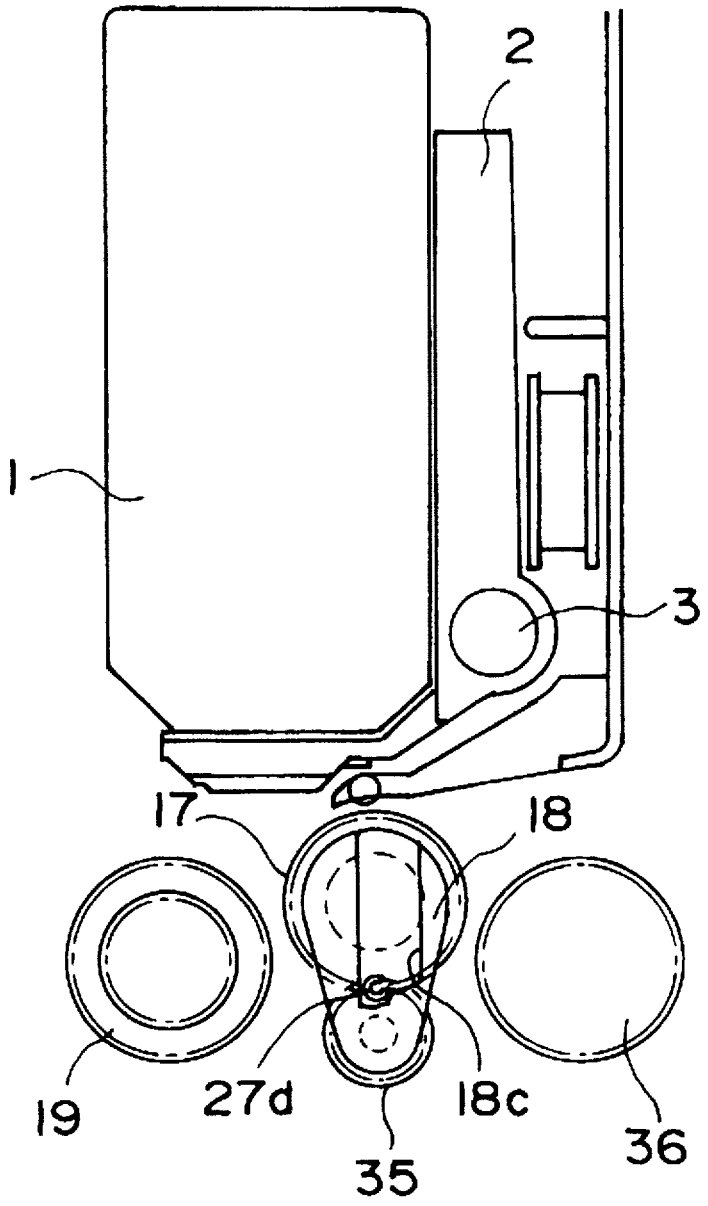
FIG. 35 is a side view of the apparatus shown in FIG. 31.

In FIGS. 31 and 35, the carriage 2 is still at the left position (normal position). In this state, the cylinder 27 is at the angular position shown in FIG. 1 by the cylinder spring 28 engaged to the arm 27*d*.

With the movement of the carriage 2 carrying the recording head 1 to the right, the recording head pushes the head lever 27*c* of the cylinder 27, so that the cylinder 27 rotates against the spring force of the cylinder spring 28. Therefore, the state of FIG. 30 is established in which the ejection side surface 51 of the recording head is faced to the cap 29. In this state, the ejection side surface 51 not yet capped. By the further rightward movement of the recording head, the cylinder 27 further rotates, as shown in FIG. 29, and the cap 29 is brought into close contact to the ejection side surface 51, whereby the recording head 1 is capped with the cap 29.

Figure 32:
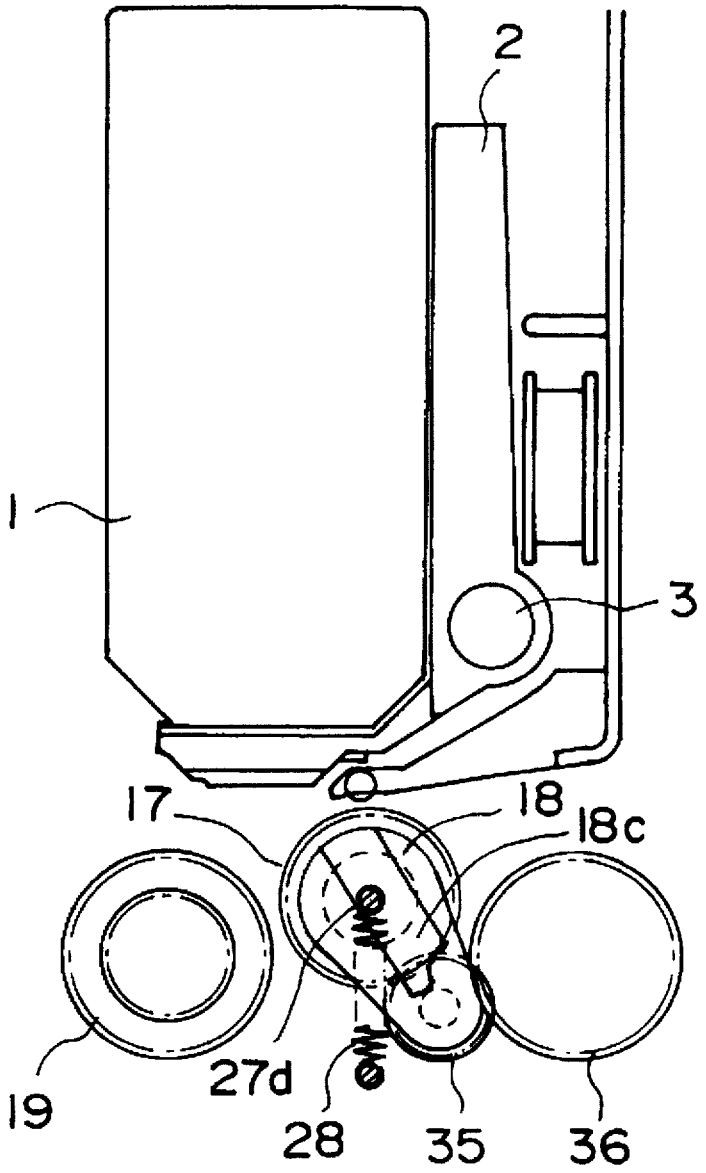
FIG. 32 is a side view of the apparatus of FIG. 29.

FIG. 32 is a side view of the switching lever 18 and the peripheral structures thereof in the state of FIG. 29. In this state, the feed gear 17 (feed roller (5) has been rotated in the counterclockwise direction). In this state, an end portion of the arm 27*d* of the cylinder 27 is engaged with a cam 18*c* of the switching lever 18 at a position in the neighborhood of the rotational axis of the switching lever 18. Therefore, in the capping position of FIGS. 29 and 32, the rotation of the switching lever 18 is not limited by the arm 29*d*. When the feed gear 17 is rotated in the counterclockwise direction in this state, the swingable gear 35 is brought into meshing engagement with the ASF gear 36, as shown in FIG. 32, thus enabling the ASF operation. On the other hand, when the feed gear 17 is rotated in the clockwise direction, the swingable gear 35 is brought into meshing engagement with a first pump gear 19, thus enabling the operation of the recovery pump. Thus, in the capping position shown in FIGS. 29 and 32, the drive transmission can be selectively switched between for the recovery pump and for the ASF, depending on the rotational direction of the feed roller 5.

Figure 33:
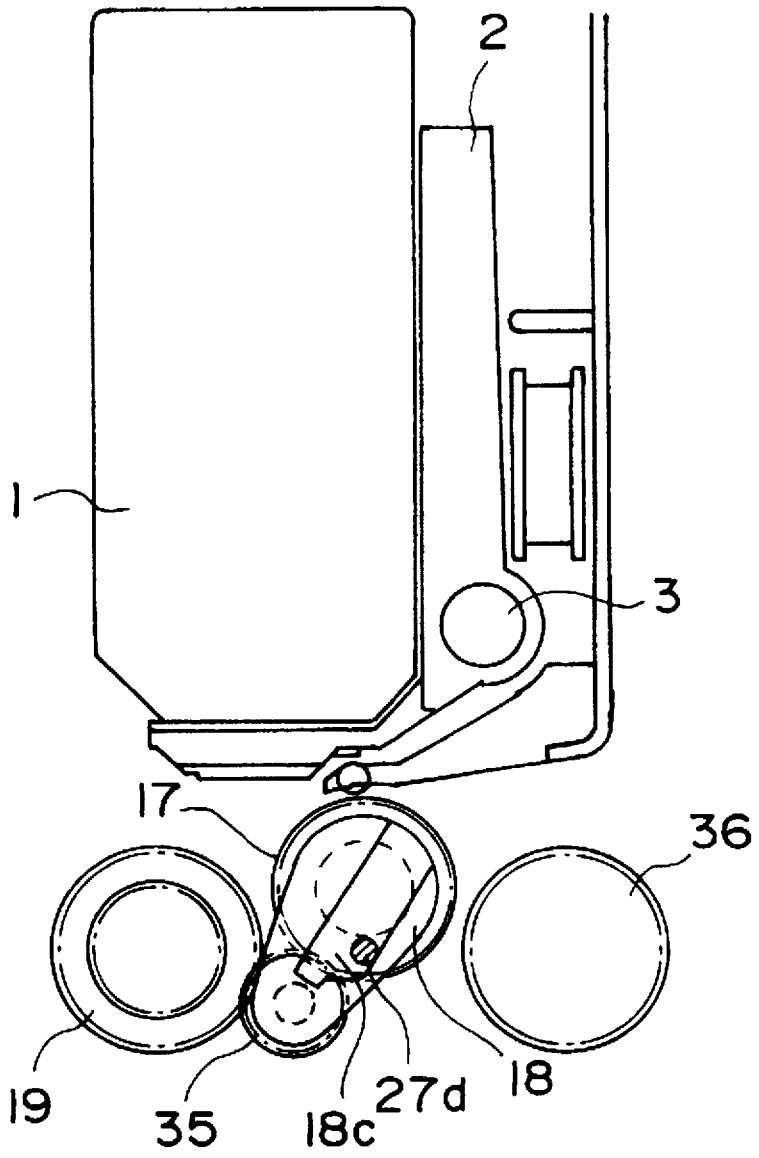
FIG. 33 is a side view of the apparatus when a feed gear is rotated in the clockwise direction in the state shown in FIG. 30.
Figure 34:
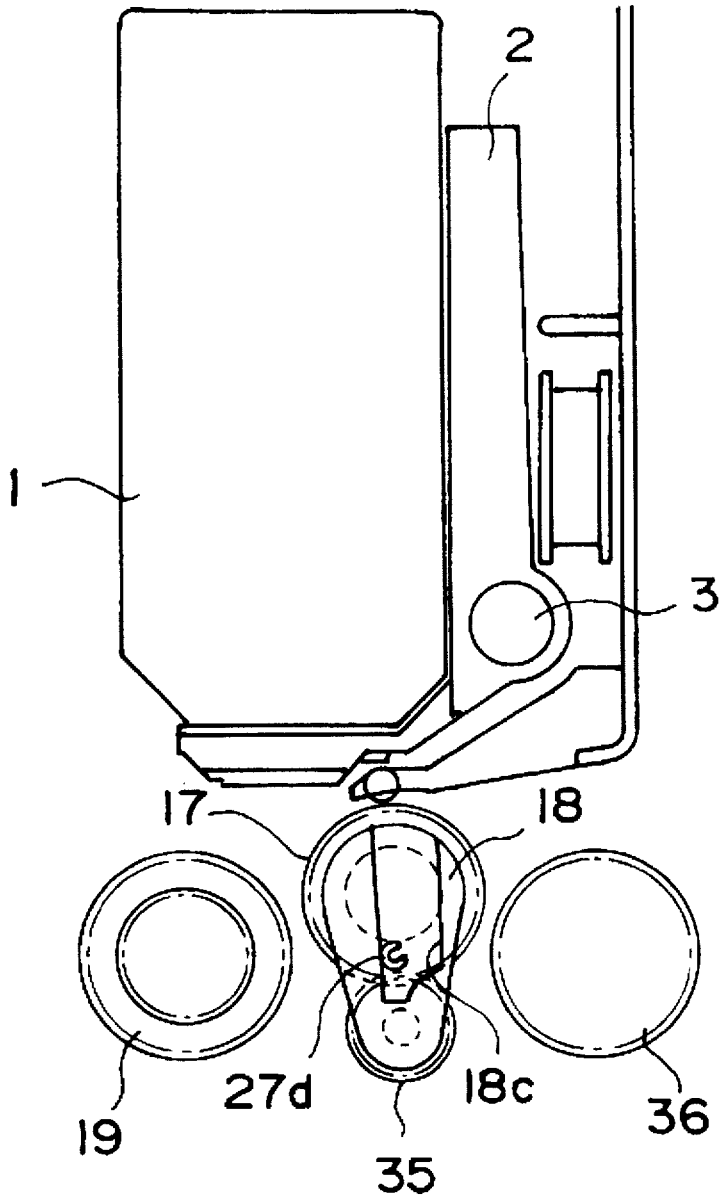
FIG. 34 is a side view of the apparatus when the feed gear is rotated in the counterclockwise rotation in the state shown in FIG. 30.

FIG. 30 shows a state in which the carriage 2 has been moved slightly to the left from the position of FIG. 29, or the carriage 2 is stopped before the right end capping position when the carriage 2 is moved to the right. FIGS. 33 and 34 are side views of the state of FIG. 30. FIG. 33 deals with the case of clockwise rotation of the feed gear 17, and FIG. 34 deals with the counterclockwise rotation of the feed gear. In this state, the arm 27*d* of the cylinder 27 is at a lower intermediate portion of the cam 18*c* of the switching lever 18, as shown in FIG. 33. Therefore, the rotation of the switching lever 18 for the clockwise rotation of the feed gear 17 is not prevented, but the rotation of the switching lever 18 for the counterclockwise rotation of the feed gear 18, is prevented. Accordingly, when the feed gear 17 is rotated in the clockwise direction, the swingable gear 35 is brought into meshing engagement with the pump gear 19, thus enabling the drive transmission to the recovery pump. When the feed gear 17 is rotated in the counterclockwise direction, on the contrary, the rotation of the switching lever 18 is prevented by the engagement between the cam 18*c* and the arm 27*d*, and therefore, the swingable gear 35 is prevented from engagement with the ASF gear 36, thus disabling the drive transmission to the ASF mechanism. In this manner, when the carriage 2 takes the position shown in FIG. 30, the state in which the recovery operation is possible while the ASF operation is not possible, is established.

FIG. 31 shows a state in which the cylinder 27 is not yet rotated at all or it is substantially not rotated, and FIG. 35 is a side view of the apparatus in the state of FIG. 31. In this state, as shown in FIG. 35, the arm 27*d* of the cylinder 27 is at the lower position and is engaged with the narrow width portion of the cam 18*c* of the switching lever 18. Therefore, even if the feed gear 17 rotates, the switching lever 18 is prevented from rotation in either direction. For this reason, even if the feed roller 5 rotates in the clockwise or counterclockwise direction, the switching arm 18 is retained at the neutral position. Thus, the swingable gear 36 is not engaged with the pump gear 19 or with the ASF gear 36. Accordingly, in the carriage position of FIG. 31, even if the feed roller 5 is rotated in the clockwise direction or counterclockwise direction, the swingable gear.35 rotates idly, and therefore, the recovery operation or the ASF drive operation are not carried out. The feeding of the recording material 4 during the recording, is normally carried out with the state of FIG. 31 or 35.

According to the fourth, fifth, sixth and seventh embodiments described in conjunction with FIGS. 16–35, additional advantageous effects are provided in addition to the advantageous effects of the first, second and third embodiments described in conjunction with FIGS. 1–15. The additional advantages include the enablement of the sheet feed (the ASF is not driven) simultaneously with the preliminary ejection, in addition to the recovery operation using the recovery pump, even when the recording head 1 is at the preliminary ejection position in which the recording head is not capped but is only faced to the cap 29. For this reason, the sequential operation of the recording apparatus is simplified, and the throughput of the entire recording system is improved.

In the foregoing embodiments, the recording head carried on the carriage 2 is used to move the sliding lever 24 or the cylinder 27. However, it is a possible alternative that the carriage 2 itself is used, or another material movable together with the carriage 2 is used.

In the foregoing embodiments, a single recording means (recording head) 1 is used. However, the present invention is applicable irrespective of the number of recording means, and therefore, is usable with a color recording apparatus having plural different color recording means, a tone reproducing recording apparatus using plural recording means containing different density ink of the same color. In such cases the same advantageous effects are provided. In the foregoing embodiments, the recording head and the ink container are unified into a cartridge type recording means (head cartridge). However, the present invention is applicable to a case in which the recording head and the ink container are separately provided, and are coupled with an ink supplying pipe or the like, with the same advantageous effects.

Figure 37:
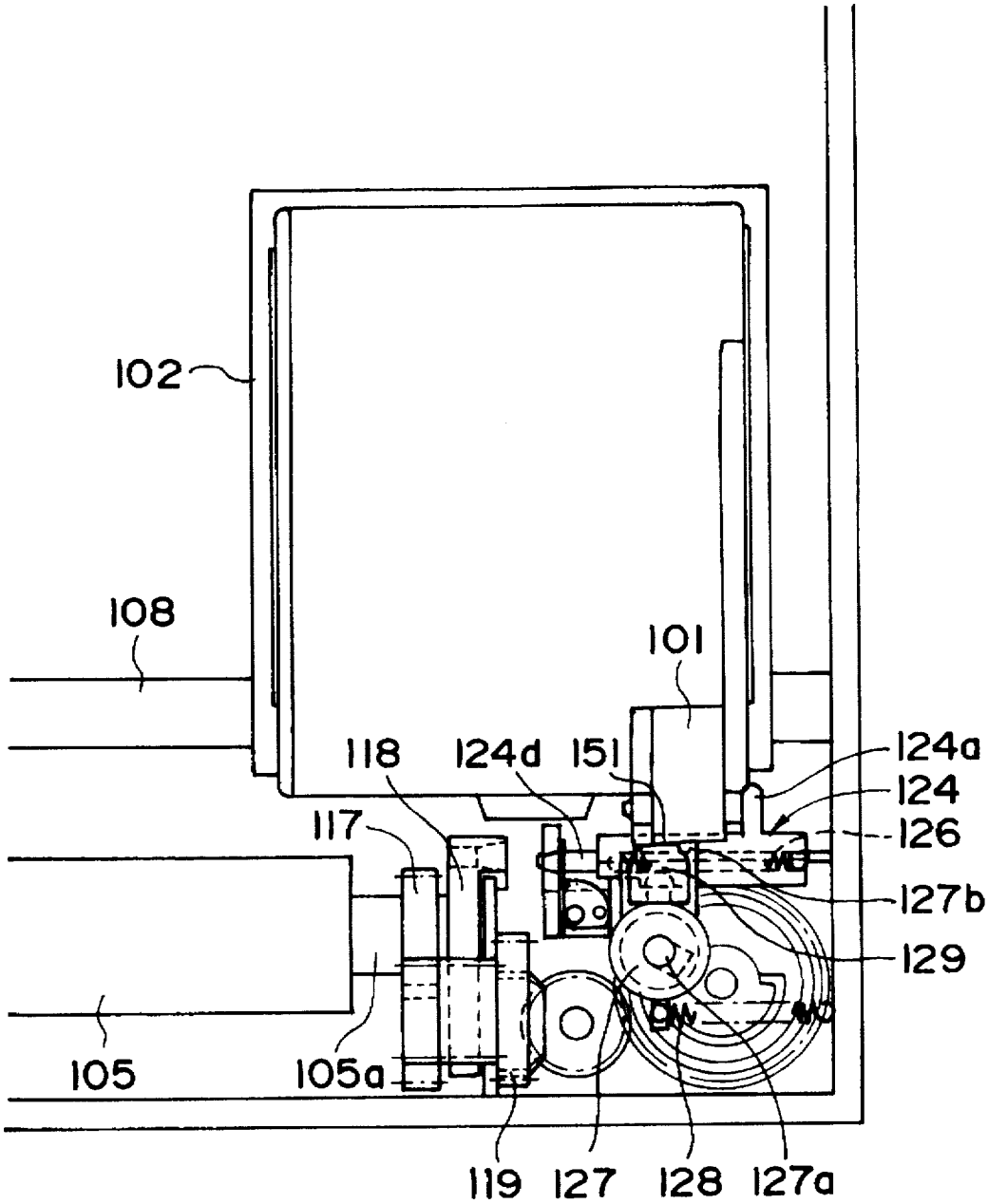
FIG. 37 is a partial front view of the ink jet recording apparatus of FIG. 36 in a capped state of the recording head.
Figure 38:
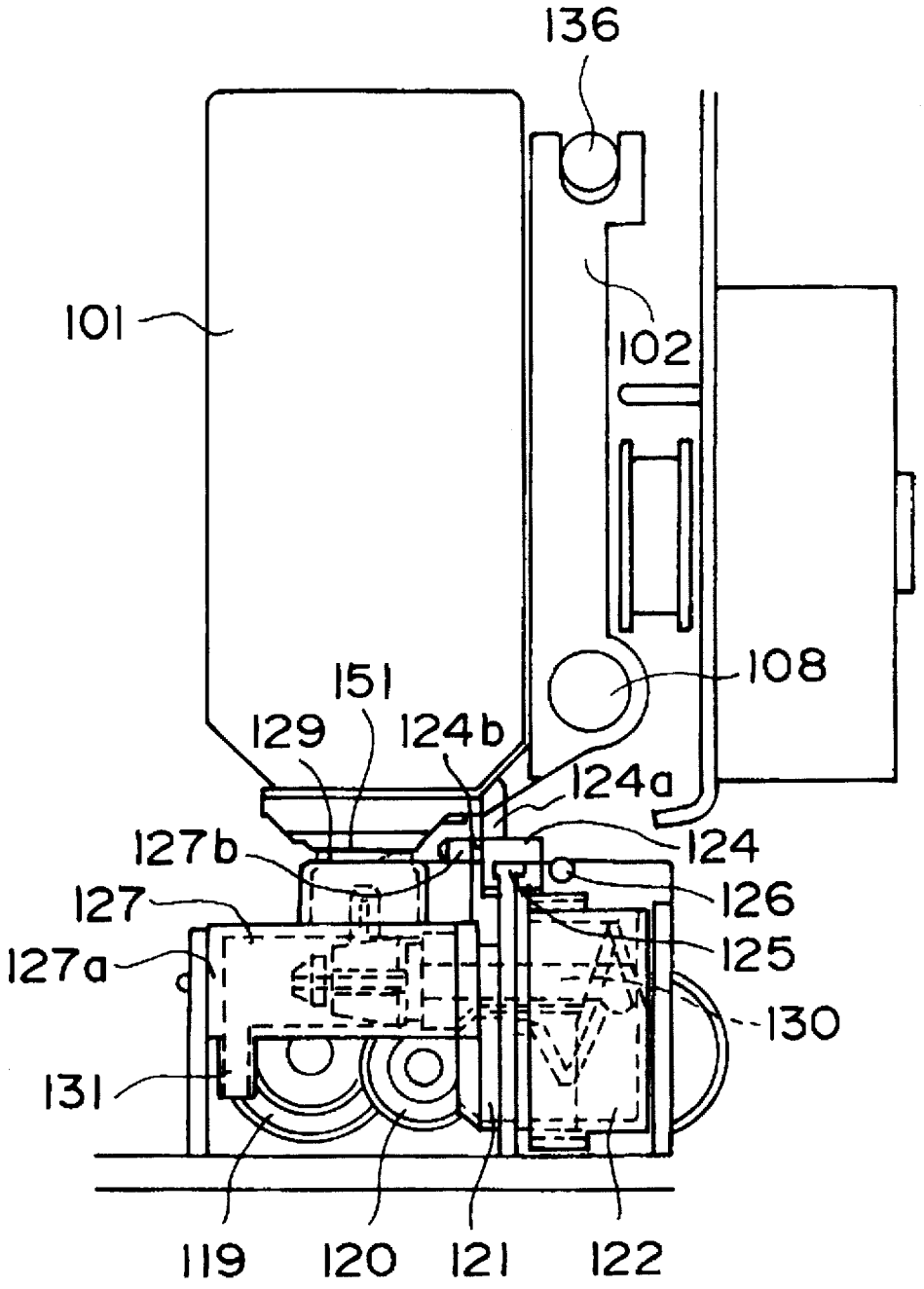
FIG. 38 is a side view of a cylinder and a carriage in the ink jet recording apparatus of FIG. 37.
Figure 39:
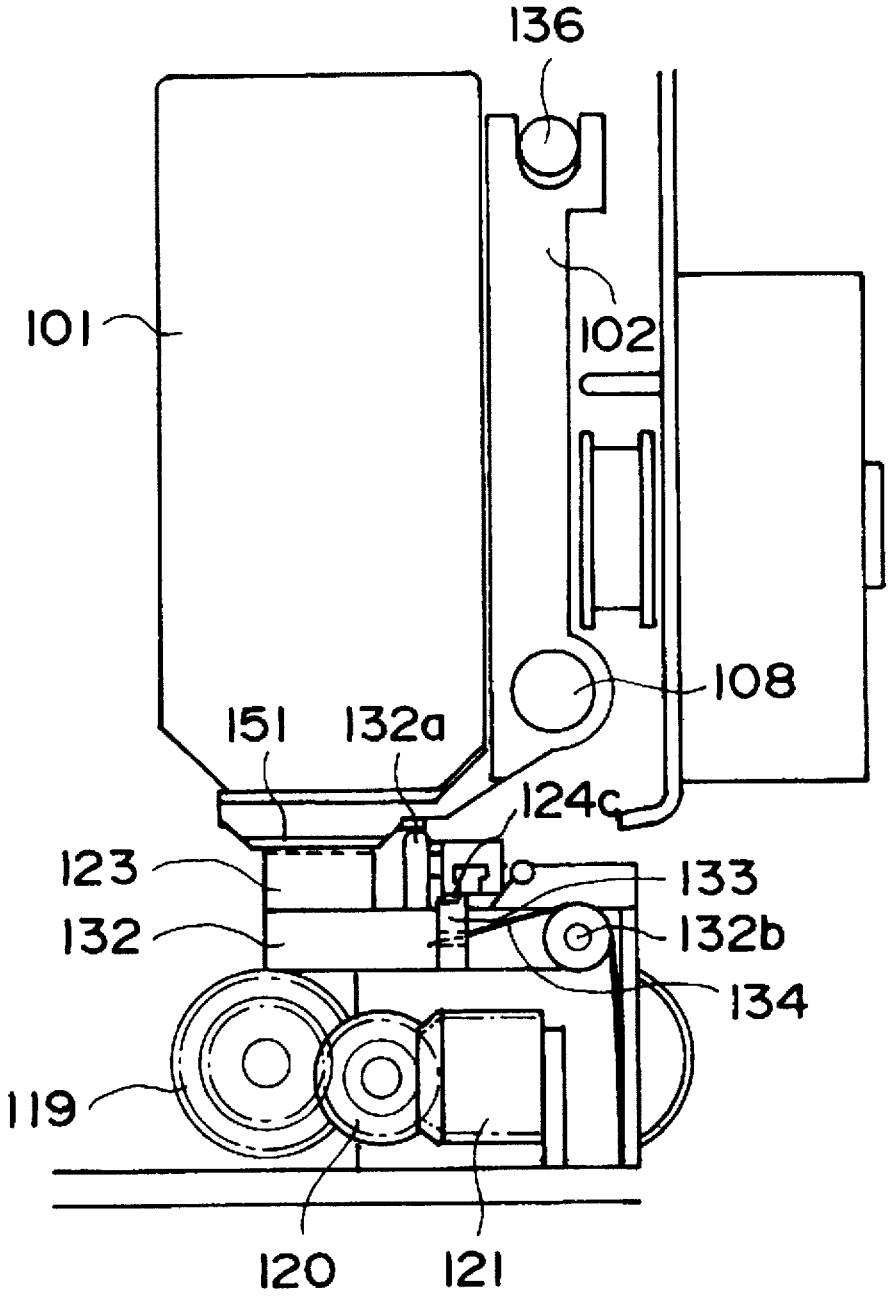
FIG. 39 is a side view of a wider and a carriage of the ink jet recording apparatus of FIG. 37.
Figure 40:
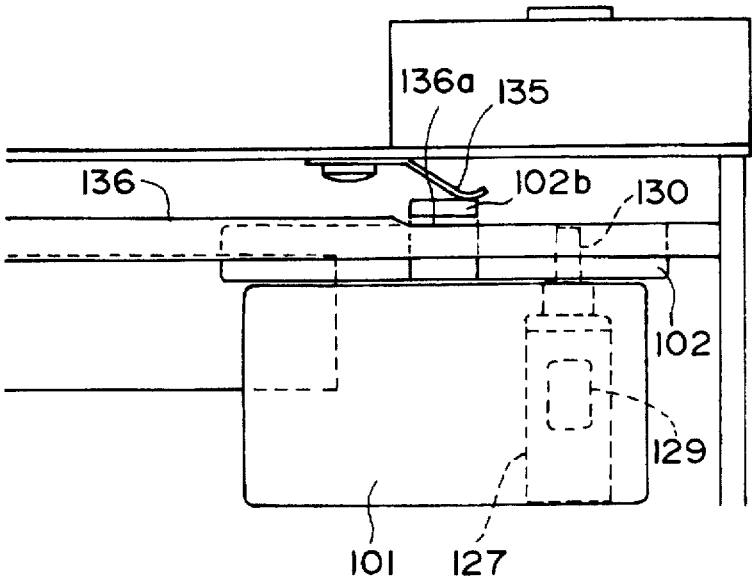
FIG. 40 is a partial top plan view of a major part of the ink jet recording apparatus of FIG. 37.

Referring to FIGS. 36, 37, 38, 39 and 40, an ink Jet recording apparatus according to an eighth embodiment of the present invention is shown. FIGS. 36 and 37 are front views of the ink 3at recording apparatus in which the carriage positions are different. FIGS. 38 and 39 are side views of the recording apparatus as seen from the right, of the apparatus shown in FIGS. 36 and 37, respectively. FIGS. 40 is a top plan view of the recording apparatus.

FIG. 36 shows a state in which the recording head 101 is not capped. FIG. 37 shows a state in which the recording head 101 has been moved to the right end position, and the recording head is capped.

In the position of FIG. 36, the recording head 101 is carried on the carriage 102 in the position for ejecting the ink downwardly, while the carriage 102 is being moved along the guiding shaft 108 (main scan), the image is recorded on the recording material 104. After completion of the recording for one line, the recording operation (ink ejection) is interrupted, and the recording material 104 is fed through a predetermined distance in a direction substantially perpendicular to the carriage movement direction (sub-scan direction). Thereafter, while the carriage 102 is being moved again along the guiding shaft 108 (main scan), the image is recorded for the next line. The recording material 104 is press-contacted to the feed roller 105, and the recording material 104 feed is carried out by rotating the feed roller 105 through a predetermined angular distance.

The driving source for the feed roller 105 is a motor (pulse motor) 106, and the rotational force thereof can be transmitted to a first pump gear 119 through the feed gear 117. The drive transmission and disconnection can be controlled by shifting or switching means in the form of a shifting or switching lever 118. The first pump gear 119 functions to drive a pumping cam 112 through a second pump gear 112 and a third pump gear 121.

Outside the recording region (outside the feed roller length 105) of the ink jet recording apparatus, a wiper 123 is mounted perpendicularly to the movement direction of the carriage 102. When the carriage 102 is moved, it is wiped by the wiper 123 at the ink ejection side 151 of the recording head 101. Outside the recording region, a sliding lever 124 is mounted for the movement to the left and to the right along the sliding rail 125. The slide lever 124 is normally urged to the left by a slide spring 126 to the left in FIG. 36. The slide lever 124 is provided with a head abutment portion 124*a*. When the recording head 101 is at a position more left than the position of FIG. 36, the recording head 101 and the head abutment portion 124*a*, are spaced apart from each other. When the recording head 101 moves to the right in FIG. 36 away from the recording position, the slide lever 124 is moved to the right together with the recording head 101 (carriage 102) by the abutment of the head abutment portion 124*a* of the recording head 101. Also when the recording head 101 is moved to the left from the right end position, the slide lever 124 moves in interrelation with the carriage 102 by the urging force of the slide spring 126, until the head abutment portion 124*a* becomes away therefrom.

A cylinder 127 is rotatable about a rotational shaft 127*a* extending in a direction perpendicular to the carriage 102 movement. To the cylinder 127, a cap 129 for covering the ejection side surface 151 of the recording head 101 is directly connected or fixed. The cap 129 is usually made of rubber elastomer material to maintain the hermetically sealing. The cylinder 127 is urged in the counterclockwise direction in FIG. 36 by a cylinder spring 128. Normally, it is in the state where the cap 129 is inclined and does not cap the recording head 101, as shown in FIG. 36. The cylinder 127 is provided with an engaging portion 127*b* extended outwardly toward the cap 129. When the sliding lever 124 moves to the right, a cylinder driver 124b of the slide lever 124 is engaged with the engaging portion 127*b*.

FIG. 37 shows the state in which the carriage 102 has moved further to the right end from the position of FIG. 36. In FIG. 37, the recording head 101 pushes the head abutment portion 124*a* of the slide lever 124, so that the slide lever 124 moves to the right against the urging force of the slide spring 126 along the slide rail 125. With the rightward movement of the slide lever 124, the cylinder driver 124*b* of the slide lever is brought into engagement with the engaging portion 127*b* of the cylinder 127. Then, it rotates the rotational shaft 127*a* of the cylinder 127 in the clockwise direction against the urging force of the cylinder spring 128. In this manner, in the position of FIG. 37, the cap 129 directly connected or fixed to the cylinder 127 is placed right in front of the recording head 101, and the ejection side surface 151 of the recording head 101 is hermetically capped by the cap 129 (capped state).

FIGS. 38 and 39 are side views of the ink jet recording apparatus of FIGS. 36 and 37, according to the eighth embodiment of the present invention. FIG. 38 is a side view of the cylinder 127 and the peripheral structure thereof. FIG. 39 is a side view of the wiper 123 and the peripheral structures thereof and the pump driving force transmitting mechanism. In the state of FIG. 38, the engaging portion 127*b* of the cylinder 127 is urged by the cylinder driver 124*b* of the slide lever 124, so that the cylinder 127 rotates about the rotational shaft 127*a*, by which the cap 129 hermetically caps the ink ejection side 151 of the recording head 101 (capped state).

In FIG. 38, a piston 130 movable to the left and to the right in the Figure is mounted on the cylinder 127. When the pump cam 122 is rotated by the rotation of the pump gear 119, the piston 130 moves to the left and to the right by the cam surface of the pump cam 122, so that the ink is sucked into the cylinder 127 from the ejection outlets of the recording head 101 through the cap 129 in the capping state. The sucked ink (residual ink) is discharged through a residual ink pipe 131 provided in the cylinder 127. In this manner, the recovery mechanism for recovering the ejection performance of the recording head 101, is established.

In FIG. 39, the wiper 123 is fixed on a wiper holder 132. The overlapping degree between the wiper 123 and the ejection side surface 151 of the recording head 101 is controlled by a projection 132*a* of the wiper holder 132 having a cam configuration conforming to the right side of the ink ejection side surface of the recording head 101. The wiper holder 132 is mounted for rotation about a rotational shaft 132*b* extending in parallel with the carriage movement. It is normally urged to the ejection side surface 151 of the of the recording head 101 by a wiper spring 134 through a wiper cam 133 rotatably mounted on the wiper holder 132.

When the carriage 102 moves to the right in FIGS. 36 and 37, the wiper 123 kicks the wiper cam 133 against the wiper spring 135 force by the wiper cam 124*c* (FIG. 39) of the slide lever 124, so that it wipes the ejection side surface 151 of the recording head with the overlapping degree assured by the wiper holder projection 132*a*.

When the carriage 102 moves to the left, on the other hand, the wiper cam 133 is urged downwardly in FIG. 39 by the wiper cam 124*c* of the slide lever 124, and the wiper holder 132 to which the wiper cam 133 is mounted, is rotated in the counterclockwise direction in FIG. 39 about the rotational shaft 132*b* against the spring force of the wiper spring 134. Accordingly, the wiper 123 held on the wiper holder 132 is spaced away from the ejection side surface 151 of the recording head 101.

FIG. 40 is a top plan view of the apparatus of FIG. 37, wherein the cylinder 127, the cap 129 and the piston 131 are shown in broken lines in the Figure. In FIG. 40, the main assembly of the recording apparatus is provided with a leaf spring 135 for assuring the capping force by urging a rear guiding portion 102*b* of the carriage 102. The rear guiding portion 102*b* normally slides along the rear guide 136 of the main assembly. However, when the carriage 102 reaches the position shown in FIGS. 37 and 40, the rear guiding portion 102*b* is faced to a cut-away portion 36*a* of the rear guide 136, so that a space is established therebetween, thus permitting effective action of the spring force from the leaf spring 135 on the carriage 102. In this state, the carriage 102 is urged in the rotational direction for the recording head 101 to contact the cap 129 about the guiding shaft 102 by the leaf spring 135. By the rotational urging force, the pressing force of the capping is assured.

In this embodiment, the capping pressure between The recording head 101 and the cap 129 is assured by the leaf spring 135 disposed behind the carriage 102, but another alternative is possible, for example, the backside of the carriage 102 is fixed, and the resiliency of the capping member 129 is used to assure the capping pressure.

According to the embodiment described in the foregoing, the cap 129 is directly connected to the cylinder 127 constituting the sucking recovery pump, and therefore, the space between the pump 127 and the cap 129 can be saved. Therefore, the initial sucking force of the pump 127 at the time of initiation of the recovery operation, can be increased.

Also, the parts can be omitted between the pump 127 and the cap 129, and therefore, the liability of the leakage can be reduced. Thus, the reliability of the recording apparatus is reduced with the cost reduction due to the reduction of the part number.

Figure 41:
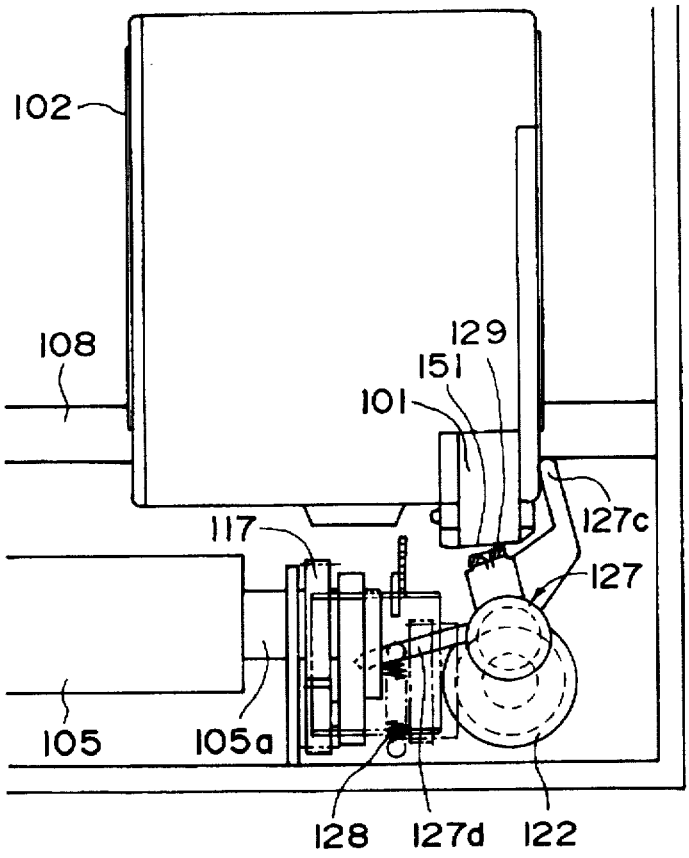
FIG. 41 is a partial front view of a major part of an ink jet recording apparatus according to a ninth embodiment of the present invention.
Figure 42:
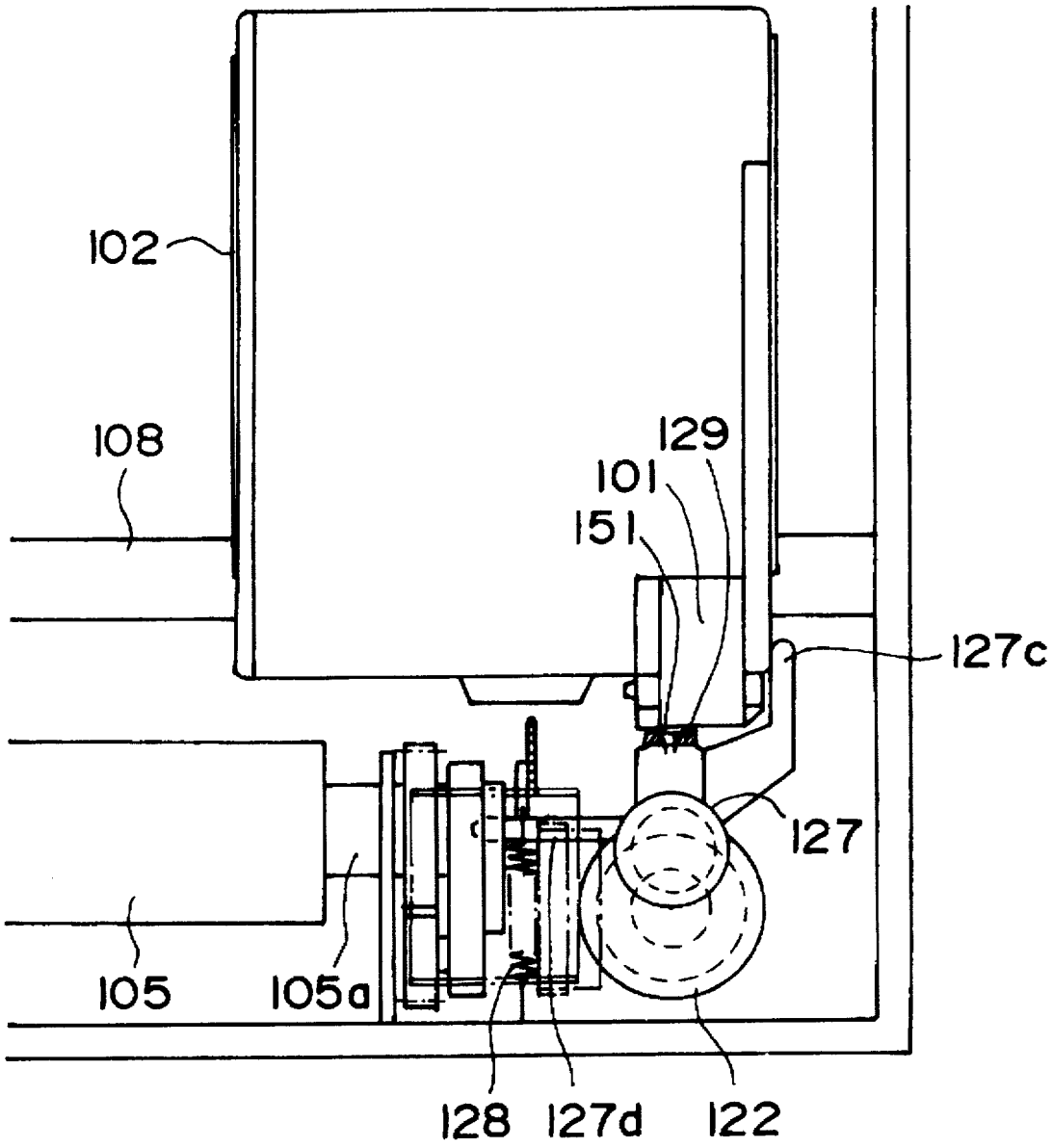
FIG. 42 is a partial front view of an ink jet recording apparatus of FIG. 41 in a capped state of the recording head.
Figure 43:
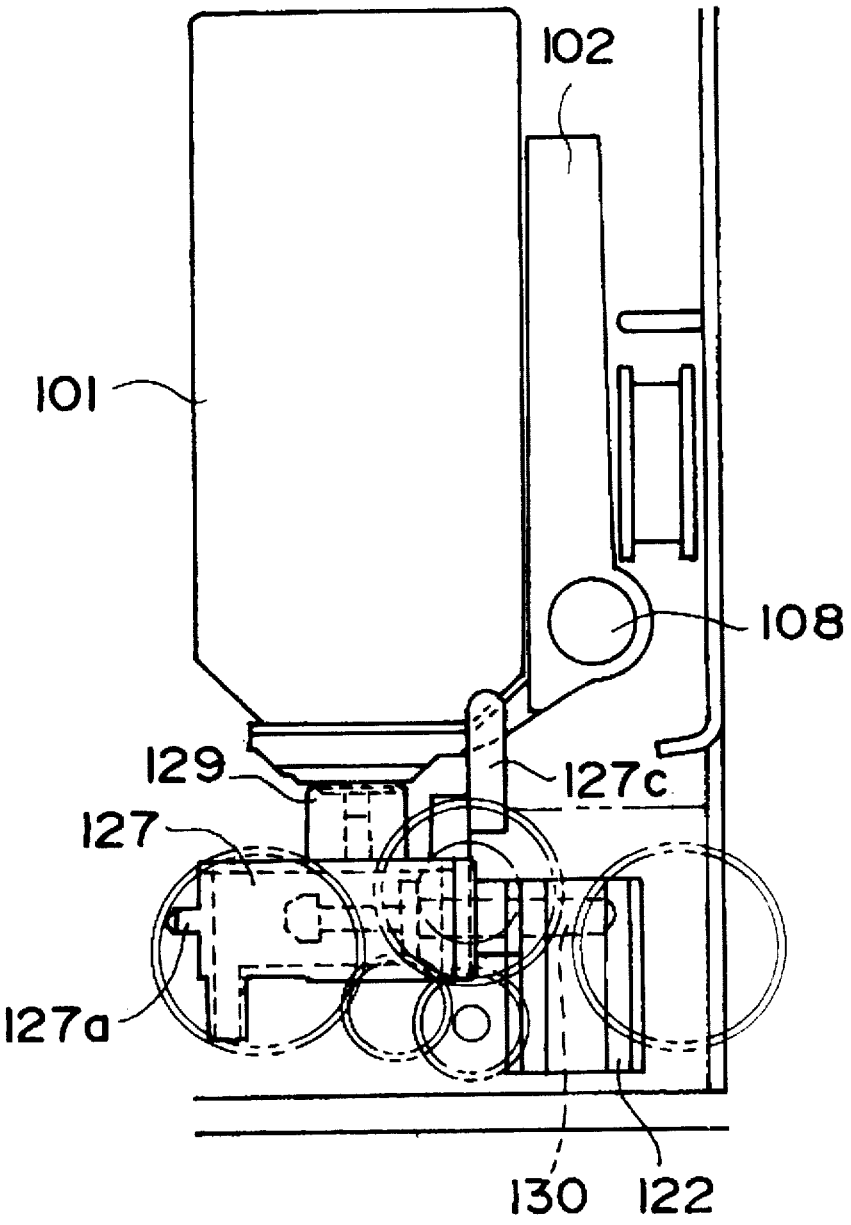
FIG. 43 is a side view of a cylinder and a carriage of the ink jet recording apparatus of FIG. 42.

FIGS. 41, 42 and 43 shows an ink jet recording apparatus according to a ninth embodiment of the present invention. FIG. 41 is a front view of the recording apparatus when the carriage 102 is not at the capping position. FIG. 42 is a front view of the recording apparatus when the carriage 102 is at the cap position. FIG. 43 is a side view of the apparatus of FIG. 42. In FIGS. 41–43, the cylinder 127 having the cap 129 is normally held at non-capping position in which the cap 129 is inclined to be away from the recording head 101, as shown in FIG. 41, by a cylinder spring 128 coupled to an arm 127*d* of the cylinder 127. Thus, when the carriage 102 is at the position shown in FIG. 41, the cap 129 directly connected to the cylinder 127 is generally faced to the recording head 101, but the election side surface 151 of the recording head 101 is opened, and therefore, the recording head 101 is not capped.

FIGS. 42 and 43 show the stare in which the carriage 102 carrying the recording head 101 moves to the right from the position of FIG. 41 to the capping position at the right end. In the state of FIGS. 42 and 43, the recording head 101 pushes the head lever 127*c* of the cylinder 127, by which the cylinder 127 rotates against the spring force of the cylinder 128, so that the capping state is established in which the cap 129 is closely contacted to the ejection side surface 151 of the recording head 101. In this embodiment, too, as shown in FIG. 43, the cylinder 127 is rotatable about a rotational shaft 127*a*, and the piston 130 engaged in the cylinder (pump) 127 is driven by the pump cam 122. The other structures and the other operations of the ink jet recording apparatus of the ninth embodiment shown in FIGS. 41–43, are substantially the same as those of the eighth embodiment shown in FIGS. 36–40, and therefore, the corresponding elements are assigned the same reference numerals, and the detailed description thereof is omitted.

In the ninth embodiment of FIGS. 41–43, the same advantageous effects as in the eighth embodiment of FIGS. 36–40, can be provided. More particularly, since the cap 129 is directly connected to the cylinder 127 constituting the pump for the sucking recovery operation, the space between the pump 127 and the cap 129 can be saved, and during the recovery operation, the initial sucking force provided by the pump 127 can be increased. In addition, the parts between the pump 127 and the cap 129, can be omitted, and therefore, the liability of the leakage is reduced. Thus, the reliability of the recording apparatus is improved with the reduction of the cost due to the reduction of the number of parts.

Figure 44:
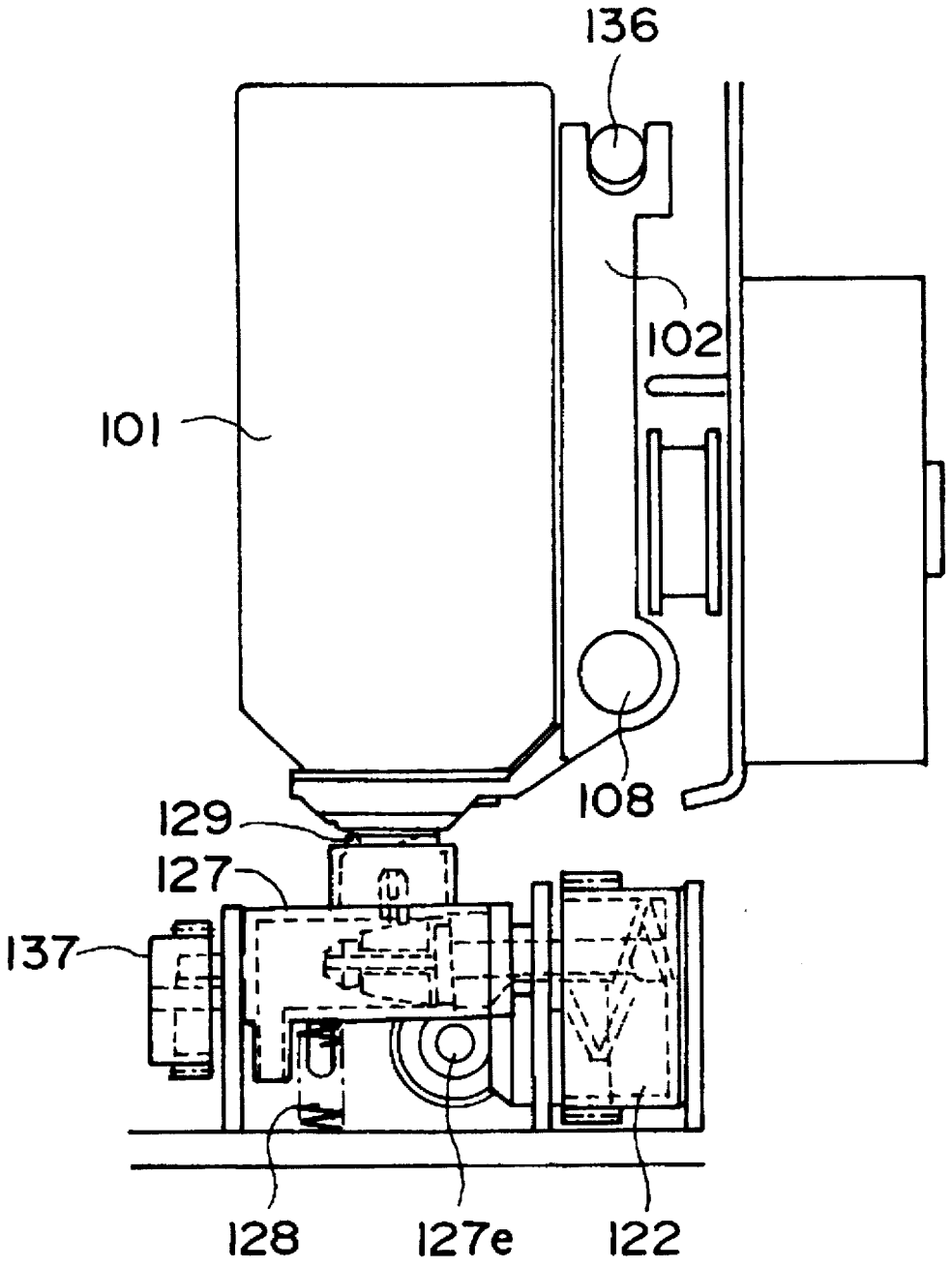
FIG. 44 is a side view of a major part of an ink jet recording apparatus according to a tenth embodiment of the present invention.
Figure 45:
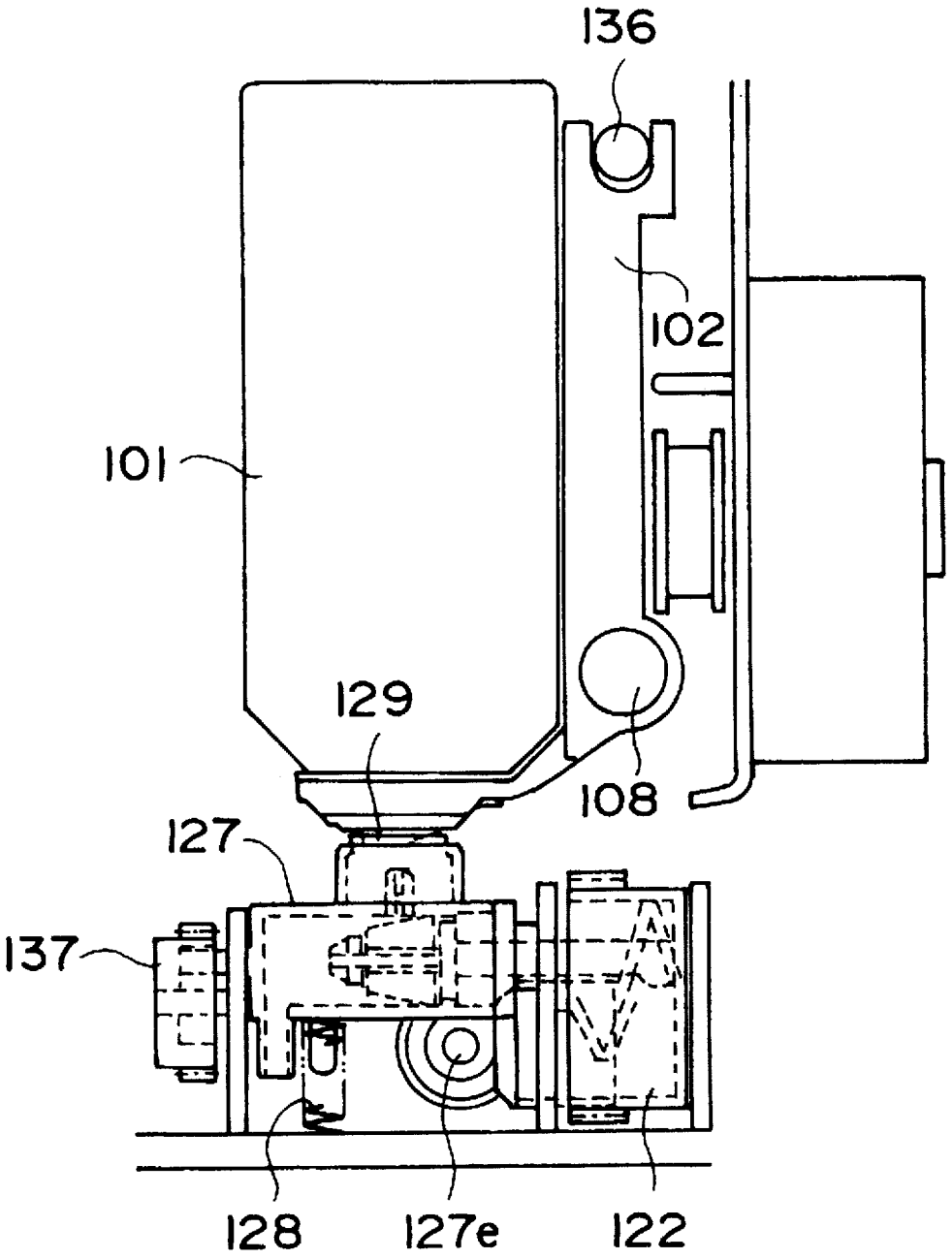
FIG. 45 is a side view of the ink jet recording apparatus of FIG. 44 in a capped state of the recording head.

Referring to FIGS. 44 and 45, there is shown an ink jet recording apparatus according to a tenth embodiment of the present invention. FIG. 44 shows a state in which the recording head carried on the carriage 101 is not capped. FIG. 45 shows the state in which the recording head 101 is capped. In FIGS. 44 and 45, the cap 129 is directly connected to the cylinder 127. The cylinder 127 is supported for rotation about a pivot 127*e* between a capping position and an open position. The cylinder 127 is urged upwardly in the Figure toward the closing position with the cap spring 138. The closing position and the open position of the cylinder 127 is limited by a cap cam 137 driven by an unshown driving source.

In FIG. 44, the cylinder 127 is rotated in the counterclockwise direction so that the left end in the Figure inclines downwardly about the center 127*e* against the cap spring 138. Therefore, a clearance is provided between the cap 129 and the recording head 101, so that the ejection side surface 151 is opened. On the other hand, in the state of FIG. 45, the cap cam 131 is rotated to a position not limiting the cylinder 127. Then, the cylinder 127 is rotated to a position for contacting the cap 129 to the ejection side surface 151 about the center 127*e* by the cap spring 138. Therefore, the capping station is established in which the recording head 101 is hermetically capped by the cap 129.

The tenth embodiment of FIGS. 44 and 45 is different from the eighth and tenth embodiments in the portions described above. However, the tenth embodiment is substantially the same in the other respects. Therefore, the detailed description of the common parts are omitted by assigning the same reference numerals to the corresponding elements.

Accordingly, in the tenth embodiment, similar to the foregoing embodiments, the cap 129 is directly connected to the cylinder 127 constituting the sucking recovery pump, and therefore, the space between the pump 127 and the cap 129 can be saved. During the recovery operation, this enhances the initial sucking force of the pump 127. The embodiment is also effective to omit the parts between the pump 127 and the cap 129, and the liability of the leakage is decreased, so that the reliability of the recording apparatus is improved with the cost reduction due to the reduction of the number of parts.

Figure 46:
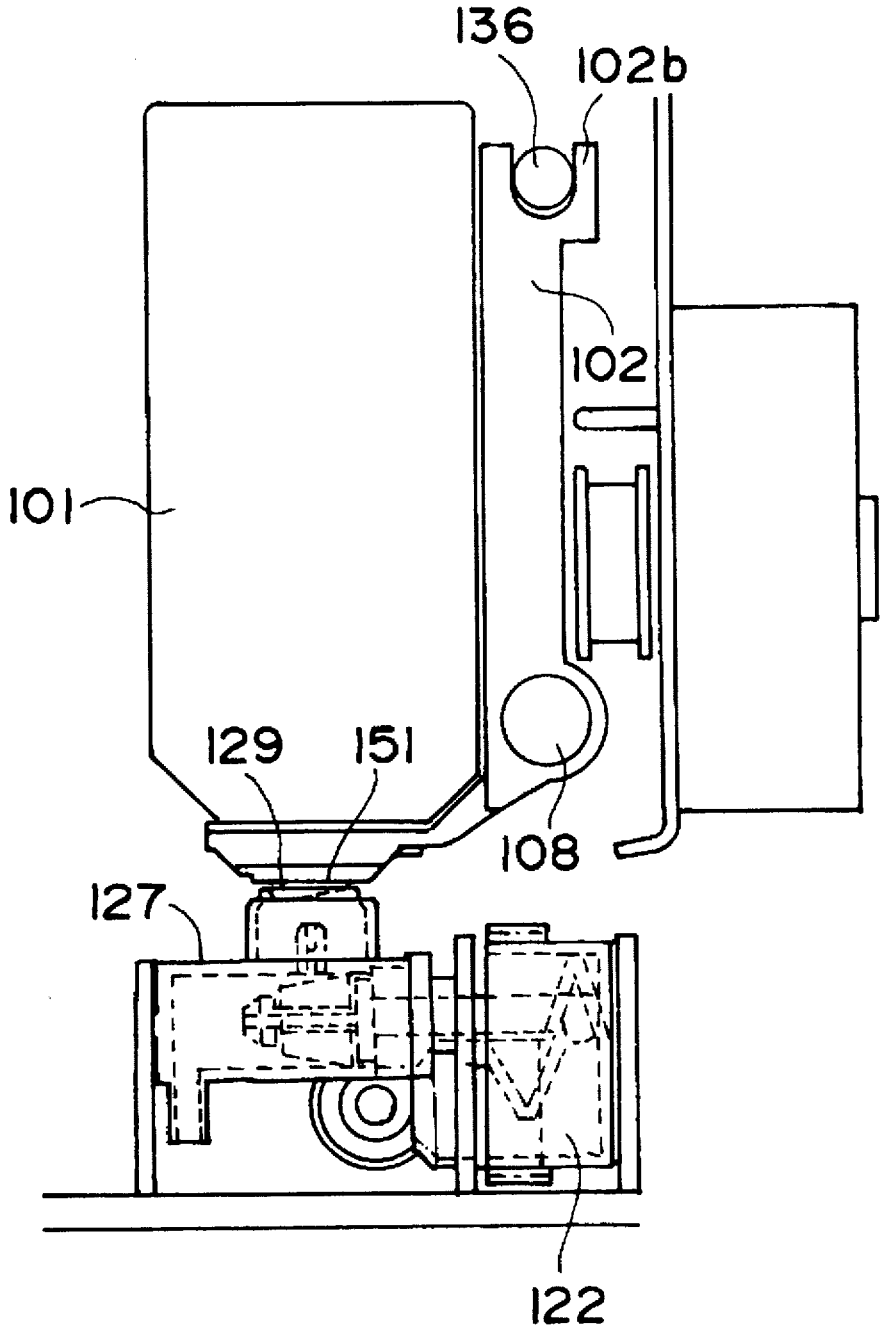
FIG. 46 is a side view of a major part of the ink jet recording apparatus according to an eleventh embodiment of the present invention.
Figure 47:
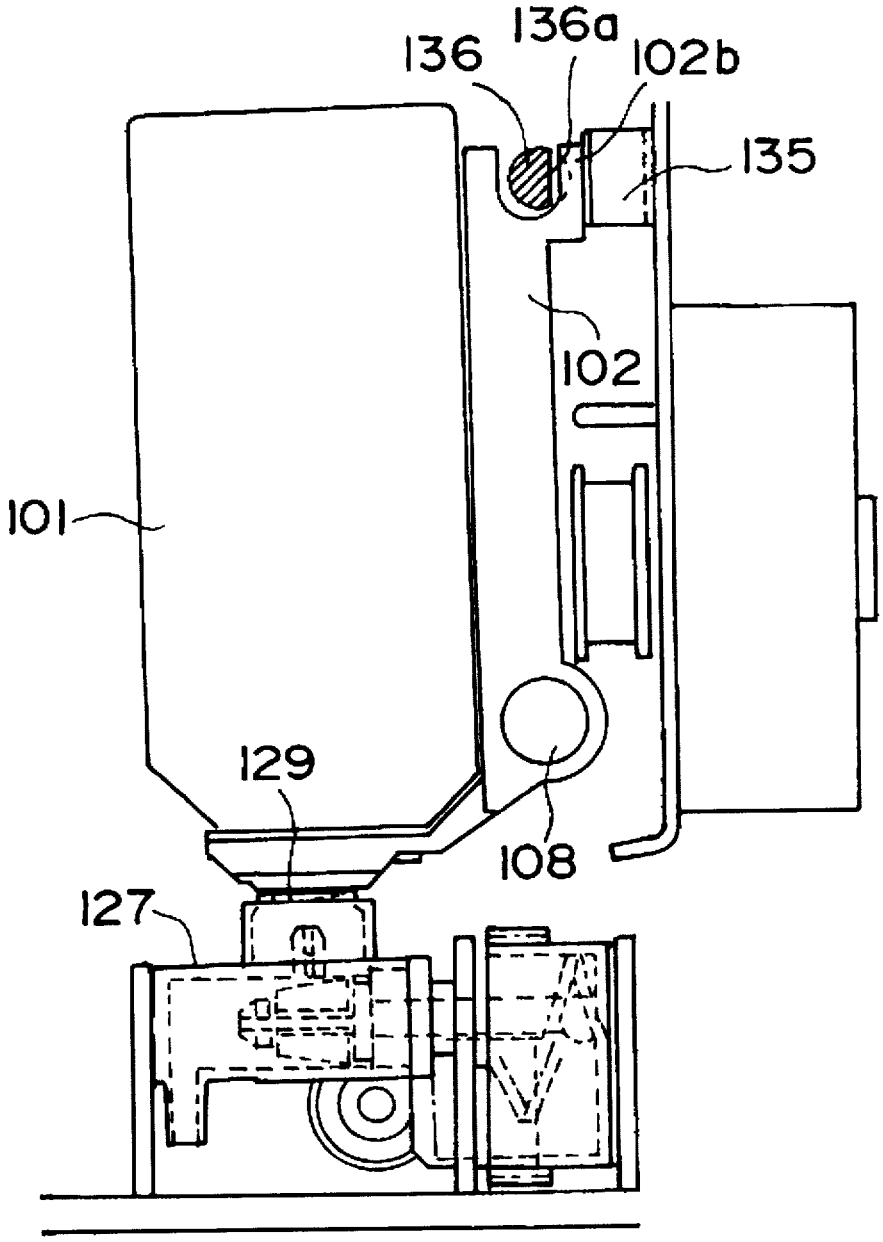
FIG. 47 is a side view of the ink jet recording head of FIG. 46 in a capped state of the recording head.

Referring to FIGS. 46 and 47, there is shown an ink Jet recording apparatus according to an eleventh embodiment of the present invention. FIG. 46 shows a state in which the recording head 101 carried on the carriage 102 is not capped. FIG. 47 shows the state in which the recording head 101 is capped. In FIGS. 46 and 47, the cap 129 is directly connected to the cylinder 27. In this case, the cylinder 127 is fixed against for rotation about its axis. The cap 129 is fixed on the cylinder 127 with a predetermined small angle so that the left end thereof is lowered. On the other hand, the right end (capping position) of the rear guide 136 engaged with a rear guiding portion 102*b* of the carriage at the upper back position, is provided with a cut-away portion 136*a*, as shown in FIG. 47. A portion of the main assembly corresponding to the capping position of the carriage 102, is provided with a leaf spring 135 (FIG. 47) as in the embodiment of FIG. 40. The leaf spring 135 is effective to urge the carriage 102 in The counterclockwise direction about the guiding shaft 108.

When the carriage 102 is at the normal position (non-capping position), the rear guiding portion 102*a* is engaged with the rear guide 136, as shown in FIG. 46, so that the carriage 102 is retained at a non-rotating position (normal recording position). When the carriage 102 moves to the capping position of FIG. 47 to the normal position of FIG. 46, the rear guiding portion 102*b* is aligned with the cut-away portion 136*a*, and the carriage 102 is pushed by a leaf spring 135 at the back thereof.

Therefore, the carriage 102 rotates in the counterclockwise direction about the guiding shaft 108, and therefore, the ejection side surface 151 of the recording head 101 is press-contacted to the cap 129 which is mounted inclinedly. In this manner, the recording head 101 is automatically capped by the movement of the carriage 2.

The eleventh embodiment shown in FIGS. 46 and 47 are different from the foregoing embodiments in the respects described above, but it is substantially the same as these embodiments, and therefore, the detailed description of the common parts are omitted by assigning the same reference numerals to the corresponding elements. Accordingly, the same advantageous effects are provided by the eleventh embodiment. More particularly, since the cap 129 is directly connected to the cylinder 127, the space between the pump 127 and the cap 129 can be saved. During the recovery operation, the initial sucking force of the pump 127 can be increased. Because the parts are omitted between the pump 127 and the cap 129, the liability of the leakage, can be reduced. Thus, the reliability o=the apparatus is improved together with the advantage of the reduction of cost due to the reduction of the number of parts.

In the foregoing, the description has been made with respect to the serial type ink jet recording apparatus in which the recording means (recording head) 101 is carried on a carriage 102 and is moved along the recording material 104 in the main scan direction. However, the present invention is equally applicable to a line type ink jet recording apparatus using a line type recording means covering an entirety or a part of the recording width for the recording material, with the same advantageous effects. In the foregoing embodiments, only one recording head is used (single color recording) in the ink jet recording apparatus. However, the present invention is applicable to a color recording ink jet apparatus using plural color recording heads containing different color ink materials or to a tone recording ink jet recording apparatus having plural recording heads containing the same color but different density ink materials. Thus, the present invention is applicable irrespective of the number of recording heads with the same advantageous effects. As for the recording means (recording head) 101, it may be a cartridge type having the recording head and the ink container as a unit, or separate recording means and ink container in which the recording head and the ink container are separate, but are connected by ink supplying tube. In either case, the advantageous effects are provided.

The present invention is usable with an ink jet recording apparatus using electromechanical transducers or the like such as piezoelectric elements in the recording means or recording head.

The present invention is particularly suitably usable in an ink jet recording head and recording apparatus wherein thermal energy by an electrothermal transducer, laser beam or the like is used to cause a change of state of the ink to eject or discharge the ink. This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording heads combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural heads corresponding to the plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in She foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is applied, but the present invention is also applicable to other types of ink. In one of them, the temperature rise due to the thermal energy is positively prevented by consuming it for the stage change of the ink from the solid state to the liquid state. Another ink material is solidified when it is left unused, to prevent the evaporation of the ink. In either of the cases, upon the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

As described in the foregoing, according to the present invention, there is provided a recording apparatus in which the drive transmitting state and the non-transmitting state is selected automatically by the movement of the carriage, and therefore, the cost can be reduced by reducing the number of driving sources. Also, the dimension of the apparatus in the direction of the width can be reduced so that the size and the weight of the apparatus can be reduced. Furthermore, the switching period can be reduced, and the operational sequence can be simplified.

According to another embodiment of the present invention, the drive transmission is enabled in only one of the forward and backward rotation, and the operational mode is switched by the movement of the carriage. With this structure, the operational sequence is further simplified, and the throughput of the entire recording system is further improved.

According to an embodiment of the present invention, the switching from the neutral position to the operational position is interrelated with the capping action for capping the ejection side surface of the recording means, and therefore, the operational efficiency is improved.

According to an embodiment of the present invention, the cap for capping the ejection side surface of the recording means is directly connected to a cylinder constituting the pump, and therefore, the initial sucking force during the recovery operation can be easily assure, and therefore, the reliability of the recovery apparatus and the cost reduction can be further achieved.

According to an embodiment of the present invention, the structure can be employed in which the cylinder is movable, in which the ejection side surface of the recording head is capped by moving the cylinder by the movement of the carriage, and/or, in which the capping pressure is produced behind the carriage. By doing so, the above-described advantageous effects are further enhanced.

While the invention has been described with reference to the structures disclosed herein, it is not confined to the details set forth and this application is intended to cover such modifications or changes as may come within the purposes of the improvements or the scope of the following claims.

What is claimed is:

1. A recording apparatus for use with a recording head for recording and a driving source for generating a driving force, said recording apparatus comprising:

a carriage, movable in a direction, for carrying the recording head;

a first rotatable transmission member for transmitting the driving force to a first mechanism;

a second rotatable transmission member, disposed substantially in a same plane that said first rotatable transmission member is disposed in, for transmitting the driving force to a second mechanism; and a swingable switching member, disposed between said first rotatable transmission member and said second rotatable transmission member said swingable switching member switching transmission of the driving force to one of said first rotatable transmission member and said second rotatable transmission member by a swinging motion of said swingable switching member between said first rotatable transmission member and said second rotatable transmission member along a plane substantially perpendicular to the direction of movement of said carriage, wherein said first and second rotatable transmission members are rotatable in a common plane, and said swingable switching member is swingable in said common plane.

2. A recording apparatus according to claim 1, wherein the recording head has an ejection outlet, said recording apparatus further comprising:

cap means for capping the ejection outlet of the recording head; and suction means for suctioning ink through the ejection outlet of the recording head and through said cap means, wherein said cap means is unified with a cylinder of said suction means, and wherein said cap means caps the ejection outlet in accordance with movement of said cylinder together with movement of said carriage.

3. A recording apparatus according to claim 2, further comprising:

the driving source for generating the driving force, wherein said swingable switching member switches transmission of the driving force in accordance with a rotational direction of said driving source, and wherein said switching member effects its switching operation in accordance with a position of said carriage.

4. A recording apparatus according to claim 3, wherein the recording head is detachably mountable to said recording apparatus.

5. A record apparatus according to claim 4, wherein said swingable switching member switches transmission of the driving force from a non-transmitting state to a transmitting state, in accordance with an operation for capping the ejection outlet.

6. A recording apparatus according to claim 3, wherein the recording head is provided with energy generating means for generating energy contributable to eject the ink.

7. A record apparatus according to claim 6, wherein the energy generating means is in the form of an electrothermal transducer for producing thermal energy as the energy.

8. A recording apparatus according to claim 3, wherein said driving source means is rotated in one direction in a drive transmission state thereof.

9. A recording apparatus according to claim 2, wherein said cylinder is rotatable.

10. A recording apparatus according to claim 2, wherein the recording head is provided with energy generating means for generating energy contributable to eject the ink.

11. A recording apparatus according to claim 10, wherein the energy generating means comprises an electrothermal transducer for generating, as the energy, thermal energy.

12. A recording apparatus according to claim 2, wherein a cap urging means for urging said cap means is provided behind said carriage.

* * * * *

UNITED STATES PATENT AND TRADEMARK OFFICE

CERTIFICATE OF CORRECTION

PATENT NO. : 5,733,055

DATED : March 31, 1998

INVENTOR(S) : Hiramatsu et al.

It is certified that error appears in the above-identified patent and that said Letters Patent is hereby corrected as shown below:

On title page, item

[56] References Cited:

U.S. PATENT DOCUMENTS

"Yamagmoto et al." should read --Yamamoto et al.--.

COLUMN 1:

Line 57, "evaporating" should read --evaporating,--.

COLUMN 2:

Line 59, "farce" should read --force--.

COLUMN 3:

Line 17, "This" should read --this--;
Line 23, "election" should read --ejection--;
Line 25, "election" should read --ejection--;
Line 29, "as" should read --as a--; and
Line 39, "Guiding" should read --guiding--.

COLUMN 6:

Line 16, "wider" should read --wiper--.

COLUMN 7:

Line 29, "moved," should read --moves,--;

UNITED STATES PATENT AND TRADEMARK OFFICE

CERTIFICATE OF CORRECTION

PATENT NO. : 5,733,055

DATED : March 31, 1998

INVENTOR(S) : Hiramatsu et al.

It is certified that error appears in the above-identified patent and that said Letters Patent is hereby corrected as shown below:

Line 33, "a" should read --by a--;
Line 46, "Is" should read --is--;
Line 60, "show" should read --shown--; and
Line 67, "The" should read --the--.

COLUMN 9:

Line 10, "Switching" should read --switching--; and
Line 13, "for the" should read --for--.

COLUMN 10:

Line 25, "faced to" should read --faces--.

COLUMN 11:

Line 32, "pump," should read --pump--; and
Line 36, "Same" should read --same--.

COLUMN 12:

Line 17, "Shown" should read --shown--;
Line 19, "Switching" should read --switching--; and
Line 39, "game" should read --same--.

UNITED STATES PATENT AND TRADEMARK OFFICE

CERTIFICATE OF CORRECTION

PATENT NO. : 5,733,055

DATED : March 31, 1998

INVENTOR(S) : Hiramatsu et al.

It is certified that error appears in the above-identified patent and that said Letters Patent is hereby corrected as shown below:

COLUMN 13:

Line 7, "are" should read --is--;
Line 15, "5: it" should read --5, but it--; and
Line 43, "hand. The" should read --hand, the--.

COLUMN 14:

Line 47, "driven," should read --driven--; and
Line 56, "show" should read --shown--.

COLUMN 15:

Line 11, "go" should read --to--;
Line 12, "Of" should read --of--;
Line 34, "of" should be deleted; and
Line 66, "teeth" should read --tooth--.

COLUMN 16:

Line 15, "a" should be deleted; and
Line 54, "are" should read --is--.

COLUMN 17:

Line 63, "gear.35" should read --gear 35--.

UNITED STATES PATENT AND TRADEMARK OFFICE

CERTIFICATE OF CORRECTION

PATENT NO. : 5,733,055

DATED : March 31, 1998

INVENTOR(S) : Hiramatsu et al.

It is certified that error appears in the above-identified patent and that said Letters Patent is hereby corrected as shown below:

COLUMN 18:

Line 35, "Jet" should read --jet--;
Line 38, "3at" should read --jet--; and
Line 40, "right," should read --right--.

COLUMN 20:

Line 55, "The" should read --the--.

COLUMN 21:

Line 22, "stare" should read --state--.

COLUMN 22:

Line 29, "Jet" should read --jet--;
Line 46, "The" should read --the--; and
Line 63, "are" should read --is--.

COLUMN 23:

Line 9, "o=the" should read --of the--.

UNITED STATES PATENT AND TRADEMARK OFFICE

CERTIFICATE OF CORRECTION

PATENT NO. : 5,733,055 Page 5 of 5

DATED : March 31, 1998

INVENTOR(S) : Hiramatsu et al.

It is certified that error appears in the above-indentified patent and that said Letters Patent is hereby corrected as shown below:

COLUMN 24:

Line 45, "mountable" should read --mounting--;
Line 46, "single" (1st occurrence) should read —single head—
Line 55, "She" should read --the--; and
Line 61, "in" should read --in the--.

COLUMN 25:

Line 32, "rotation," should read --rotations,--; and
Line 45, "assure," should read --assured,--.

COLUMN 26:

Line 7, "member" should read --member,--;
Line 42, "record" should read --recording--; and
Line 50, "record" should read --recording--.

Signed and Sealed this

First Day of December, 1998

*Attest:*

*Attesting Officer*

Bruce Lehman

BRUCE LEHMAN

*Commissioner of Patents and Trademarks*